US012427356B2

(12) United States Patent
Bassoo

(10) Patent No.: US 12,427,356 B2
(45) Date of Patent: Sep. 30, 2025

(54) TRAINING BAG COMPRISING ADJUSTABLE WEIGHTS, DRAGGING SURFACE, WEIGHTED BAG AND COMPONENTS FOR PHYSICAL ACTIVITIES

(71) Applicant: Naipaul Bassoo, North York (CA)

(72) Inventor: Naipaul Bassoo, North York (CA)

( * ) Notice: Subject to any disclaimer, the term of this patent is extended or adjusted under 35 U.S.C. 154(b) by 139 days.

(21) Appl. No.: 17/722,476

(22) Filed: Apr. 18, 2022

(65) Prior Publication Data

US 2022/0288440 A1 Sep. 15, 2022

Related U.S. Application Data

(63) Continuation-in-part of application No. 16/656,840, filed on Oct. 18, 2019, now Pat. No. 11,318,345,
(Continued)

(51) Int. Cl.

| | |
|---|---|
| ***A63B 21/06*** | (2006.01) |
| ***A44B 13/00*** | (2006.01) |
| ***A44B 19/26*** | (2006.01) |
| ***A45C 13/02*** | (2006.01) |
| ***A45F 3/04*** | (2006.01) |

(Continued)

(52) U.S. Cl.
CPC ..... *A63B 21/0605* (2013.01); *A44B 13/0029* (2013.01); *A44B 19/26* (2013.01); *A45C 13/02* (2013.01); *A45F 3/047* (2013.01); *A63B 21/065* (2013.01); *A63B 21/4007* (2015.10); *A63B 21/4035* (2015.10); *A63B 23/047* (2013.01);
(Continued)

(58) Field of Classification Search
CPC ... A63B 6/00; A63B 21/0552; A63B 21/0555; A63B 21/0602; A63B 21/0603; A63B 21/0605; A63B 21/065; A63B 21/169; A63B 21/4007; A63B 21/4033; A63B 21/4035; A63B 21/4037; A63B 23/047; A63B 69/0028; A63B 71/0036; A63B 71/0054; A63B 71/03; A63B 2071/0694; A63B 2208/12; A63B 2209/10; A63B 2210/50; A63B 2214/00; A63B 2225/09; A63B 2225/093; A63B 2225/60; A63B 2225/68; A63B 2225/682; A63B 2225/685; A63B 2225/687; A45C 3/00; A45C 3/02; A45C 7/0095; A45C 9/00; A45C 13/02; A45F 3/04; A45F 4/02
See application file for complete search history.

(56) References Cited

U.S. PATENT DOCUMENTS 5,251,945 A * 10/1993 Stoops ..... A45C 7/0095 D34/28
5,337,933 A * 8/1994 Nunez ..... A01K 97/06 224/660

(Continued)

*Primary Examiner* — Joshua Lee

(57) ABSTRACT

This disclosure describes a training bag apparatus including weights of the apparatus, one or more fixed and removable components. The training bag is adaptable for exercises wherein one or more fixed and removable elements is utilized as a slam bag, sled, backpack, weighted vest with adjustable internal weights to utilize individually or as an entire training system. The fixed and removable elements comprise of grips, adjustable straps, draggable surface, backpack straps, harness, connecting straps, adjustable internal straps with internal filler weights to use individually and/or as a complete set.

16 Claims, 30 Drawing Sheets

Related U.S. Application Data which is a continuation-in-part of application No. 15/983,505, filed on May 18, 2018, now Pat. No. 10,561,886.

(51) Int. Cl.
*A63B 21/00* (2006.01)
*A63B 21/065* (2006.01)
*A63B 23/04* (2006.01)

(52) U.S. Cl.
CPC ..... *A63B 2209/10* (2013.01); *A63B 2214/00* (2020.08)

(56) References Cited

U.S. PATENT DOCUMENTS 6,149,555 A * 11/2000 Kinback ..... A63B 21/0603 482/93
6,296,094 B1 * 10/2001 Knecht ..... A45C 7/0095 206/281
8,474,614 B2 * 7/2013 Hanson ..... B65D 81/1275 206/583
9,908,678 B2 * 3/2018 Hanson ..... B65D 81/02
10,004,936 B1 * 6/2018 Ekstrom ..... A63B 21/0604
10,149,997 B1 * 12/2018 Henniger ..... A63B 21/0603
10,251,721 B2 * 4/2019 Garratt ..... A61B 50/20
10,343,009 B2 * 7/2019 Peyton ..... A63B 21/072
10,561,885 B1 * 2/2020 Lewis, Jr. ..... A63B 21/0603
11,583,046 B2 * 2/2023 Obst ..... A45C 7/0095
2006/0207697 A1 * 9/2006 Greiner ..... A45C 7/0095 150/113
2007/0049469 A1 * 3/2007 Brown ..... A63B 21/0603 482/93
2007/0215501 A1 * 9/2007 Hanson ..... B65D 85/30 206/583
2010/0048363 A1 * 2/2010 Gilberti ..... A63B 21/0603 482/105
2011/0012309 A1 * 1/2011 Schreff ..... A63B 43/002 473/598
2013/0157815 A1 * 6/2013 Reynolds ..... A63B 21/0603 482/93
2013/0277253 A1 * 10/2013 Hanson ..... B65D 85/30 206/320
2015/0051053 A1 * 2/2015 Conen ..... A63B 21/4035 482/108
2015/0174466 A1 * 6/2015 Folland ..... A45C 9/00 206/315.1
2016/0129292 A1 * 5/2016 Stroup ..... A63B 23/12 434/247
2018/0333603 A1 * 11/2018 Peyton ..... A63B 21/0605
2021/0000232 A1 * 1/2021 Obst ..... A45C 7/0095

* cited by examiner

FIG. 1
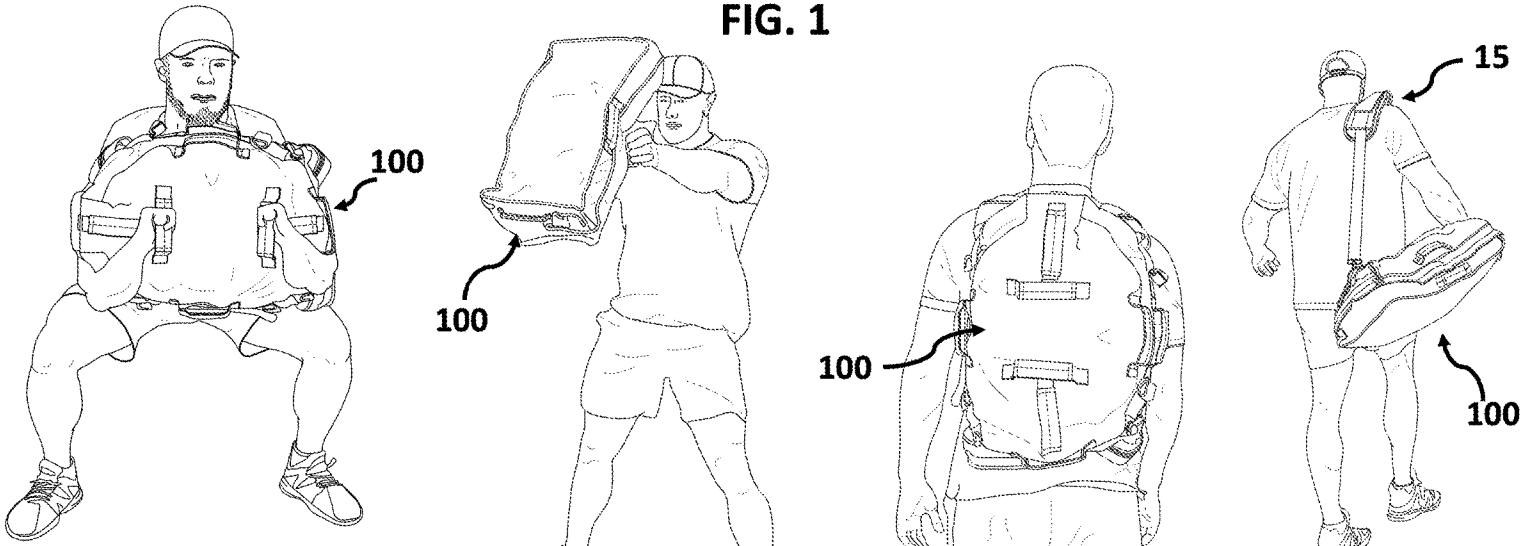
FIG. 1a
FIG. 1b
FIG.1c
FIG. 1d
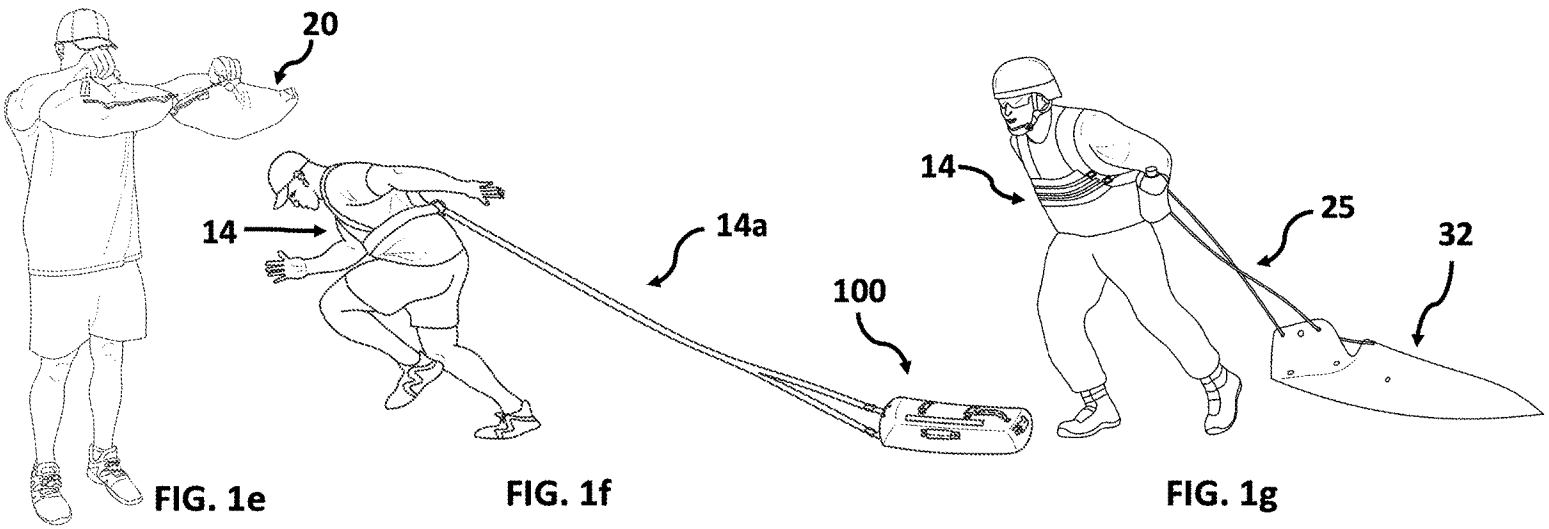
FIG. 1e
FIG. 1f
FIG. 1g 100
1
2
11a
5
6
6a
7

20
1
2
7
17
5
29
6
6a
31
11
19
13
12
101

100
1
2
4
5
11
11a
11b
17
17a
29
30

FIG. 8
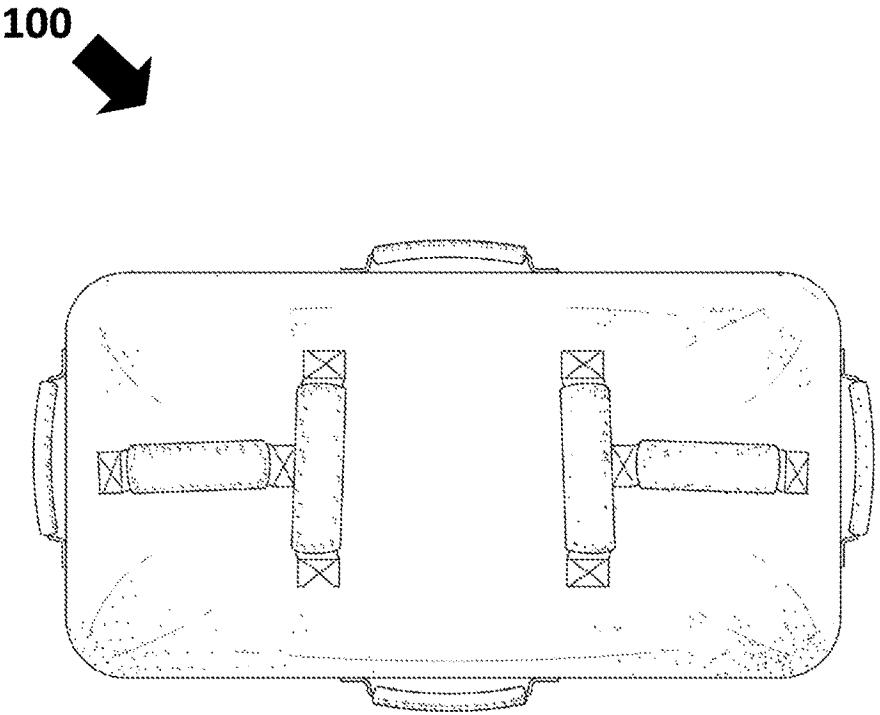
FIG. 8b
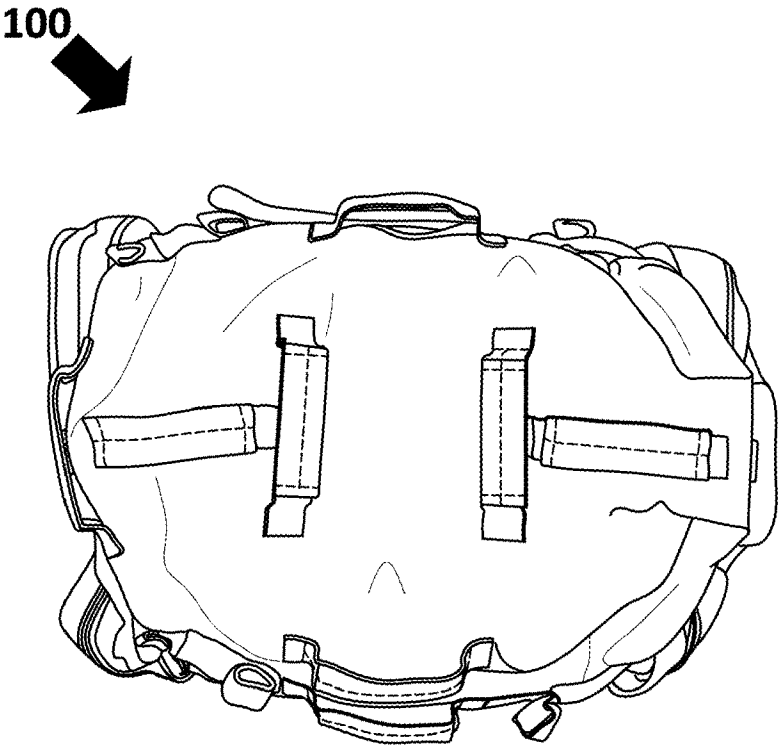
FIG. 8a

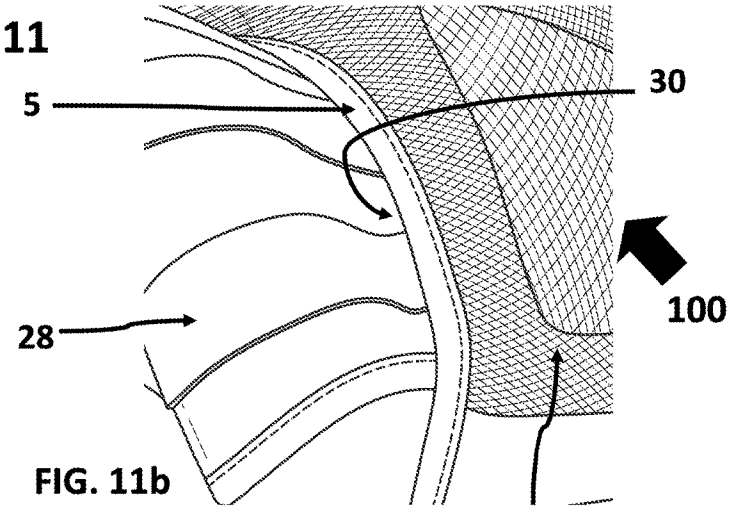
FIG. 11
FIG. 11b
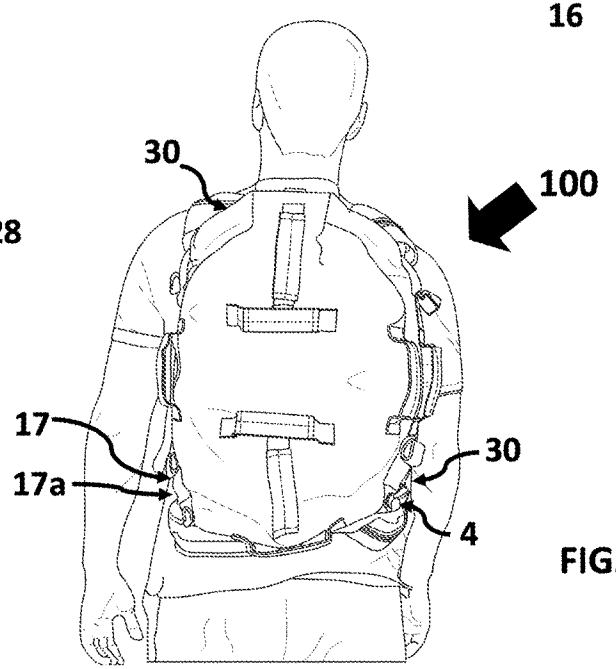
FIG. 11d
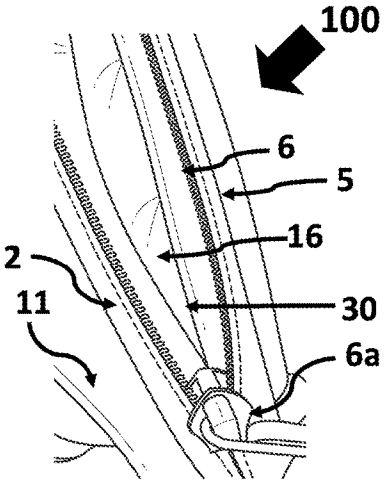
FIG. 11a
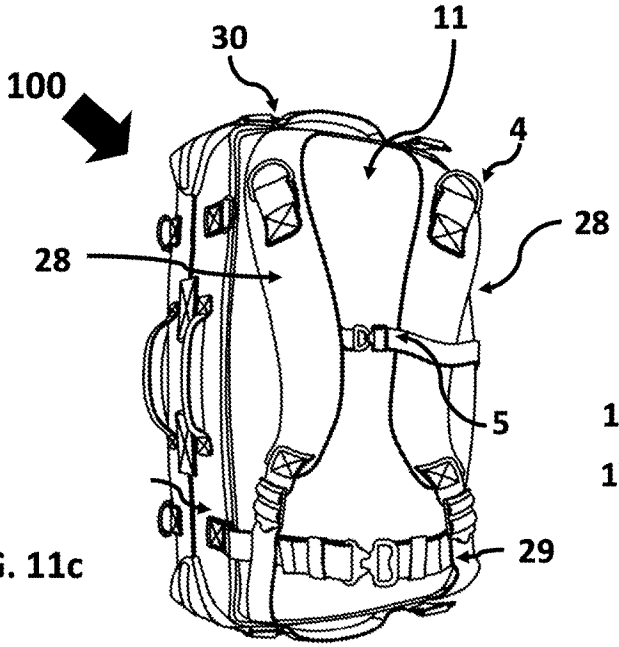
FIG. 11c

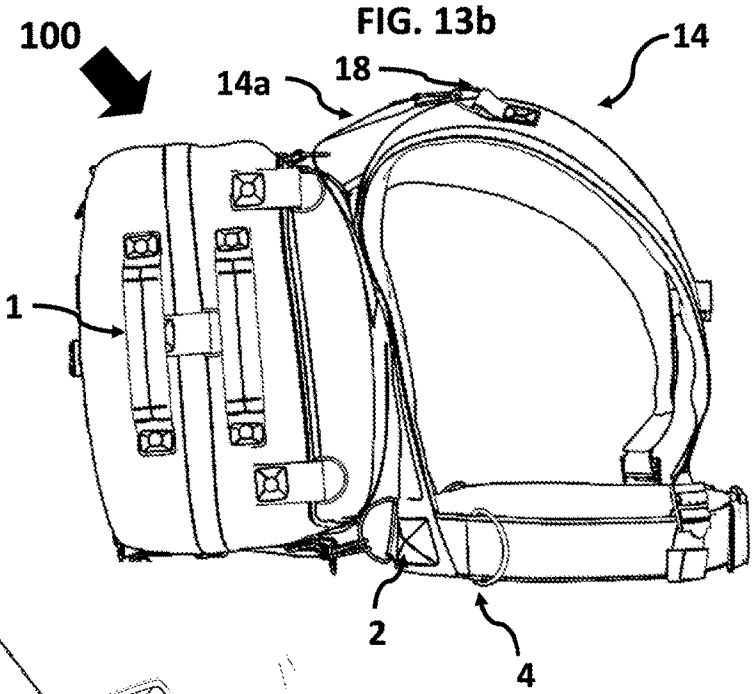
FIG. 13b
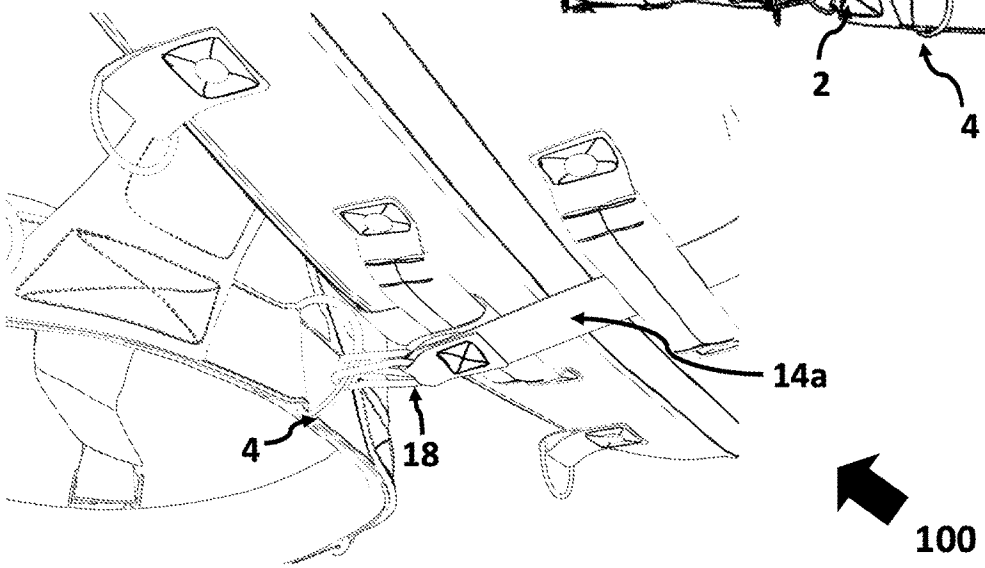
FIG. 13c
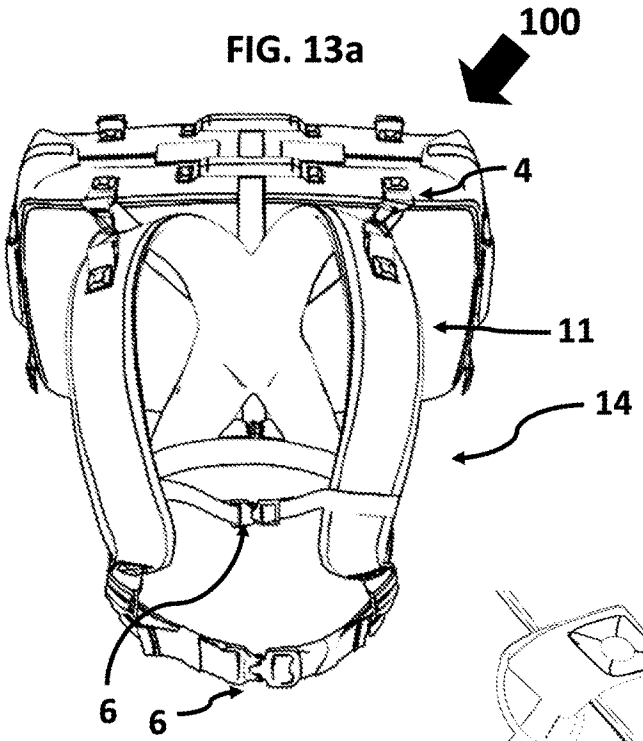
FIG. 13a
FIG. 13

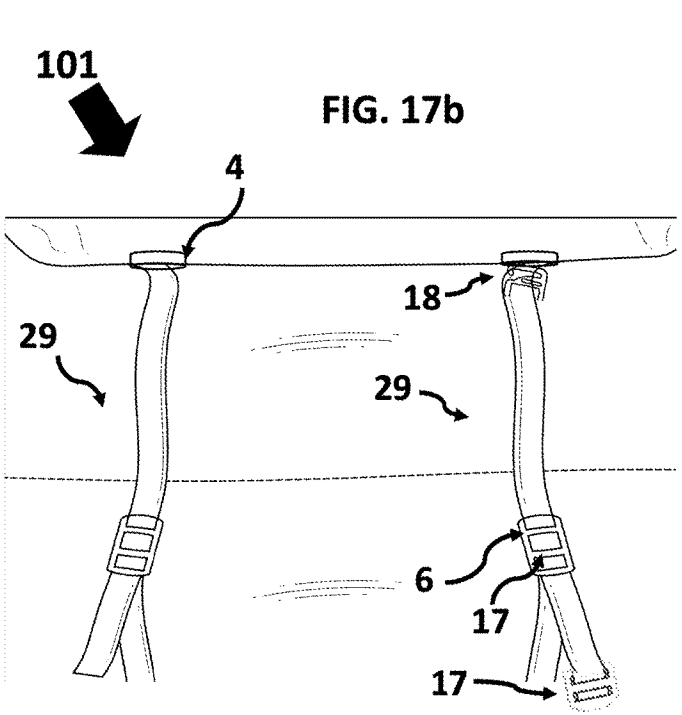
FIG. 17b
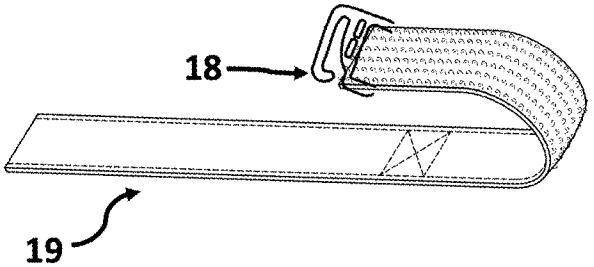
FIG. 17d
FIG. 17
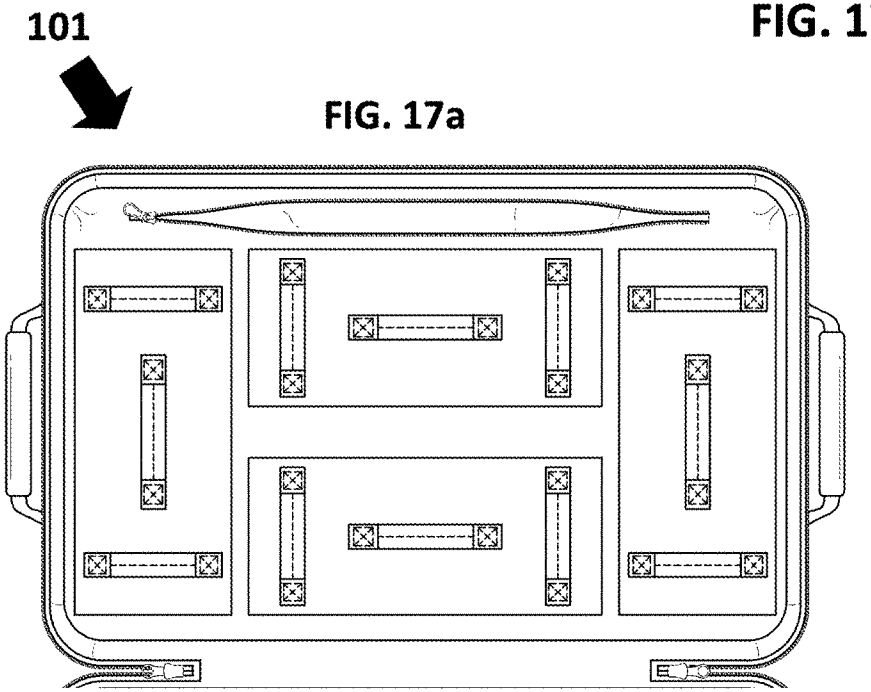
FIG. 17a
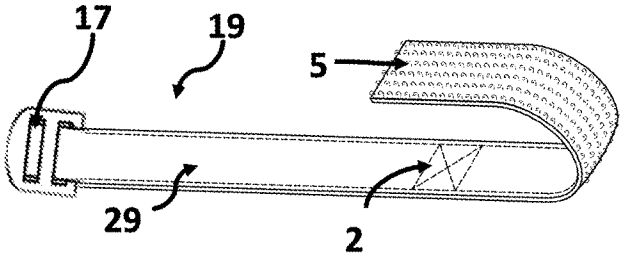
FIG. 17c

14

14d
31
5
4
2
6
17
14c
29a

24

36

35

34

FIG. 23
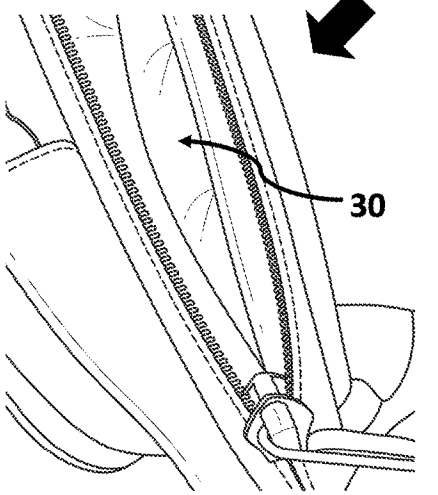
FIG. 23a
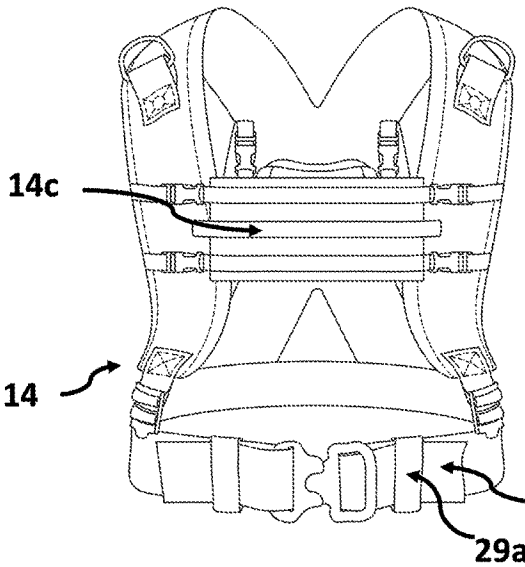
FIG. 23b
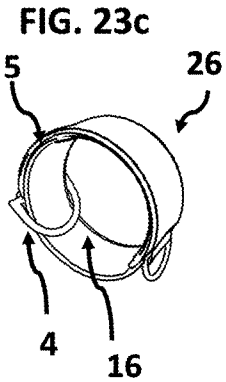
FIG. 23c
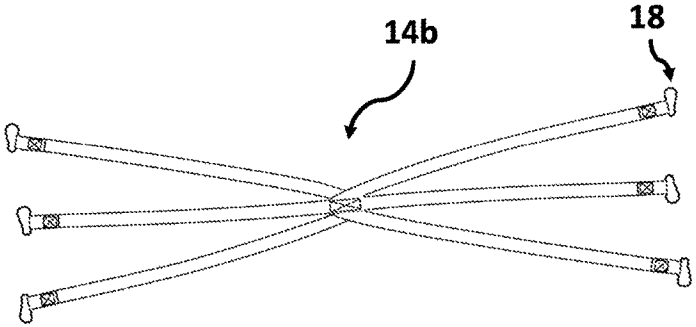
FIG. 23d
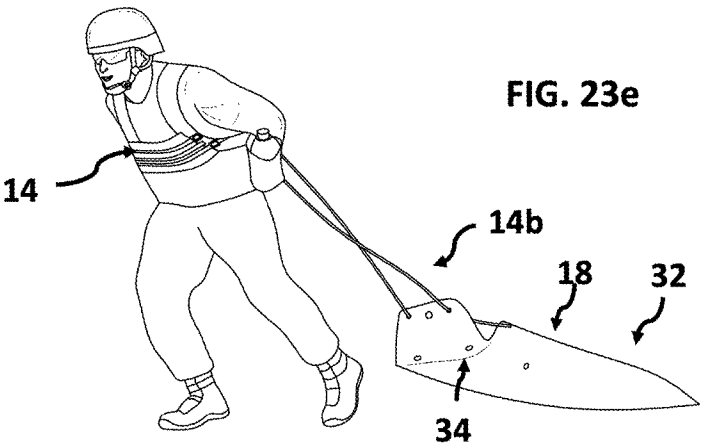
FIG. 23e 4
6
16
14c
2
16
29
29a
6
17
14
18
14a
14b
2
2
18
14
4
14a
4
100

FIG. 29
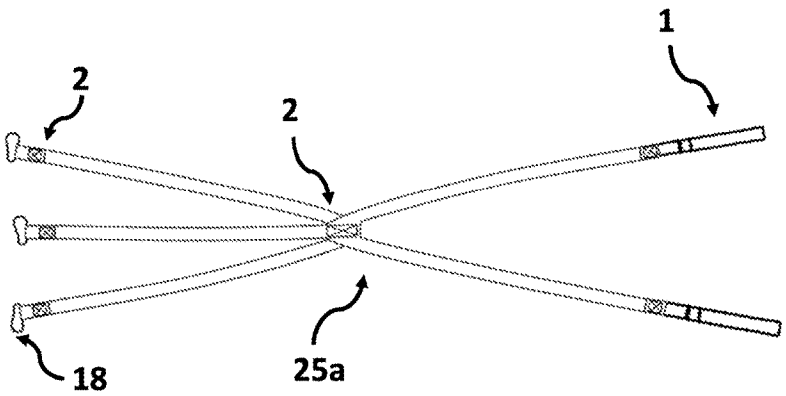
FIG. 29b
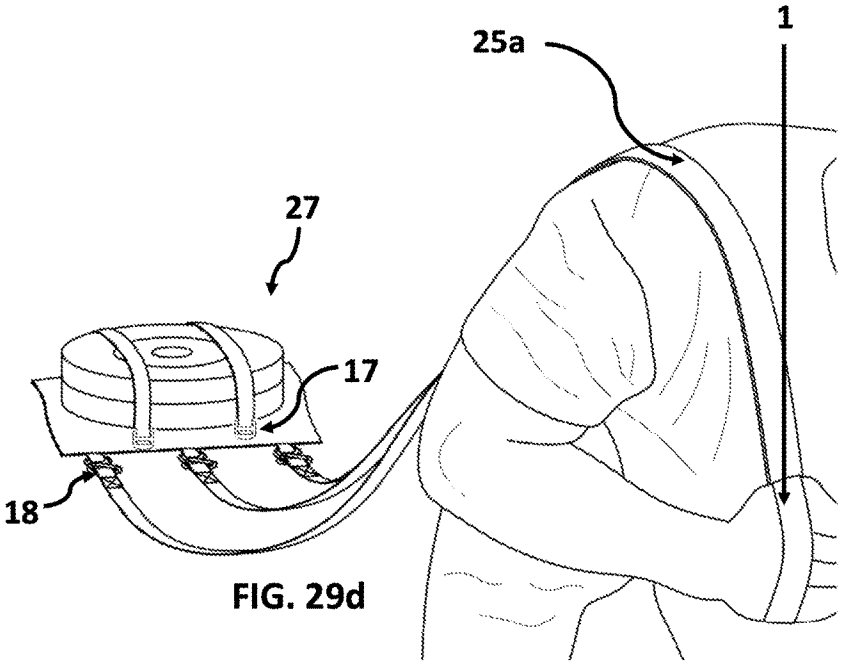
FIG. 29d
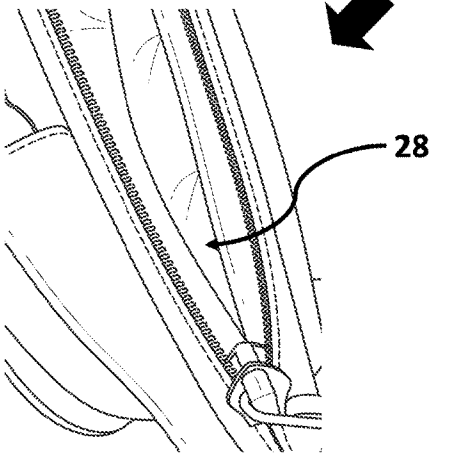
FIG. 29a
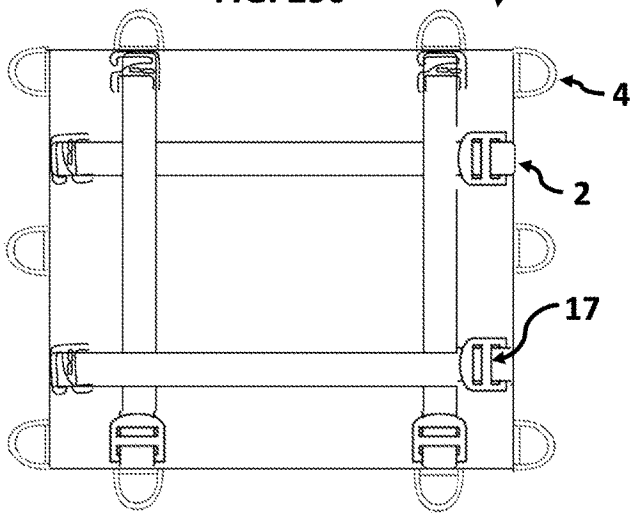
FIG. 29c

TRAINING BAG COMPRISING ADJUSTABLE WEIGHTS, DRAGGING SURFACE, WEIGHTED BAG AND COMPONENTS FOR PHYSICAL ACTIVITIES

CROSS REFERENCE TO RELATED APPLICATIONS

This application is a continuation in part patent application No. 16,656,840, filed Oct. 18, 2019 now U.S. Pat. No. 11,318,345, which is a continuation in part patent application No. 15,983,505, filed on May 18, 2018 now U.S. Pat. No. 10,561,886, all of which prior applications are incorporated herein by reference and made part hereof.

FIELD OF THE INVENTION

The present disclosure relates generally to workout bags, more specifically, the present disclosure provides training bags to be used for full body strength, endurance, rock climbing, hiking, internal individual adjustable filler weights to use as dumbbells and/or kettlebells with a draggable system. The present disclosure further discloses a bag comprising of external compartments of fixed and/or removable backpack straps configured to utilize as a weighted backpack and configured to drag the bag as a weight with one or more straps. In the open bag configuration, one or more compartments can comprise of personal belongings and/or related components to the training bag with securing devices to strap weights with minimal to no movement.

BACKGROUND

An adjustable multi-functional training bag with grips in circumferential of the surface area of the bag configuration with various securing devices adjustable working straps to adjust the bag in weight and/or size.

The usage of one device to utilize as an adjustable weight bag to change in shape and/or size by weights comprised by internal adjustable weights further comprising as individual adjustable exercise weights.

Loops around the external surface for attachments such as backpack straps, harness to drag as a weight and carry as a backpack and various components to utilize the bag for exercise and/or leisure activities.

Adjustable working straps secured on the periphery and circumference from a proximal end and/or to distal end of the external surface of the closed bag configuration.

One or more adjustable working straps secured to the external surface in a vertical and/or horizontal direction to adjust the bag horizontally or vertically.

One or more gliding surfaces overlapping the external surface adjacent and/or configured in the enclosure open bag configuration for durability to drag on any surface.

Sports performance training includes speed, strength and corrective techniques throughout. The current prior art systems on the market, are configured to be limited to covering only one training aspect for the specific training goal needed to be achieve. Also, in the medical industry, there have been a higher amount of body scans and x-rays that are showing past injuries, present injuries, and potential future injuries, that can cause a consumer to be more aware of what specific movement to perform, based on various body capabilities at several appropriate stages.

As more youths start to participate in physical activities, and sports organizations, coaches and trainers have found it important to emphasize strength training at an even younger age. In order to facilitate this, the coaches and trainers start off with a foundation of including more advanced weight lifting tools such as barbells. Accordingly, these exercises should be selected to allow the body to adapt to the various specific movements to increase flexibility and stabilization.

For example, these target exercises can help athletes who use their wrist as one of their prime movers. Accordingly, one sprained wrist and/or damaged tissue can lead an athlete to be forced to stop all physical activities until further approval by the athletic trainer. If there is a present wrist injury listed as acute and not fully treated, the athlete is prone for another similar injury which may lead to a chronic injury. To minimize and possibly avoid these injuries, wrist flexion and/or extensions is advised to minimize hyperextension. To avoid hyperextension, a device should have a soft grip for ease released in a comfortable position.

In another use, Olympic lifting involves a full force on the wrist when snatching, cleaning and performing any overhead movement. As such, learning the fundamentals prior to using a barbell will familiarize the specific movement which is viewed as strength and/or resistance training in preparation for actual Olympic lifts with a barbell.

The primary core muscles are diaphragm, multifidus, transversus abdominis and muscles of the pelvic floor. Core stability refers to a user's ability to stabilize the core with unstable movement. A user can improve core stability with shifting movements, forcing the body to stabilize the weight at a controlled pace. Using devices with unstable movements forces the body to control that specific device, strengthening your core. Standard fitness equipment does not offer the opportunity to release devices inside an invention with the capability of securing them for a compound movement in which core stability is the primary goal.

Different grips in different angles can strengthen and target different muscles. For example, an open, closed bent over rows can provide for primary moving muscles such as latissimus dorsi, rhomboids and scapular stabilizers and biceps for a specific goal such as gaining mass in the back. Additionally, an open wide grip can achieve the user's goal such as length in the back for a wider shape.

One or more grips allows a user for creativity such as lower body exercises indoor and/or outdoors with one adjustable safe equipment compared to a standard barbell that may cause injuries to a first-time user.

Carrying portable dumbbells and/or kettlebells to different locations is very inconvenient, especially for personal trainers traveling to multiple locations throughout the day. A portable training tool with adjustable, removable weight can prevent inconvenience and also save travel time throughout the day. To provide accommodations to different clientele, removable, adjustable weights will benefit the ability for the personal trainer to expand variation exercise throughout the training session.

Physiotherapist treat patients with acute, chronic injuries such as torn rotator cuff to name one example. During the early stage of the injury, the training bag may be intensive therefore an adjustable, removable weight can benefit for isolation exercises such as shoulder flies.

To correct a user's posture during leisure activities such as walking and/or during speed training, an upper body harness to uplift the torso with or without a weighted tool on the user's torso and/or being dragged for multiple repetition will cause muscle memory for when no attachments are on the user's body.

In some examples, there are upper body harnesses that are configured for pulling exercises movements with a connecting strap for strength, endurance, speed and agility. These exercises can be performed in all planes such as, transverse, frontal and sagittal with other devices such as a sling band, parachute and/or other attachments for a quick release, lower body exercises, rock climbing, leisure activities such as walking your pet, daily walking, and/or a more convenient way to carry heavy objects such as boats to the lake via connecting strap(s).

High intensity interval training (HIIT) consist of muscle to contract during a set of movement, such as eccentric, concentric and/or isometric. These three phases increase strength, endurance, toning and increasing stamina with or without weighted objects.

Push and pull exercises focuses on a three area of the body, by targeting the point hinge, isolating the lower body can generate the stretch shortening cycle more efficiently compared to the traditional full body pull exercises, wherein focuses on the hips, knees and ankles to generate momentum and, also corrects posture.

To prevent stress to the lower body and specifically the abdominal cavity; having securing element support throughout the entire upper body, in specific anterior/ventral, posterior/dorsal, cranial to caudal to uplift in an upright position can reduce long term muscle, joint and bone deficiency which may lead to lower back pain; is caused by poor posture, body mechanics/defects/dysfunctions or genetics. In some instances, chronic lower back pain may lead to scoliosis which is viewed by "rounding of the back." To minimize or possibly prevent scoliosis, lifting the upper torso at an early stage when performing physical activities will cause muscle memory to remain in the up-right position when exercising without devices.

During and post-Covid-19, the cost of fitness equipment has significantly increased due to demand and supply chain. Consumers purchase multiple size dumbbells, kettlebells and barbell with various sizes and weighted plates. A one size fits all adjustable training bag can save the consumer hundreds of dollars from purchasing multiple size fixed standard equipment.

Accordingly, embodiments of the invention, provide significant advantages while overcoming the above-described and other disadvantages, as will now be described.

SUMMARY OF THE INVENTION

In light of the disadvantages of the prior art, the following summary is provided to facilitate an understanding of some of the innovative features unique to the present invention and is not intended to be a full description. A full appreciation of the various aspects of the invention can be gained by taking the entire specification, claims, drawings, and abstract as a whole.

Accordingly, it will be appreciated that the above-described features are merely examples and should not be construed to narrow the scope or spirit of the subject matter described herein in any way. Other features, aspects, and advantages of the subject matter described herein will become apparent from the following Detailed Description, Figures, and Claims.

There is a disclosed herein a training bag comprising a body portion of the apparatus, one or more fasteners around the exterior surface of the training bag to open the training bag to an open configuration. The fasteners comprise one or more buckles, hooks, adjustable working straps, one or more layers of a hook and loop fastener, at zippers.

For the foregoing reasons, there is a need for a multipurpose training bag that incorporates strength training, speed, and agility, sports performance, military, tactical, and first responder training for an efficient workout with one portable equipment.

Other exercise bags on the market have the tendency to tear which provides sand and/or similar minerals which can injure the consumer. Additionally, the majority of exercise bags on the market do not disclose additional adjustable internal weights to use individually for exercises.

The training bag incorporates a full body workout with one or more grips perpendicular around the perimeter of the training sack for an open configuration, and a closed grip for variation movements to achieve a specific strength goal such as wide mass and/or closed mass in the user's body. Also, during explosive training such as military training, picking up the training sack without looking down can save a split second compared to looking down for a grip and then picking it up to continue the specific task. For more advanced users such as military personnel, one or more securing element can be on one or more grips to secure all weighted objects are held without damaging the training bag.

A user can adjust the appropriate weight with an adjustable weight in the enclosure of the training sack in a fixed position and/or loose for a specific goal to be achieve. For example, aiming for core stability, a user may leave the adjustable weight without securing one or more adjustable weight in one or more hook and loop fastener straps to control the shifting movement.

At least one weight may include a grip for easy removal and/or exercises with or without the training bag. One or more weight can hold minerals to fill the enclosure for dense weight in preparation for weighted exercises. For example, a user may want to work on personal record repetition and can add all weights in the enclosure with dense weight. Another example is for isolation exercises such as bicep curls, a user may decrease the density in the weight which decreases the weight in the training bag.

With one at least one fixed and/or removable durable surface made for dragging and at least one or more loops around the perimeter of the training bag allows the user to utilize this invention with a versatile harness with a connecting strap to be used as a dragging tool and/or back pack. This can utilize all adjustable weight inside the enclosure as one or more hooks 18 from the connecting strap can be attached to one or more loops around the perimeter of the training bag.

In an embodiment of the present invention, a harness targeted for lower body exercises enforcing an upright posture, comprising of one or more loops, fasteners, Modular Lightweight Load-carrying Equipment "(MOLLE attachments)", adjustable working strap, attachable devices such as connecting strap, sling, hydration pack, gun holsters and similar attachments when using for high physical activities and/or for leisure activities which can be viewed as a convenient device in a closed configuration. To utilize all working parts of this invention, the connecting strap can be used as adjustable working straps with the harness to be used as a back pack for leisure and/or physical activities with or without any additional objects in the enclosure.

In the instance where the harness has one or more loops, MOLLE attachments, hydration pack, fasteners, adjustable working strap, other attachments such as fix and/or removable back pack straps may be applied when manufactured, according to the user's needs. For example, releasable fasteners can be provided in the front of the harness to create additional back support to improve posture, an upright position when using the versatile harness as a pulling device, rock climbing to attach rock climbing straps and still to maintain a firm posture.

With the harness to be designed as a heavy loaded pulling device with or without the training bag, foam padding may be in at least one section of the versatile harness to create comfort for the user in the certain position, and also corrective posture and leisure activities when in usage for a long duration. Around the perimeter of the versatile harness, there may be more than one adjustable working strap 17 to accommodate to a wide variety of body sizes.

In an exemplary embodiment, a training bag is disclosed. The training bag includes one or more fasteners around the perimeter of the training bag. The training bag includes one or more grips or loops, woven tape and/or securing elements positioned on the outer periphery of the training bag. The training bag includes at least one compartment strap, configured for enclosing one or more filler weights. The training bag includes at least one dense surface around the perimeter in an open and/or closed configuration.

In one embodiment, the one or more grips are positioned on the surface of the training bag; or the one or more grips are positioned around the perimeter of the training bag.

In one embodiment, the at least one compartment strap is configured to provide weight in different sections of the training bag.

In one embodiment, the training bag further includes at least one dragging accessory, configured to assist with pulling and dragging of the training bag In one embodiment, the at least one dragging accessory is one or more of a suspension training, one or more additional connecting straps with handles, or a sled.

In one embodiment, the training bag further includes a workout harness with securing ring attached to the periphery of the dense surface In one embodiment, the training bag further includes at least one attachment strap configured to connect to at least two of the one or more fasteners, and a at least one handle for a user to use for dragging or pulling.

In one embodiment, the one or more fasteners are configured to transition from a closed configuration to an open configuration.

In one embodiment, the one or more fasteners comprise of a plurality of hook and loop fasteners and one or more straps configured to be stored inside the training bag, and configured to hold one or more weighted objects to prevent movement when in a closed configuration.

In one embodiment, the one or more grips is one or more of loops, MOLLE attachments or securing elements located around the perimeter of the training bag or in the enclosure. Additionally, the grips comprise of one or more fabrics with padding for gripping comfort comprising additional securing element such as rivets on one or more grips or one or more loops. Also, the loops comprise of one or more attachments such as a harness, a connecting strap, or a shoulder strap, wherein one or more attachment securing element may include one or more thread stitching around the surface.

In one embodiment, the at least one dense surface is configured to be fixed or removable for dragging activities training bag as a sled or hard impact slams, wherein the removable surface may comprise of a fastener such as a hook and loop fastener to attach and detach when using the training bag for dragging activities.

In one embodiment, the at least one dense surface comprises of rubber coated with polyvinyl chloride and/or polyurethane for dragging on dense surfaces in any weather condition, and one or more stitching may be around the surface with possible securing elements.

In one embodiment, the at least one compartment strap comprises of one or more filler weights selected from sand or minerals.

In one embodiment, the training bag is configured as a cosmetic leisure bag comprising of one or more animations around the perimeter; an additional attachable item such as backpack straps is attached to one or more loops around the perimeter of the training bag for multi-purpose use; and one or more enclosure straps and/or compartment straps configured to secure one or more objects such as coins, laptops, clothing and sporting equipment creating additional usage such as a travel bag.

In one embodiment, the backpack straps are fixed in a separate enclosure or compartment strap configured for securing the backpack straps.

In one embodiment, the one or more loops are configured to connect one or more accessories selected from the group of a set of connecting straps, a harness, or a sled.

In another disclosed aspect, the apparatus further comprises one or more at least one layer of a mixture of textile fabrics with PVC and/or PU coating in a closed and open configuration.

In another disclosed aspect, the apparatus further comprises one or one draggable surface on the exterior and interior surface.

In another disclosed aspect, the apparatus further comprises one or grips in a closed and open configuration.

In another disclosed aspect, the apparatus further comprises one or more securing elements such as nylon thread stitching, adhesive, rivets, and binding which can comprise one or more layers on the external and internal surface of the apparatus.

In another disclosed aspect, the apparatus further comprises one or fixed loops on the exterior surface in a closed configuration.

In another disclosed aspect, the apparatus further comprises one or removable loops on the exterior surface in a closed configuration.

In another disclosed aspect, the apparatus further comprises one or fixed loops on the interior surface in an open configuration.

In another disclosed aspect, the apparatus further comprises one or removable loops on the interior surface in an open configuration.

In another disclosed aspect, the apparatus further comprises one or animation such as a printed logo, Velcro patch, MOLLE attachments, and logos with a visual surface.

In another disclosed aspect, the apparatus further comprises one or layers of a durable surface in a closed configuration.

In another disclosed aspect, the apparatus further comprises one or more removable surfaces in a closed bag configuration and/or open bag configuration.

In another disclosed aspect, the apparatus further comprises one or more adjustable working straps around the exterior surface in a closed configuration.

In another disclosed aspect, the apparatus further comprises one or adjustable working straps on the internal surface in an open configuration.

In another disclosed aspect, the apparatus further comprises one or securing element patches to secure attachable objects.

In another disclosed aspect, the apparatus further comprises one or more compartments in a closed bag configuration.

In another disclosed aspect, the apparatus further comprises one or more compartments in an open bag configuration.

In another disclosed aspect, the apparatus further comprises one or more fixed backpack straps with at least one adjustable working strap.

In another disclosed aspect, the apparatus further comprises one or more removable backpack straps with at least one adjustable working strap.

In another disclosed aspect, the apparatus further comprises one or more detachable durable surfaces with at least one object stabilizer.

In another disclosed aspect, the apparatus further comprises one or more removable animations on one fixed backpack strap.

In another disclosed aspect, the apparatus further comprises one or more fixed animations on or more fixed backpack straps.

In another disclosed aspect, the apparatus further comprises one or more removable animations on a removable backpack strap.

In another disclosed aspect, the apparatus further comprises one or more fixed animations on a removable backpack strap.

In another disclosed aspect, the apparatus further comprises one or more fasteners such as a buckle, hook and loop fasteners, zippers, hooks, adjustable working straps on at least one fixed backpack strap, and one removable backpack strap.

In another disclosed aspect, the apparatus further comprises one or more adjustable weight straps on one fixed and one removable backpack strap.

In another disclosed aspect, the apparatus further comprises one or more foam padding on one fixed and one removable backpack strap.

In another disclosed aspect, the apparatus further comprises one or more compartments to hold objects, a fixed and removable backpack strap in a closed bag configuration and an open bag configuration.

In another disclosed aspect, the apparatus further comprises one or more internal adjustable weight straps to one at least one removable weight in place in an open bag configuration.

In another disclosed aspect, the apparatus further comprises one or more fixed internal adjustable weight straps to at least one fixed weight in an open bag configuration.

In another disclosed aspect, the apparatus further comprises one or more adjustable working straps in an open bag configuration.

In another disclosed aspect, the apparatus further comprises one or more securable attachments to hold one or more objects in place in an open bag configuration.

In another disclosed aspect, the apparatus further comprises one or more compartments secured by at least one fastener in an open bag configuration.

In another disclosed aspect, the apparatus further comprises one or more loops and/or hooks and/or attachments in an open bag configuration secured by one or more securing elements.

There is also disclosed herein a training bag apparatus comprising of optional and/or attachable connecting straps to attach on one or more hooks, loops, securing elements, MOLLE attachments in a closed bag, and open bag configuration for carrying, dragging, throwing, slamming, not limiting to other physical activities.

In another disclosed aspect, the apparatus further comprises one or more bungee slings.

In another disclosed aspect, the apparatus is further viewed as a selected: cylinder, square, triangular-shaped bag, combined thereof.

Disclosed herein are embodiments of apparatuses, methods, and systems pertaining to a training bag apparatus. This description includes drawings, wherein the principles of the invention may better be understood with reference to the accompanying figures provided by way of illustration of an exemplary embodiment, or embodiments, incorporating principles and aspects of the present invention.

Hereinafter, certain exemplary embodiments of the present invention will be described in detail with reference to the accompanying drawings.

The matters defined in the description, such as a detailed construction and elements thereof, are provided to assist in a comprehensive understanding of the invention. Thus, it is apparent that the present invention may be carried out without those defined matters. Also, well-known functions or constructions are omitted to provide a clear and concise description of exemplary embodiments of the present invention.

BRIEF DESCRIPTION OF THE DRAWINGS

Disclosed herein are embodiments of apparatuses, methods, and systems pertaining to delivering of packages and products from a shipper to a recipient. This description includes drawings, wherein The principles of the invention may better be understood with reference to the accompanying figures provided by way of illustration of an exemplary embodiment, or embodiments, incorporating principles and aspects of the present invention, and in which:

FIG. 1 is a perspective view of a user exercising with the training bag and components, more specifically, FIG. 1*a* illustrates a user performing front squats, FIG. 1*b* illustrates a user performing simulated kettlebell swings, FIG. 1*c* illustrates a user wearing the training bag as a backpack, FIG. 1*d* illustrates a user carrying the training bag as a duffle bag, FIG. 1*e* illustrates a user performing shoulder flexion with two filler weights, FIG. if illustrates a user wearing the harness and dragging the training bag upon a surface, FIG. 1*g* illustrates a user wearing a harness and dragging a litter;

FIG. 8 is a front perspective view of two training bags, more specifically FIG. 8*a* illustrates a training bag with minimal to no weight in the enclosure and FIG. 8*b* illustrates a training bag with an expansion;

FIG. 9*a* illustrates a top side view of a durable surface, FIG. 9*b* illustrates a durable surface overlapping in the internal surface of the open bag configuration, FIG. 9*c* illustrates a side perspective view of an expansion training bag with a durable surface and a portion of the durable surface in contact with a ground surface and FIG. 9*d* illustrates a durable surface overlapping to the outer periphery side of the training bag;

FIG. 11 is a perspective views of a training bag with backpack straps, more specifically FIG. 11*a* illustrates a top view of an external compartment opening, FIG. 11*b* illustrates a waist belt released from a side external compartment; FIG. 11*c* illustrates a training bag with a harness and/or backpack strap and FIG. 11*d* illustrates a user wearing the training bag as a backpack;

FIG. 13 is a perspective view of three training bags set up as a backpack with a harness, more specifically, FIG. 13*a* is a rear perspective view of a training bag and harness, FIG. 13*b* is a side perspective view of a training bag and harness and FIG. 13*c* is a bottom perspective view of a connecting strap under one grip followed by attaching via a hook onto the rear loop of the training bag and an individual strap of a connecting strap on the rear end of the training bag, looped around a grip followed by attaching via a hook onto the rear loop;

FIG. 17 is a top perspective view of the training bag enclosure, more specifically FIG. 17*a* illustrates the training bag in an open bag configuration with a portion of a fastener extending from an outer surface of a top external surface disengaged with the periphery surface revealing an internal surface and a top view of half of the enclosure comprising of four filler weights, unstrapped, FIG. 17*b* illustrates the enclosure of the training bag comprising of two alternative adjustable weight straps secured on the internal surface by one or more loops, FIG. 17*c* illustrates a detached adjustable weight strap comprising of a adjustable working strap and FIG. 17*d* illustrates a detached adjustable weight strap comprising of a hook;

FIG. 19*a* illustrates a front view of a filler weight comprising of two adjustable working straps, FIG. 19*b* illustrates a rear view of a filler weight comprising of three grips, FIG. 19*c* illustrates a detached hook and loop fastener with a visual of a zipper, FIG. 19*d* illustrates a detached hook and loop fastener with a zipper opening, FIG. 19*e* illustrates a filler weight comprising of two compartments and two adjustable working straps, FIG. 19*f* illustrates a rear view of a filler weight comprising of two compartments and two grips, FIG. 19*g* illustrates a front perspective view of a filler weight comprising of one compartment and two adjustable working straps and FIG. 19*h* illustrates a rear view of a filler weight comprising of one compartment and one grip;

FIG. 23 is a perspective view of the components to drag a litter, more specifically FIG. 23*a* illustrates a top opening of an external compartment of the training bag, FIG. 23*b* illustrates a harness with a chest kit attached, FIG. 23*c* illustrates a limb strap, FIG. 23*d* illustrates a variation connecting strap and FIG. 23*e* illustrates a user wearing a harness with an attached chest kit and water bottle attached to the waist kit, dragging the litter;

FIG. 27*a* illustrates a grip connecting strap attached to a training bag, FIG. 27*b* illustrates a grip connecting strap and FIG. 27*c* illustrates a user gripping a grip connecting strap and dragging a portion of the training bag upon a ground surface;

FIG. 29 is a front perspective view of the detachable durable surface and components, more specifically FIG. 29*a* illustrates a top perspective view of a training bag external compartment opened, FIG. 29*b* illustrates a variation grip connecting strap, FIG. 29*c* illustrates a detachable durable surface and FIG. 29*d* illustrates a user gripping one grip of a variation grip connecting strap attached onto a detachable durable surface with two adjustable weight straps secured over to two weighted plates; FIG. 30*a* illustrates a detachable durable surface with no weights, FIG. 30*b* illustrates a detachable durable surface with two filler weights secured by four adjustable weight straps, FIG. 30*c* illustrates a two filler weights on the top surface, unstrapped.

DETAILED DESCRIPTION OF THE INVENTION

Figure 2:
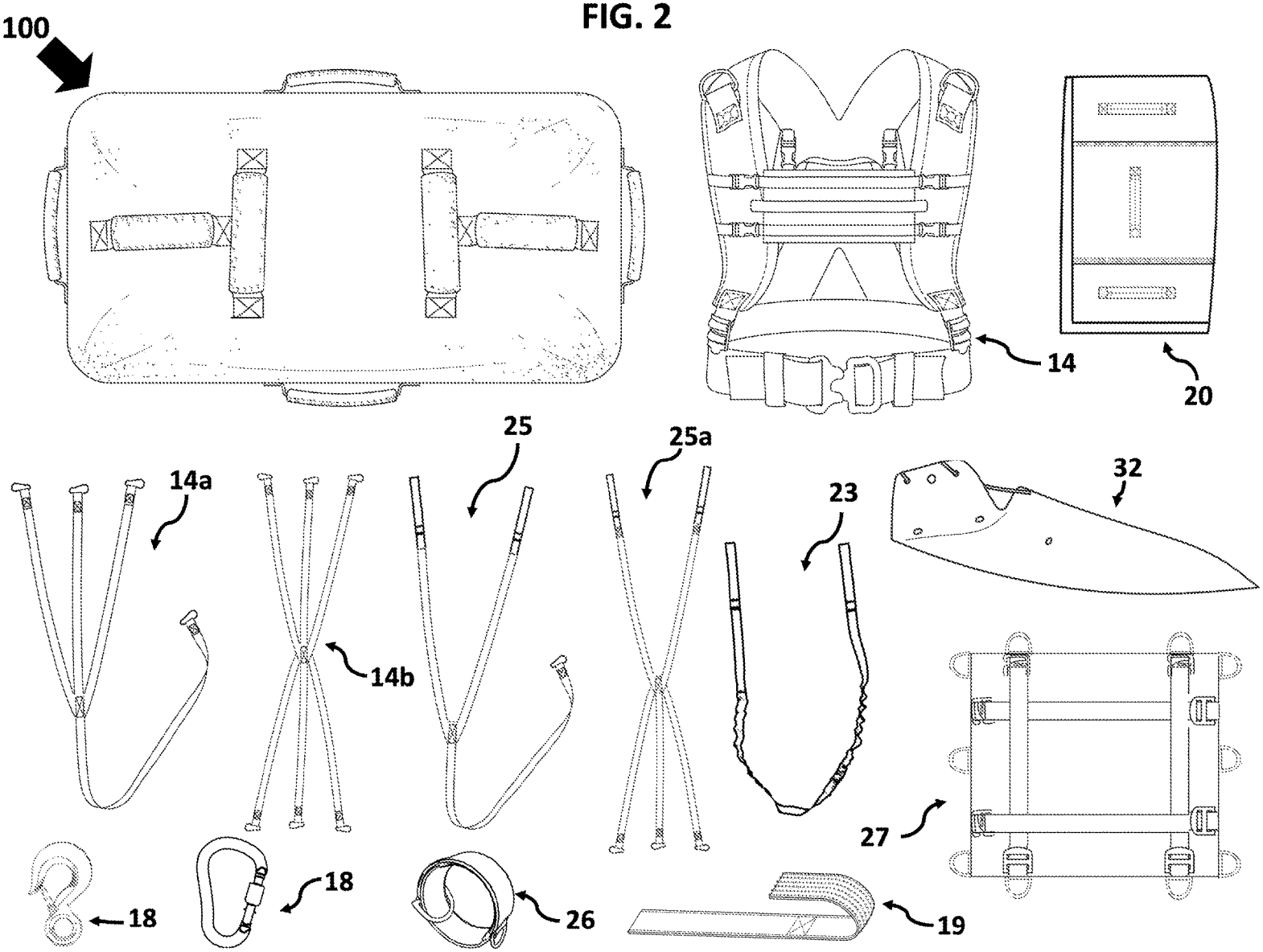
FIG. 2 is a perspective view of the disclosed apparatus and components in the following chronological order; first row: training bag, harness, filler weight, second row: connecting strap, variation connecting strap, grip connecting strap, variation grip connecting strap, sling, litter, third row: two hooks, limb strap, adjustable weight strap and a detachable durable surface.

Some detailed example embodiments are disclosed herein. However, specific structural and functional details disclosed herein are merely representative for purposes of describing example embodiments. Example embodiments may, however, be embodied in many alternate forms and should not be construed as limited to only the embodiments set forth herein.

The invention may be embodied in other specific forms without departing from the spirit of essential characteristics thereof. The present embodiments therefore to be considered in all respects as illustrative and not restrictive, the scope of the invention being indicated by the appended claims rather than by the foregoing description, and all changes which come within the meaning and range of equivalency of the claims are therefore intended to be embraced therein.

The terminology used herein is to describe particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprise" and/or "comprising," when used in this specification, specify the presence of stated features, steps, operations, elements, and/or components, but do not preclude the presence or addition of one or more other features, steps, operations, elements, components, and/or groups thereof.

The following description is not to be taken in a limiting sense, but is made merely for the purpose of describing the general principles of exemplary embodiments. Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

The description that follows, and the embodiments described therein, are provided by way of illustration of an example, or examples, of particular embodiments of the principles of the present invention. These examples are provided for the purposes of explanation, and not of limitation, of those principles and of the invention. In the description, like part are marked throughout the specification and the drawings with the same respective reference numerals. The drawings are not necessarily to scale, and in some instances, proportions may have been exaggerated in order more clearly to depict certain features of the invention.

The following description sets forth exemplary devices, methods, parameters, and the like. It should be recognized, however, that such description is not intended as a limitation on the scope of the present disclosure but is instead provided as a description of exemplary embodiments.

It is to be understood the closed configuration, closed bag configuration, the training bag in the closed configuration is illustrated and elaborated as element 100 meanwhile the open configuration, the open bag configuration, the enclosure, internal is illustrated and elaborated as element 101.

It is to be understood the embodiments, figures and examples are listed from the training bag 100 closed configuration to open configuration 101 embodiments, figures and examples, concluding to additional components of the training bag 100. In some instances, embodiments will be referred back to figures throughout the specifications.

Prior art discloses minimal functions, components and/or features to the present disclosed apparatus. The training bag 100 discloses and illustrates a multi-function training bag with components to utilize as a slam bag, dragging tool also known as a sled component, backpack/weighted bag, duffle bag, adjustable filler weights, dragging component with or without a harness and a harness, chest and waist kit for dragging a litter as depicted in FIG. 1*a*-1*g*.

In some embodiments, the training bag 100 can be manufactured in different shapes and/or sizes. Additionally, a user can request various cosmetic appearances selected from more than one colour, print screen, rubber and/or similar material logos, MOLLE attachments, various webbing colours in combination thereof.

The training bag 100 has the ability to slam, throw and drag in any weather condition and/or surface in regards to a mixture of textile contents such as but not limiting to selected from nylon, ballistic nylon, Kevlar®, wool, silk, plant such as cotton, flax, jute, bamboo, minerals such as asbestos, glass fiber and synthetic such as nylon, polyester, acrylic and rayon in combination thereof. It is to be understood prior to manufacturing, the user can request one layer of and/or a mixture of all layers with at least one layer of polyvinyl chloride (PVC) and/or polyurethane (PU) coating in a closed bag 100 and/or open bag 101 configuration.

Prior to manufacturing, a user can request one or more fabric blended together with or without securing elements 2 to eliminate the visual aspects. For example, during production, fabric glue and/or fusible bonding tape like Dritz Sitch Witchery®

It is to be understood all working moving functions selected from metal loops 4, plastic loops, rivets, metal rods, hook and loop fasteners 5, fasteners 6, securing elements 3 in combination thereof and/or additions to the training bag 100 in an open 101 and/or closed configuration can comprise of at least one layer of a PVC and/or PU coating.

Environmentalist can request to manufacture one or more fabrics and/or working moving parts to contain 0.01% or less to 100% of recycled materials.

The training bag 100 body portion structure held together by one or more securing elements 2 selected from carbon fibers, fiberglass and/or glass fiber, aramid fibers, tow or stands in a bobbin, tape in a roll, woven in one or more layers of fabric and prepregs in combination thereof.

In more particular, a securing element 2 can comprise of the selected from thread stitching, rivets, adhesive, fabric glue, at least one metal rod, fastener, fabric fold over in combination thereof. The intended purpose of one or more securing elements is to secure the training bag structure and/or components. For example, one or more loops 4 can comprise of a securing element 2 to secure to the external surface 11*a* and/or periphery 11*b* in the closed bag configuration 100. In some instances, a securing element 2 is an adjustable working strap 17 to secure the training bag 100 size and/or structure and in some instances, a securing element 2 can comprise of a hook to secure one or more weights in the enclosure 100 of the training bag 100.

In some embodiments, at least one layer of thread stitching of fabric can hold one or more fabrics of the training bag 100 together in an open bag configuration 101 and/or closed bag 100 configuration.

In some embodiments, at least one layer of adhesive, one or more rivets, on the external surface area and/or periphery in the open bag configuration 101 and/or closed bag configuration 100.

In some embodiments, at least one layer of thread stitching can secure one or more fabric layers shapes selected from triangle, right triangle, rectangle, parallelogram, circle, square, rhombus, oval, pentagon, hexagon, octagon, cylinder, cube, star, heart, arrow in combination thereof the training bag 100 as one apparatus.

It is to be understood a securing element 2 can be selected from: fastener 6, zipper 6*a* and/or at least one layer of a hook and loop fastener 5 in combination thereof to hold one or more working moving parts together. For example, at least one fastener 6 may open and close one or more working parts and/or structure such as the closed bag configuration 100 to open bag configuration 101.

Grips 1

Figures 4, 4A, 4B, 4C, 4D:
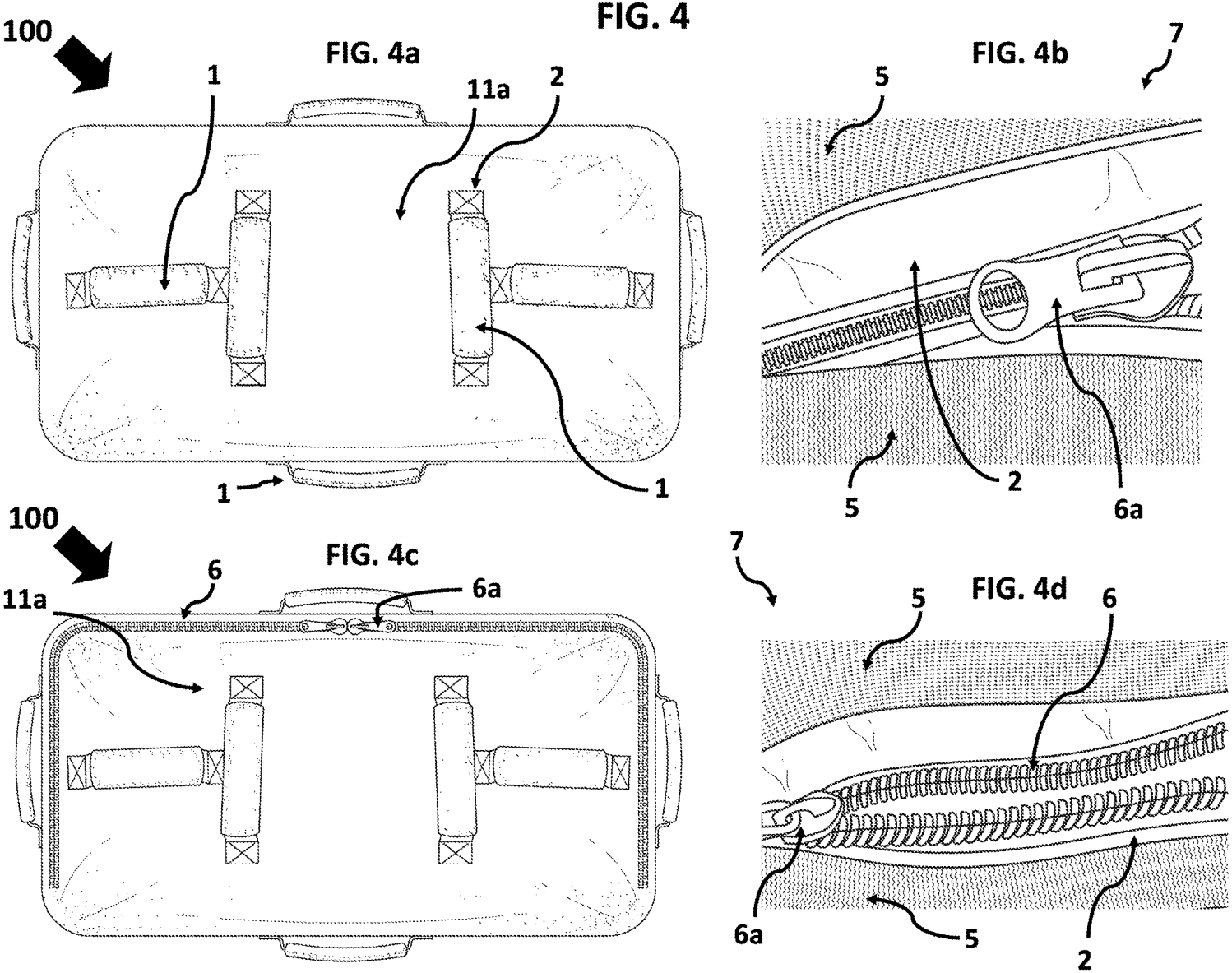
FIG. 4 is a front perspective view of the training bag, more specifically
FIG. 4*a* illustrates a training bag.
FIG. 4*b* illustrates an external fastener fold over detached from a zipper.
FIG. 4*c* illustrates a training bag with a visual of a zipper extending from the top external surface to a periphery surface and FIG. 4*d* illustrates an external fastener fold over detached from a zipper, followed by the zipper opening.

FIGS. 4*a* and 4*c* illustrates one or more grips 1 comprising of water-repellent binding 10 thread in the middle and/or around one or more grips 1 to allow the user to firmly grasp a grip 1 without damaging the fabric over time. For example, when a user grasps one or more grips 1 for lifting, the grip 1 then folds in half as previously illustrated in FIGS. 1*a* and 1*b*. The dividing of one or more binding, considered as a securing element 3 prevents wear and tear of the fabric and compressed lining 16. The water repellant binding 10 is configured to repel various elements of water that can take place during a water or outdoor training, or when an excessive amount of sweat is realized.

In some embodiments, one or more grips 1 can comprise of at least one layer of nylon without compressed lining 16 which can be interpreted as foam padding with a securable element selected from: woven tape 3 with a fabric mixture, Nylon, and/or polyester with one or more layers an x shaped thread, one rivet may have a coating of polyvinyl chloride (PVC) and/or with a mixture of polyurethane, rivets in combination thereof.

In some instances, a grip 1 can one layer of nylon which is then folded in half by thread stitching then secured to the periphery 11*b* and external surface 11*a* by one or more securing elements 2. For example, prior to manufacturing, a user can request one layer of fabric with no padding.

In some embodiments, one or more grips 1 may have a corner of the grip stitched from the interior to the exterior to prevent any discomfort from sharp edges for the user when grasping at a fast pace. The corner group stitching can be constructed with one or more different types of stitching selected from the group of a blind stitch, running stitch, zig-zag stitch and basting stitch in combination thereof.

In some embodiments, one or more securing elements 2 can be utilized such as woven tape with a fabric mixture, Nylon, and/or polyester with one or more layers to the external surface 11*a* of the training bag 100. The layers can be formulated with an x shaped thread. In some embodiments, a square thread around the securing element 2 and woven tape 3 with a visual of at least one rivet, can be utilized. One rivet may have a coating of polyvinyl chloride (PVC) and/or with a mixture of polyurethane (PU) to prevent rusting if any minerals area in contact with a rivet.

In some instances, at least one ending of a woven tape can remain as the same point to an adjustable working strap 17 which will be further elaborated.

It is to be understood, that at least one layer of woven tape 3 can be manufactured on one or more grips 1, resulting in no visual rivets, also depending on the angle when viewing the training bag 100. The use of the woven tape 3 is configured to strengthen the durability of the rivets, and to protect the rivets from excessive wear and tear.

One or more grip 1 may be seen with at least one-millimeter height from the surface of the training bag 100 and some may be seen with no space between, depending on the angle viewed. This allows the user to firmly grasp the grip 1 and hold the training bag 100 at a controlled motion. This controlled motion allows the user to more specifically target various muscle groups, or body parts that the exercise are intended to target. With a controlled motion, the user is able to maintain their form, as well as their exercise motion with many repetitions and sets as necessary.

Figures 6, 6A, 6B, 6C:
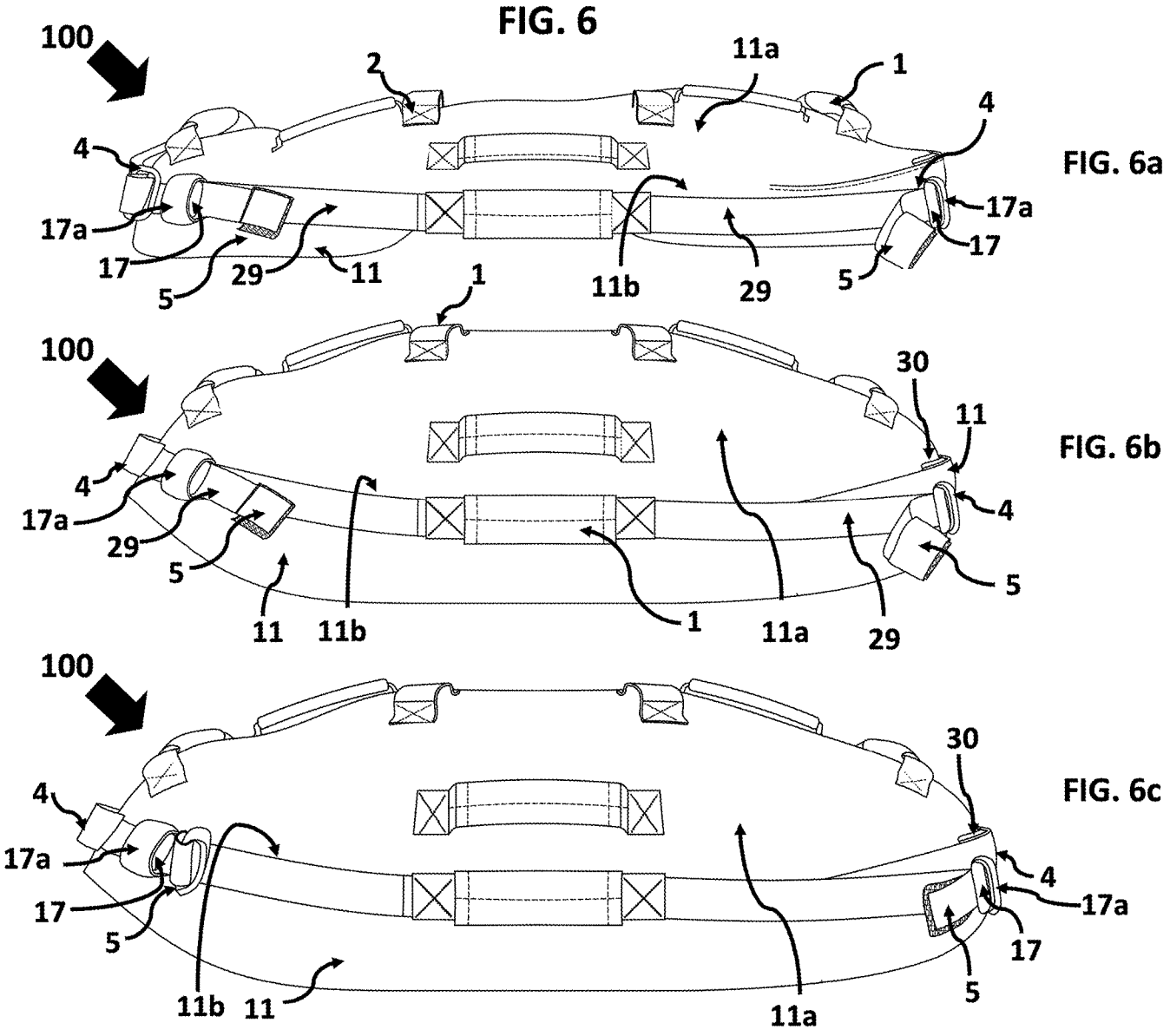
FIG. 6 is a side perspective view of three training bags, more specifically
FIG. 6*a* illustrates a training bag with minimal to no weight in the enclosure and a portion of the rear durable surface in contact with a ground surface.
FIG. 6*b* illustrates a training bag with moderate expansion with more than one weight in the enclosure and a portion of the rear durable surface in contact with a ground surface and FIG. 6*c* illustrates a significant expansion with one or more weights in the enclosure and a portion of the rear durable surface in contact with a ground surface.

In some embodiments, the training bag 100 can have one or more grips 1 around the periphery 11*b* as depicted in FIG. 6*a*-6*c*. In other embodiments, one or more grips 1 may be perpendicular, distal end, proximal end, adjacent on or around the external surface 11*a* and/or periphery 11*b* in the closed bag configuration 100 and/or open bag configuration 101 from one another with one or more securing elements 2 such as woven tape 3 and/or rivets to support the structure of a grip 1 but, not limiting to other optional securing elements 2 prior to manufacturing.

In some embodiments, the training bag 100 may comprise of one or more MOLLE attachments around the external surface 11*a* area to be used as a cosmetic appearance and/or for optional attachments related with or without the training bag 100.

In some embodiments, one or more MOLLE attachments comprise of at least one layer of woven tape 3 with optional textile mineral mixture with one or more securing element 2 to hold the structure and for weighted objects.

Depending on the usage of the training bag 100, it may be convenient to manufacture with a mixture of minerals and/or Nylon, vinyl, linen, cotton, canvas, polyester, or microfiber with one or more water proof coating selected from the group of polyvinyl chloride and/or polyurethane around the external surface 11*a* area and periphery 11*b* wherein a specific machinery can be used.

As previously illustrated, FIG. 6*a*-6*c* further comprises of one or more grips 1 secured with one rivet (not shown) and one x shaped securing element such as at least one layer of nylon threading. It is to be understood the nylon thread can further comprise of at least one layer of PVC and/or PU coating and/or one or more layers of mixture of thread such as canvas, polyester and/or similar fabrics.

It is to be understood at least one rivet can further comprise of copper, metal, alloy, aluminum and at least one layer of PVC and/or PU coating.

In some instances, individual environmentalist and organizations can request customized fabrics and/or minerals prior to manufacturing. For example, a mixture of minerals can comprise of current fabrics that are unused and/or used recycled materials such as glass, paper, cardboard, metal, plastic, tires, rubber, and metal.

In some instances, a user can comfortably grasp two grips 1 at once for certain exercises such as front squats and simulated as kettlebell swings as depicted in previous FIGS. 1*a*-1*b*.

In some embodiments, one or more grips can be secured by one or more securing elements 2 on the external surface 11*a* and one or more grips can be secured by one or more securing elements 2 on top and/or underneath a fastener 6 such as a zipper 6*a* and/or external fastener fold over 7 comprising of at least one layer of a hook and loop fastener 5.

In some embodiments, the fastener 6 such as a zipper 6*a* can have an invisible feature with one or more water proof coating selected from: water-proof coating, chlorosuifonated polyethylene (CSPE) synthetic rubber (CSM), polyvinyl chloride (PVC), polyurethane (PU), PVC tarpaulin in combination thereof. This allows the user to utilize the training bag 100 as a slam bag without any minerals depositing from the enclosure 101.

The user has the option to request prior to manufacturing various securing elements 2 on one or more grips 1 comprising of one or more rivets, one box stitching, one x box stitching.

In some embodiments, one grip 1 is secured to the external surface 11*a* by one or more securing elements 2 in a vertical direction which comprises of one or more fabric layers and in some embodiments, one or more grips 1 secured by one or more securing elements 2 in a horizontal direction to and/or from the vertical grip 1. It is to be understood one or more grips 1 can be secured to the top, bottom (not shown), periphery 11*b* of the training bag 100.

In some instances, one or more sets of grips is on a distal end and wherein when a second grip is proximal end of the first grip, wherein when another grip is adjacent to one or more of the grips secured by one or more securing elements on the external surface and periphery wherein when one or more grips is on a vertical and one or more grips is horizontal from one another in the closed bag configuration In some embodiments, the base of one or more grips 1 can comprise of an overlapping of fabric which can be interpreted as a loop 4 for attachments. For example, the structure of a grip 1 base can overlap at least one with stitching on one end to another which is then considered and viewed as a loop 4 for optional attachments such as straps to utilize the training bag 100 as a weighted backpack and/or dragging device.

It is to be understood a user can request one or more grips without binding and/or dividers, additional securing elements such as but not limiting to x box shape and rivets.

Although the aforementioned range is considered the preferred embodiment, the size of the grips 1 may comprise of an endless amount of sizes and ranges, that are suitable to serve the purpose of this disclosure. The grips 1 can be as large, or as small as needed to serve the intended purpose.

Example: Grip 1

In regards to the flexibility of the training bag 100 a user can firmly grasp more than one grip 1 of the surface area 11*a* and/or periphery 11*b* of the training bag 100 in an external closed bag configuration 100 without any stress to the user's wrist as previously illustrated in FIG. 1*a*. For example, a user performing kettlebell swing can firmly grasp two periphery grips 1 for a more controlled, smooth swing.

Current exercise bags on the market comprises of one layer of fabric as a grip 1 which can cause discomfort, awkwardness during Olympic lifting and overall wear and tear. During farmers walk, a user can grasp a grip 1 on a training bag 100 with discomfort after a few feet in regards to the thin grips.

The training bag 100 grip 1 provides compressed lining 16 such as foam, allowing the user to firmly grasp the training bag 100 for a long distance without discomfort. Additionally, the training bag 100 is equipped with securing elements 2 to increase the durability of large amount of weight in the enclosure bag configuration 101.

Loops 4

In some embodiments, one or more loops 4 can be fixed onto the surface of the training bag 100 in an open bag configuration and/or closed bag configuration.

In some embodiments, one or more loops 4 can be removable from the external surface 11*a* of the training bag 100 in an open bag configuration and/or closed bag configuration.

Figures 7, 7A, 7B:
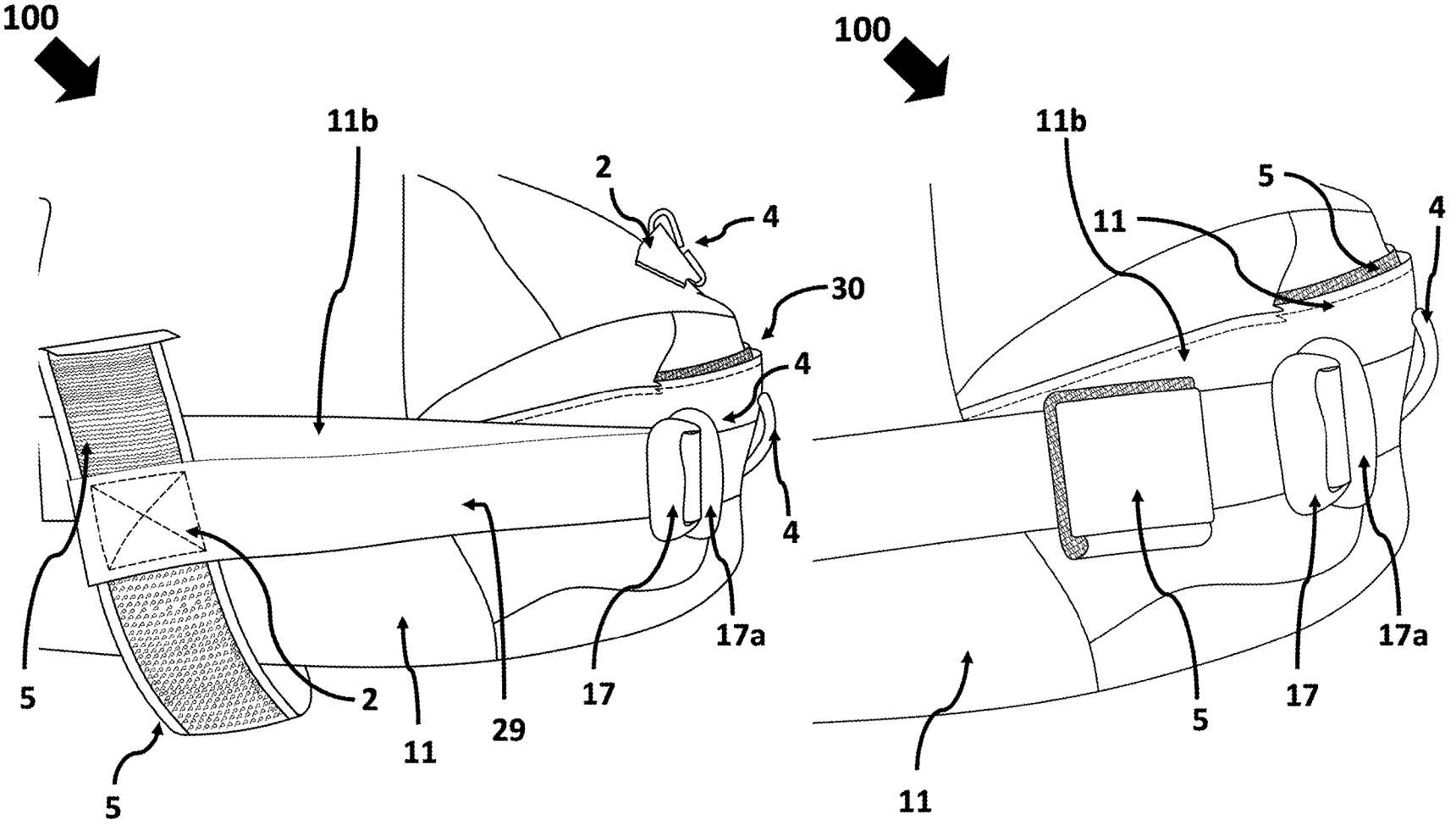
FIG. 7 is a side perspective view of a training bag, more specifically
FIG. 7*a* illustrates a loose fabric strap with an ending of a hook and loop fastener and FIG. 7*b* illustrates a fabric strap with a hook and loop fastener folded over adjacent to a adjustable working strap.

As illustrated in FIG. 7*a*, a loop 4 comprises of a slight opening however is reinforced by one or more securing element 2 to the external surface 11*a* and/or periphery 11*b* of the training bag 100 in a closed bag configuration.

In some perspective views, a loop 4 can comprise of a fabric fold-over fixed onto the external surface 11*a* area of the training bag 100 in a closed configuration. It is to be understood a loop 4 can comprise of one or more from the selected metal, steel, carbon steel, alloy steel, stainless steel, iron (wrought or cast), aluminum, magnesium, copper, brass, bronze, zinc, titanium, tungsten, adamantium, nickel, cobalt, tin, lead, silicon, PVC and PU coating in combination thereof. It is to be understood one or more loops 4 can have a fixed structure before manufacturing and in some instances, one or more loops 4 may have a slight slit opening which allows the user to remove the loop 4 depending on the usage of the training bag 100.

In some embodiments, a loop 4 can be viewed with the circumference of at least a half an inch, around the periphery 11*b*, but not limited to various measurements prior or subsequently to manufacturing.

Prior to manufacturing, a user can request a loop 4 to strictly be constructed with the main fabric of the training bag 100 in a closed bag and/or open bag configuration. For example, the fabric can be stitched onto one securing end which then can be folded over and can then be viewed as a loop 4 for optional attachable accessories which will be explained in the upcoming embodiments and figures.

It is to be understood at least one loop 4 can comprise of the similar structure of one grip 1 which is at least one layer of woven tape 3, a visual of at least one rivet with an x and/or square stitching around the woven tape 3 to secure one or more loops 4. In some examples, the rivets can use a combination of an x or square stitching based on proximity, and the probability of higher usage.

In some embodiments, one or more loops 4 may be shaped like a D-ring and in other embodiments, some may be shaped like a circle, depending on the view looked upon. In some instances, one or more loop 4 can vary in thickness and diameter, and size, depending on the location and functional purpose for the specific loop 4.

In some embodiments, at least one loop 4 securing element 2 such as one or more layers of woven tape 3 can be stitched from the top to bottom end allowing minimal to no movement of the loop 4. This will allow a user to carry the training bag 100 with attachments such as a harness 14, connecting straps 14*a* with minimal to no shifting.

In some embodiments, one loop 4 may have a coating of polyvinyl chloride (PVC) and/or with a mixture of polyurethane (PU) to prevent rusting if any minerals are in contact with a loop 4. The prevention of rust ensures that the durability is extended when coming in contact with sweat or other high moisture environments and interactions.

It is to be understood one or more loops 4 can be viewed as binding and/or securing elements 2 listed in previous embodiments which secures the structure of one or more adjustable working straps 17 which can also attach optional accessories and/or attachments which will be listed in the upcoming embodiments.

In some embodiments, at least one grip 1 is secured by one or more securing elements and/or woven tape which may have a slight opening and can also be considered as a loop 4 to attach optional accessories and/or attachments which will be listed in the upcoming embodiments.

In some embodiments, the training bag 100 in a closed bag and/or open bag configuration can comprise one or more loops 4 around the external surface 11*a* area and/or periphery 11*b* of the training bag 100 in an upward, downward, and/or side position which allows the user to have various options. It is to be understood one or more loops 4 can be located in the enclosure 101 for optional attachments.

In some embodiments, one or more loops 4 can comprise Nylon and/or similar threading 9 may be positioned to attach all of the fabrics as a whole. For example, when manufacturing, the Nylon thread and/or similar threading 9, such as binding 10, can be stitched through one or more fabrics. The fabric may be stitched through more than once, to maintain the structure all fabrics in a denser area, such as the fabric around one or more loops 4.

It is to be understood the training bag 100 is designed for functional activities wherein one or more loops 4 can be viewed on the external surface 11*a* of the training bag 100 in a closed bag configuration and/or one or more loops 4 around the enclosure 101 periphery 11*b* and/or external surface 11*a* area with or without one or more securing elements 2 in an open bag configuration 101.

In some embodiments, at least one fixed loop 4 can be fixed in the enclosure 101 surface area secured with at least one securing element 2 with the intended purpose to adjust the length of one or more adjustable working straps 17 to hold one or more weights in place which will be explained in the upcoming embodiments. In some instances, a user can utilize one or more fixed loops 4 for attachable objects related or unrelated to the training bag 100.

In some embodiments, at least one removable loop 4 can be fixed in the enclosure surface area secured with at least one securing element 2 with the intended purpose to adjust the length of one or more adjustable working straps 17 to secure one or more weights in place which will be explained in the upcoming embodiments. In some instances, a user can utilize one or more removable loops 4 for attachable objects related or unrelated to the training bag 100.

In some embodiments, a MOLLE attachments can be visual on the external surface 11*a* area and/or periphery 11*b* of the training bag 100 to attach optional objects related or unrelated to the apparatus. For example, a MOLLE attachments can be utilized as a loop 4 to attach a connection strap 14*a*-14*b* for dragging or lifting exercises in a closed 100 and/or open 101 configuration.

In some embodiments, one or more grips 1 can be viewed as a loop 4 during manufacturing. For example, a user can request a grip 1 to be as small as to fit one finger over and under for specific workouts. Additionally, a user can attach optional objects onto the grip 1 for various usages such as but not limited to, push and pull exercises.

In some instances, the foam of one or more grips 1 may have a slight opening that can attach an optional object such as a connecting strap 14*a*-14*b* for dragging and/or lifting exercises, related or unrelated to the apparatus.

In some embodiments, at least one cavity hole (not shown) can be located around the external surface 11*a* area and/or periphery 11*b* of the training bag 100 in a closed bag and/or open bag 101 configuration to attach optional accessories related or unrelated to the apparatus.

For example, two-cavity holes (not shown) can be vertically and/or horizontally for a hook on a connecting strap 14*a*-14*b* and/or other attachments for dragging or lifting exercises which will be explained in the upcoming embodiments, illustrations and examples.

In some embodiments, one or more cavity holes may comprise a cavity cover to secure all objects and/or minerals in the enclosure 101.

In some embodiments, a cavity cover can comprise of a fastener 6 such as a hook and a loop fastener 5, not limiting to similar fasteners 6 with or without waterproof coating such as PVC and/or PU coating.

In some instances, a cavity cover can swivel which is then secured by a fastener 6.

In some embodiments, a cavity cover can have a visual or no visual depending on the textile manufactured.

It is to be understood a loop 4 can be viewed around the periphery 11*b* and external surface 11*a* facing up, down, and/or the side way in the closed 100 and open bag 101 configuration which is decided before manufacturing.

In some embodiments, one or more loops 4 can be secured by one or more securing elements 2 proximal to distal, adjacent to one or more grips 1 on the external surface 11*a* and periphery 11*b* of the training bag 100 closed configuration. For example, two loops 4 near a grip 1 on the periphery 11*b* of the closed training bag configuration 100. Also, in some embodiments, one or more loops 4 can be in a horizontal or vertical view, which a user can request prior to manufacturing.

In some embodiments, one or more loops 4 can be secured by one or more securing elements 2 directly on the durable surface 11 (not shown) for strictly attachments such as backpack straps 28, harness 14 and other optional attachments. For example, a user can strictly utilize the training bag 100 as a leisure backpack which allows the user to request flexible fabrics in previous embodiments without the ability to drag the training bag 100. Additionally, one or more loops 4 can be secured by one or more rivets to swivel in a 1-360-degree rotation.

The intended purpose for loops 4 on the training bag 100 is for attachments to utilize as a backpack, dragging device, leisure bag, baseball bag. Additionally, prior to manufacturing, a user can request the training bag 100 with a customized length to be utilized as a golf bag to place golf clubs directly in the enclosure 101 proximal end and/or distal end of the training bag 100 with optional openings such as separate compartments (not shown).

In some embodiments, a training bag 100 can fold over at least one which is then secured by one or more straps and/or adjustable working straps 17 but not limiting to connecting straps 14*a*-14*b* to minimize the size of the training bag 100 and also to conveniently stow away in a suitcase when travelling.

In some embodiments, one or more loops 4 can be secured as the axis by one or more secure elements 2 such as a rivet but not limiting to other securing elements 2 to swivel which can increase the ability to drag and carry the training bag 100 in different directions.

Although the aforementioned range is considered the preferred embodiment, the size of the loops 4 can comprise an endless amount of sizes and ranges, with a single layer of fabric and/or one or more layers with or without waterproof coating such as PVC and/or PU coating that are suitable to serve the purpose of this disclosure. The loops can be as large 4, or as small as needed to serve the intended purpose.

Example: Loops 4

The training bag 100 can be viewed as a dragging tool with a harness 14, and connecting strap 14*a* configured to be dragged on either side of the training bag 100. The user can adjust the harness 14 according to the body composition via adjustable working straps 17 followed by attaching on one or more hooks 18 via connecting strap 14*a* on one or more loops 4 around the perimeter of the harness 14. The opposite ending of the connecting strap 14*a* can be attached to one or more loops 4 on the training bag 100. It is preferred to securely attach all three connecting straps 14*a* hooks 18, onto each of the three loops 4 on the training bag 100 to configure as a dragging tool. Attaching the connection straps 14*a*-14*b* onto each of the three loops 4 of the training bag 100 can distribute the enclosed weight evenly, preventing swiveling and raising of the training bag 100 during running, speed, and agility exercises. For example, a track and field athlete to improve a short distance goal such as the 40-yard dash, can utilize all weight in the enclosure of the training bag 100 and prevent swiveling by attaching all three connecting straps 14*a* hooks 18 on one side of the training bag 100. The friction of the durable surface 11 allows the training bag 100 to come to a stop when the user would complete the exercise on any surface about the comprising fabric and coating on the durable surface 11.

Other inventions may have one loop 4 which increases lifting of the dragging tool and swivel, which does not utilize the dragging tool. This particular method could cause the user to lose a smooth-running form, and cause apparent injury if the training bag 100 were to pull the runner in an awkward direction, or not stop when the runner ceases running. In addition, other dragging tools on the market may not create enough friction, which would result in the dragging tool possibly causing an injury to the rear lower body when coming to a stop.

In some instances, a user can attach one or more hooks 18 of a connecting strap 14*a* to a loop 4, comprising of fabric that was previously mentioned. One or more securing elements 2 of a loop 4 comprises additional securing element the training bag 100 will not damage. For example, if a training bag 100 is not manufactured with metal loops 4, a loop comprising of fabric on the external surface 11*a* and/or periphery 11*b* of the training bag 100 in an external closed bag configuration. During manufacturing, a smaller size training bag 100 can comprise of smaller size loops 4 however, depending on the request of a user, a loop on a smaller size training bag 100 a loop can have a larger opening.

To utilize detachable backpack straps 28, a user has the option to clip on one or more hooks 18 of a backpack strap 28 around the periphery 11*b* of the training bag 100 in an external closed bag configuration 100. For example, a firefighter can quickly attach and flip the training bag 100 onto his back while adjusting the adjustable working straps 17 on the detachable backpack straps 28. It is to be understood more than one loop 4 can be viewed around the periphery 11*b* of the training bag 100 which allows the user to wear the training bag 100 vertically or horizontally. Current exercise bags on the market do not have loops 4 on the periphery 11*b* of a bag for attachments.

To utilize the training bag 100 as a duffle bag, at least one hook 18 of a shoulder strap 15 has the ability to attach to the loop 4 on either side of the training bag 100. It is preferred to attach the hooks 18 to the top loops 4 on the periphery 11*b* of the training bag 100 to prevent the training bag 100 from swiveling when walking.

To utilize the training bag 100 as a baseball bag, a user can attach a hook 18 onto one or more loops 4 and which then can attach to the fence. It is to be understood one or more securing elements 2 around the structure of one or more loops 4 can hold an unlimited amount of weight when hanging from a leveled surface, such as a baseball diamond fence.

Adjustable Working Straps 17 and Buckle 6

Other exercise bags on the market comprises of multiple sizes to hold various weights. The training bag 100 comprises at least one adjustable working strap 17 around the external surface 11*a* and/or periphery 11*b* of the training bag 100 in the closed bag and open and/or configuration.

In some embodiments, an adjustable working strap 17 is located on the periphery 11*b* of the training bag 100 to tighten or loosen the training bag 100 depending on the amount of weight as depicted in FIG. 6*a*-6*c*.

Figure 3:
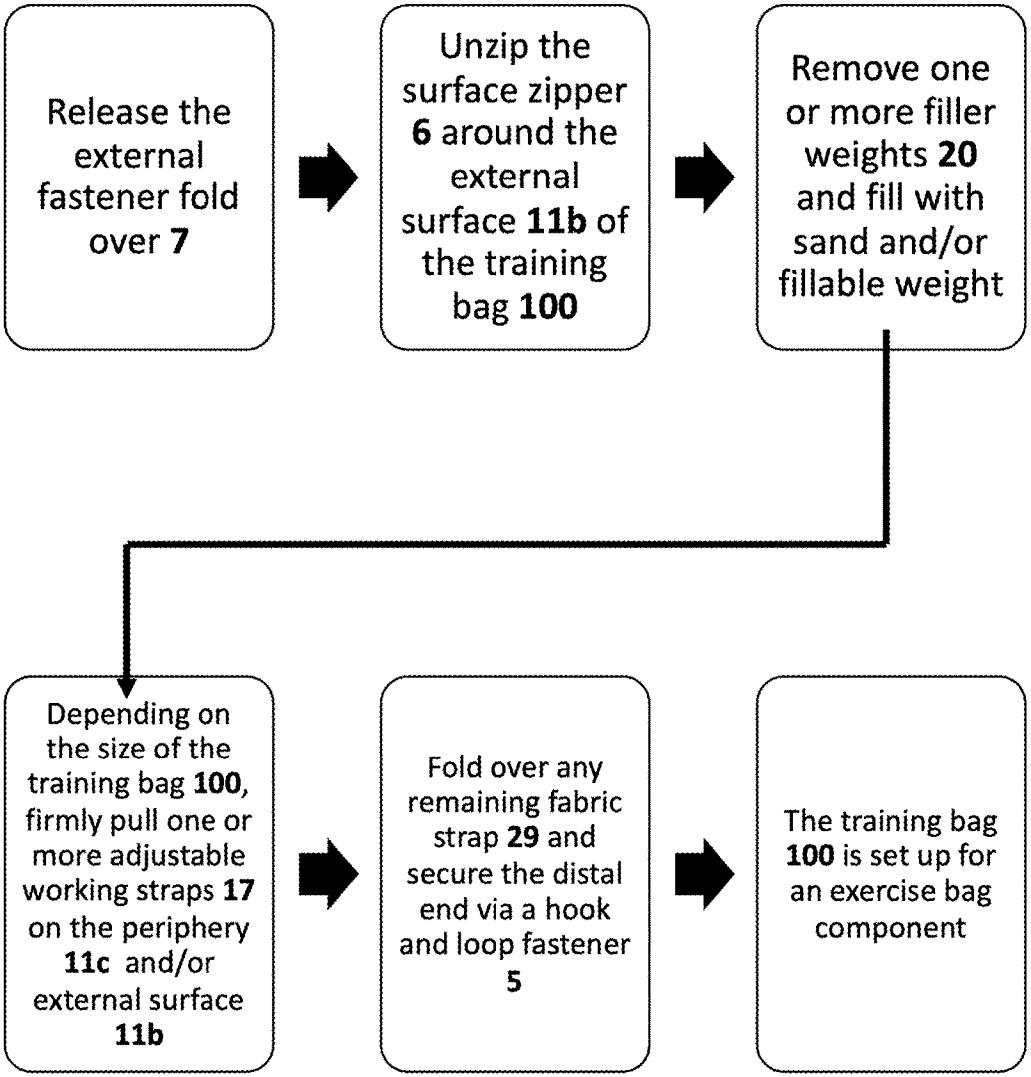
FIG. 3 is the preferred method for a transition from a closed bag configuration to open bag configuration and adjusting the adjustable weight straps.

FIG. 3 illustrates the preferred method to add weight in the enclosure and adjust the adjustable working strap 17 to the preferred weight in the enclosure. It is to be understood this is a preferred method and not required. Also, it is to be understood the amount of weight in the enclosure 101 of the training bag 100 depends on the usage of the adjustable working strap 17. For example, if a user places two weights in the enclosure, the user can adjust one or more horizontal and/or vertically adjustable working straps 17 to tighten the weights in place with minimal or no movement.

In some embodiments, the user can place four weights or more weights in the enclosure 101 with the fabric remaining loosely. The user has the option to tighten one or more adjustable working straps 17 around the training bag 100 to tighten the fabric.

To tighten or loosen the fabric strap on the adjustable working strap 17, the user can slightly lift one ending of the adjustable working strap 17 allowing a passage to either pull or loosen the fabric strap.

It is to be understood one or more weights can comprise of filler weight 20 which will be described in the upcoming embodiments.

In some embodiments, the expansion of the internal weight in the enclosure 101 of the training bag 100 is shown, in which a user can loosen the adjustable working straps 17, allowing the fabric to loosen.

In some embodiments, at least one adjustable working strap 17 can be fixed with at least one securing element 2 and/or one or more layers of adhesive on the external surface area 11*a* of the training bag 100 to hold the fabric in between the closed 100 and open bag 101 configuration. For example, a user can attach one or more backpack straps 28 by at least one strap; which then can lead to the adjustable working strap 17 swivel to adjust to the user's body size.

The adjustable working strap 17 anchor can be metal and/or plastic. However, for long-lasting durability, the user can request one or more mixtures of dense minerals before manufacturing the adjustable working strap 17 anchor.

The adjustable working strap 17 anchor can comprise at least one divider for the fabric strap to fold over and/or under to securely tighten and/or loosen the training bag 100.

It is to be understood one or more adjustable working strap anchors can be used for other purposes such as securing optional accessories such as connecting straps 14*a*-14*b*, not limiting to similar related and/or unrelated accessories to the training bag 100.

In some embodiments, a securing element 2 such as a rivet, not limited to securing elements 2 mentioned in previous embodiments can be placed on one or more adjustable working straps 17 to allow the fabric strap 29 to rotate and/or swivel.

In some embodiments, an adjustable working strap cover 17*a* can comprise at least one layer of comfort foam padding and one or more layers of a mixture of textiles selected from nylon, Cordura, polyester, canvas woven tape in combination thereof to prevent any damage to the underlying layer of padding.

In some embodiments, the adjustable working strap 17 is hidden by way of the adjustable working strap cover 17*a*.

In some embodiments, the adjustable working strap 17 can have a visual with or without a fixed and/or removable adjustable working strap cover 17.

The adjustable working strap cover 17*a* can fold over either vertical and/or horizontal to cover the adjustable working strap 17 with minimal to no visual.

In some embodiments, one or more securing elements 2 such as binding, not limited to securing elements mentioned in previous embodiments can secure the adjustable working strap 17 in place on the external surface 11*a* area with minimal to no space in between. The user has the option to attach optional accessories such as backpack straps 28 and/or connecting straps 14*a*-14*b* onto the securing element 2 which can also be viewed as a loop 4.

In some embodiments, one or more adjustable working straps 17 can be fixed and/or removable on the top surface vertically and/or horizontally and/or slanted on the training bag 100 in a closed and/or open bag configuration. This allows the user to not only tighten the sides of the training bag 100 as discussed in previous embodiments but to tighten and/or loosen the training bag 100 depending on the amount of weight in the enclosure 101.

In some embodiments, at least one adjustable working strap 17 and fabric strap 29 can fold over and/or under one or more grips 1 on the front external surface 11*a* of the training bag 100 in a closed configuration (not shown) to tighten and/or loosen from either vertically and/or horizontally.

In some embodiments, at least one adjustable working strap 17 and fabric strap 29 can be in between one or more grips 1 and securing elements 2 on the front external surface 11*a* of the training bag 100 wrapped around to the rear durable surface 11 in a closed configuration (not shown) to tighten and/or loosen from either vertically and/or horizontally.

In some embodiments, at least one adjustable working strap 17 and fabric strap 29 can wrap around and over one another on the durable surface 11 of the training bag 100 in a closed configuration (not shown) to tighten and/or loosen from either vertically and/or horizontally.

It may be convenient to retail removable adjustable working straps 17 as an individual item which can allow the user to have a fixed weight in the enclosure 101 of the training bag 100 with minimal securing devices onto the external surface 11*a* area and/or periphery 11*b*. For example, a user can request prior to manufacturing one to two filler weights 20 fixed in the enclosure 101 which does not include adjustable working straps 17 around the training bag 100 in an open and/or closed configuration.

Additionally, a user can request a larger size training bag 100 with one or more removable adjustable working straps 17.

In some embodiments, one or more adjustable working strap 17 is attached by at least one layer of a hook and loop fastener 5 to be held folded, attaching onto the opposite side of the hook and loop fastener 5 to be held and viewed as a bag structure.

In some embodiments, at least one adjustable working strap 17 comprises at least one woven tape 3 wrapped around the periphery 11*b* of the training bag 100 to be viewed as a rectangle shape with one or more securing elements 2 stitching viewed as an x shaped and/or outlining of the adjustable working strap 17 to be held securely if and when a large amount of weight is held in the enclosure 101.

In some embodiments, the ending fabric strap 29 can be secured by one or more securing elements listed in previous embodiments with an unlimited measurement, depending on the size of the training bag 100.

In some embodiments, a fabric strap is secured by at least one layer of nylon stitching in a box x shaped onto the surface area of the training bag 100.

In some embodiments, the fabric strap 29 is fixed on one end positioned on the external surface 11*a* and/or periphery 11*b* of the training bag 100 and the ending is loose for the user to insert the fabric strap over and/or under one or more dividers on the base of the adjustable working strap 17 as depicted in FIG. 7*a*-7*b*.

It may be convenient to retail a separately adjustable working strap 17 anchor to provide the user with options, depending on the specific goal to be achieved.

It is to be understood the ending of at least one fabric strap 29 can be integrated with the one or more securing element 2 and/or grips 1.

As previously illustrated in FIG. 7*a*, the fabric strap 29 is extended to an excessive length. The user can fold over the fabric strap 29 at least once and then secured it with a fastener 6, such as a hook and a loop fastener 5 to secure the ending of the fabric strap 29 as previously illustrated in FIG. 7*b*.

It is to be understood the fabric strap 29 can comprise a mixture of textiles such as nylon but is not limited to similar textiles with or without PVC and/or PU coating.

In some embodiments, a user can request before manufacturing a fabric strap glider 29*a* which can secure the loose fabric strap, eliminating the option of a hook and loop fastener 5 to fold over. It may be convenient to have both fabric strap glider 29*a* and a hook and loop fastener 5 to secure the excessive fabric in place without the tangling.

In some instances, a fabric strap glider 29*a* can comprise the selected: foam padding, compressed lining, mesh, webbing, nylon, ballistic nylon, canvas, polyester, water-proof coating, chiorosulfonated polyethylene (CSPE) synthetic rubber (CSM), polyvinyl chloride (PVC) and/or with a mixture of polyurethane (PU), PVC tarpaulin in combination thereof secured by one or more securing elements 2.

In some embodiments, a fabric strap glider 29*a* can wrap around at least once, secured by one or more securing elements at the base of the adjustable working straps. This allows the user to tighten and/or loosen the fabric strap 29 without folding over the hook and loop fastener.

In some embodiments, the rear of a training bag 100 mid-way of a fastener 6, in particular the mid-point zipper without ending in between the exterior fold over 7 and adjustable working strap 17 as a connector to hold a bag structure.

It is to be understood the connecting side of the hook and loop fastener 5 on the training bag 100 can be longer and/or wider depending on what is held in the enclosure 101 and also depending on the user.

Prior to manufacturing and/or retail, a user has the option to request an additional fastener 6 such as a buckle in addition to the adjustable working strap 17 for an additional securing element and reassurance all weights in the enclosure 101 will remain closed with minimal to no movement.

In some instances, one or more buckles 6 can be hidden under one or more adjustable working strap covers 17*a* to protect from any damage, which will be elaborated on in examples for adjustable working straps 17.

In some embodiments, a buckle 6 is secured to the periphery 11*b* of the training bag 100 distal to the adjustable working strap.

In some embodiments, an adjustable working strap 17 is fixed onto the distal end of the buckle 7 on the external surface 11*a* and/or periphery 11*b* of the closed bag configuration 100 to tighten and/or loosen the structure. In some instances, the distal end of the buckle which is considered as the fixed adjustable working strap 17 comprises of a fabric strap to fold over at least once for additional reassurance to tighten and/or loosen the training bag 100 structure. In some instances, the ending of the fabric strap can comprise of one or more layers of a hook and loop fastener to tighten the excessive fabric strap 29.

In some embodiments, a buckle 6 can comprise of different or a mixture of metal and/or plastic. However, for long-lasting durability, the user can request one or more mixtures of dense minerals for one or more buckles.

It is to be understood one or more adjustable working straps 17 and buckles 6 can comprise of the selected metal, steel, carbon steel, alloy steel, stainless steel, iron (wrought or cast), aluminum, magnesium, copper, brass, bronze, zinc, titanium, tungsten, adamantium, nickel, cobalt, tin, lead, silicon, PVC and PU coating in combination thereof.

Depending on the weight capacity inside the training bag 100, one or more adjustable working strap 17 fabrics can be utilized as a grip 1 with respect to the length from one ending point to another. For example, an adjustable working strap 17 fabric 29 can be picked up mid-way of the beginning and ending point to use for exercises and/or leisure activities. The midpoint of the adjustable working strap 17 fabric 29 will be viewed close to the external surface 11*a* of the training bag 100 with respect to the internal weight as previously discussed.

The user has the option to secure the adjustable working straps 17 inside the enclosure 101 of the training bag 100 to be used more flexibly, however, this may not show a bag structure. Also, prior to retail, the training bag 100 structure can comprise completely or partially flat with the adjustable working straps 17 tucked inside to keep a durable surface 11 and also allow the user to fold the back at least once when traveling. For example, when traveling, one or more adjustable working straps 17 can be placed inside and the training bag 100 can fold at least once. However, the user can decide where the adjustable working straps 17 can be placed.

One or more removable adjustable working straps 17 can be retailed separately which is intended to secure one or more removable weights in the enclosure which will be elaborated in upcoming embodiments and illustrations.

In some embodiments, the adjustable working strap 17 can comprise of at least one layer of woven tape which can also be the same woven tape as the ending of one or more grips which was explained in previous embodiments. This is convenient for manufacturing as multiple components are not necessary.

In some embodiments, a minimal space between the adjustable working strap 17 woven tape and grip 1 woven tape can be secured by a securing element 2, folded over at least once to create a loop for attachments.

In some embodiments, the securing element 2 can comprise nylon stitching as a box shape and/or X shaped to reassure all weight inside the training bag 100 will remain secure when lifting, throwing, dragging, and using the training bag 100 for other physical activities.

In some embodiments, the adjustable working strap 17 and cover 17*a* can be fixed and/or removable vertically and/or horizontally on the external surface 11*a* and periphery 11*b* of the training bag 100.

In some embodiments, the base holding the structure of one or more adjustable working straps 17 can be the similar and/or same as the structure securing one or more grips 1 and loops 4 on the external surface 11*a* and periphery 11*b* of the closed bag configuration. For example, a securing element 2 such as binding and/or woven tape can comprise one strip of fabric strap 29 wrapped around the periphery 11*b* of the training bag 100 with components such as grips 1, loops 4 and adjustable working straps 17.

In some instances, one or more layers of a securing element 2 can comprise attachments of the training bag 100 components such as grips 1, loops 4 and adjustable working straps 17 on the external surface 11*a* and periphery 11*b* of the training bag in a closed configuration 100.

Depending on the activity the user has desired, the adjustable working strap 17 can be replaced with a buckle 6 on the external surface 11*a* and/or periphery 11*b* around the training bag 100 in a closed bag configuration.

It is to be understood one or more adjustable working straps 17 and/or one or more buckles 6 can be secured by one or more securing elements 2 vertically and/or horizontally on the on the external surface 11*a* and the periphery 11*b* of the closed bag configuration 100. In some instances, a user can request one starting point of the adjustable working strap 17 and/or buckle 6 to start on the top right corner and ending point on the bottom left corner on the external surface 11*a* of the closed bag configuration.

It is to be understood vertically and/or horizontally can be interpreted as upwards, downwards, and/or sideways.

In some instances, a training bag 100 can be retailed separately with minimal to no weight in the enclosure as illustrated in FIG. 8*a* and in some instances, a training bag 100 can comprise of weight in the enclosure 101 with an expansion as illustrated in FIG. 8*b*.

Although the aforementioned range is considered the preferred embodiment, the size of the adjustable working strap 17 and buckle 6 can comprise an endless amount of sizes and ranges, that are suitable to serve the purpose of this disclosure. The adjustable working strap 17 and buckle can be as large, or as small as needed to serve the intended purpose.

Example: Adjustable Working Straps 17 and Buckle 6

As previously illustrated in FIG. 7*a*-7*b*, the transition and appropriate steps to tighten and/or loosen the adjustable working strap 17 and folding over the fabric strap 29 via a hook and loop fastener 5.

During overhead presses, the user can conveniently tighten or loosen the fabric straps by pulling the fabric strap followed by folding over the fabric strap which is then secured by a fastener such as a hook and a loop fastener to prevent any loose fabric strap during the exercise. Additionally, the adjustable working strap cover reassured the user the adjustable working strap will not cause any sort of injury during the exercise.

FIG. 6 illustrates three training bags with FIG. 6*a* with minimal to no weight, FIG. 6*b* comprising of weight and FIG. 6*c* comprising of maximum weight in the closed bag configuration 100.

When using the training bag 100 as a backpack, the user has the option to secure the internal weights and/or filler weights 20 in place with one or more securing elements 2 in the enclosure 101. The alternative option is to place the weights in the enclosure 101, unsecured allowing the weights to move freely. The bottom, lower end of the training bag 100 will contain one or more weights which leave the top to mid-portion of the training bag 100 to be empty. The user can then use one or more adjustable working straps 17 to tighten vertically and/or horizontally to eliminate the excessive fabric of the training bag 100.

During heavy loading exercises such as back squats, the user can insert countless amounts of filler weights into the enclosure 101. To expand the space, the user can lift the adjustable working strap 17 and firmly pull the fabric strap 29 to allow expansion on the training bag 100 in a closed and/or open bag 101 configuration. It is to be understood that fixed and/or removable adjustable working straps 17 can be positioned around the external surface 11*a* area of the training bag 100 which provides the user with options on where to allow expansion, depending on the certain exercise performed.

When packaging, the seller can use one or more adjustable working straps 17 wrapped around vertically and/or horizontally positioned around the training bag 100 in a closed and/or open configuration. This will allow the user to conveniently package the training bag 100 in a small amount of space which can decrease the shipping cost of the apparatus and/or accessories.

A user can fold the training bag 100 at least once in a closed and/or open configuration to stow in a suitcase for travel. The user can then use the removable adjustable working strap 17 to hold the training bag 100 in place which will also eliminate space in the luggage.

In some instances, one or more adjustable working straps 17 may have at least one layer of a hook and loop fastener 5 as a partial and/or entire fabric strap 29 to adjust the appropriate size which can also be viewed as a similarity of a hook and loop fastener 5 shoe functions.

It is to be understood the adjustable working strap 17 can be used for activities related to and/or unrelated to the training bag 100 and components.

Durable Surface 11

Figure 9:
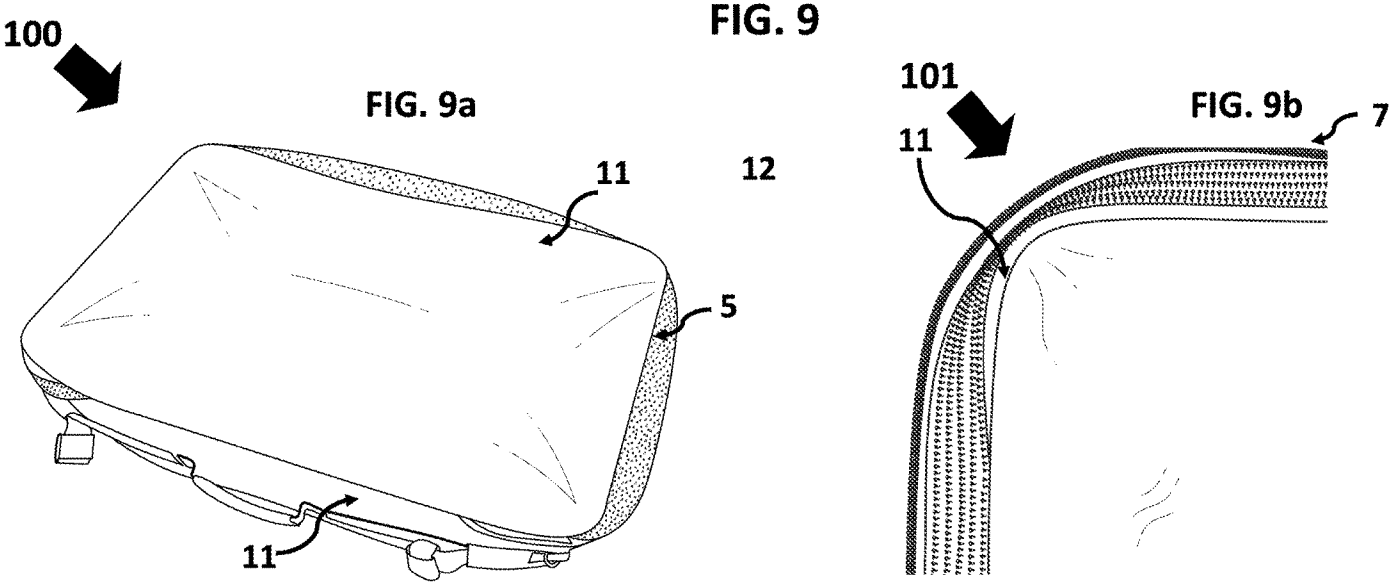
FIG. 9 is a rear and side perspective view of the durable surface on a training bag, more specifically
Figure 9:
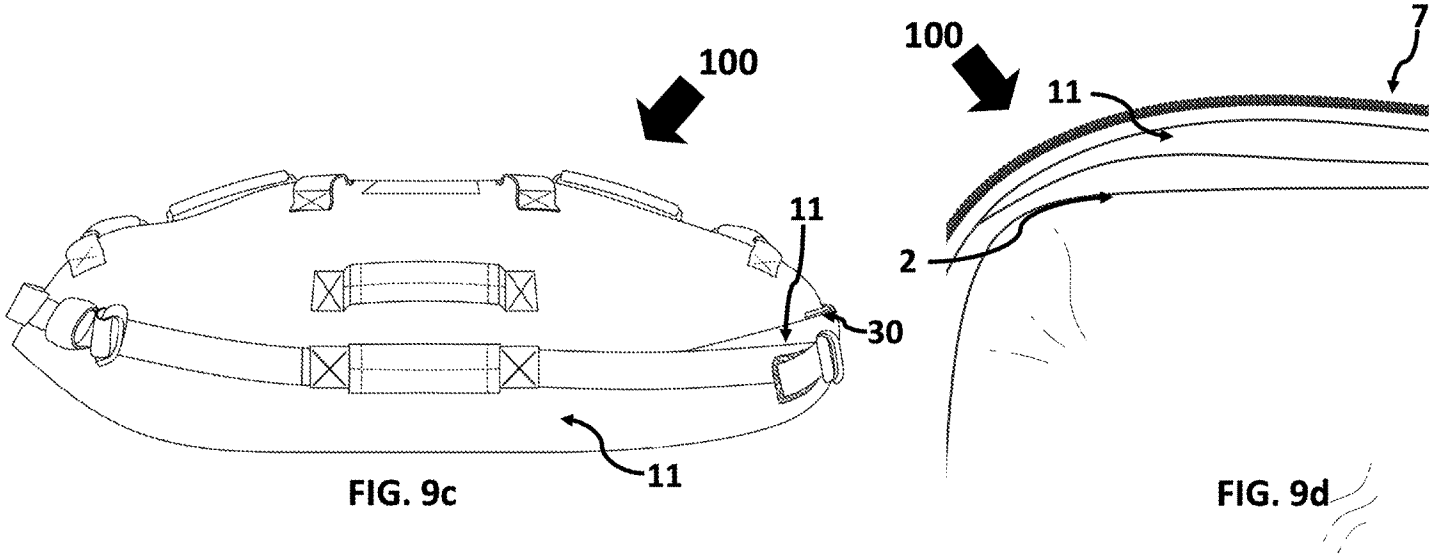

FIG. 9*a* illustrates a training bag with a fixed durable surface 11 comprising of one or more layers, selected of rubber, latex, petroleum, and/or similar minerals with at least one layer of water-proof coating, chlorosulfonated polyethylene (CSPE) synthetic rubber (CSM), polyvinyl chloride (PVC) and/or with a mixture of polyurethane (PU), PVC tarpaulin, materials metals, aluminum, silver, copper, and alloys secured by one or more layers of adhesive and stitching on and around the periphery, internal and/or external in combination thereof. In some instances, the durable surface 11 may be slightly elevated depending on the layers and thickness when manufactured. It is to be understood a rear foam surface can comprise of the similar and/or same elements and construction when manufactured.

It is to be understood the durable surface 11 is meant for hard impact slams and dragging activities which will be explained in later embodiments. However, a training bag 100 can be designed and manufactured with a single layer of PVC and/or PU coating to be dragged on certain surfaces.

In some embodiments, the training bag 100 durable surfaces 11 can be manufactured overlapping around the periphery 11*b* of the training bag 100 as depicted in FIG. 9*c*-9*d*.

Optionally, prior to manufacturing, at least one side of the periphery 11*c* of the training bag 100 may have one or more layers for dragging workouts which will be explained in examples.

The friction of the durable surface 11 allows the training bag 100 to come to a stop when the user would complete the exercise on any surface in reference to the comprising fabric and coating on the durable surface 11. Other inventions may comprise of one loop 4 which increases lifting of the dragging tool and swivel, which does not utilize the dragging tool. This particular method could cause the user to lose a smooth-running form, and cause apparent injury if the training bag 100 were to pull the runner in an awkward direction, or not stop when the runner ceases running. In addition, other dragging tools on the market may not create enough friction, which would result in the dragging tool possibly causing an injury to the rear lower body when coming to a stop.

In some embodiments, one or more layers of a durable surface 11 can comprise ballistic nylon and/or similar bulletproof textiles for combat training. For example, a user can hold the training bag 100 as body armor. The bulletproof durable surface 11 can protect a user which can also be viewed as a body shield. It is to be understood at least one layer of ballistic nylon and/or bulletproof fabrics such as synthetic fiber and/or Kevlar around the durable surface and/or entire external and/or internal surface of the training bag 100.

In some embodiments, one or more layers of ballistic nylon and/or bulletproof fabric can comprise one or more layers of PVC and/or PU coating to utilize in any weather condition.

In some instances, the main fabric of the entire training bag 100 can comprise of one or more layers of a durable surface 11 designed for intensive activities.

In some instances, during the start of manufacturing, one or more layers of the external surface 11*a* can be secured to the durable surface 11 overlapping at least once which increases the durability of the training bag 11 as depicted in FIGS. 9*b* and 9*d*. For example, at least one layer of a durable surface 11 can be seen in the internal surface as depicted in FIG. 9*b* in the open bag configuration 101. The purpose of this intention is to reinforce that the durable surface 11 is not a flat sheet of fabric but a full complete durable surface 11 with no additional fabric from the periphery 11*b* and top external surface 11*a*. This can be interpreted as the durable surface 11 in the internal surface 12 in the open bag configuration 101.

In some embodiments, the durable surface 11 is the main surface of the internal surface 12 of the training bag 100 in an open configuration 101.

In some embodiments, one or more cavity holes (not shown) can comprise a mixture of metals and/or fabrics listed in the previous embodiments to be secured around the training bag 100 in a closed configuration for dragging. For example, one or more cavity holes can be located on the external surface for attachments such as connecting straps to drag the training bag 100 as a weight.

It is to be understood a durable surface 11 can comprise one or more layers of a mixture of fabric with or without PVC and/or PU coating which is visible in the closed training bag 100 configuration. The internal surface 12 of the training bag 11 enclosure may have a visual of the durable surface 11 overlapping with additional fabric to ensure durability. For example, a user can drag the training bag 100 on a hill with sharp objects without causing damage to the periphery 11*b* of training bag 100.

In some instances, the durable surface 11 may comprise of thread stitching with or without adhesive (hidden) along the periphery of the training bag 100 in a closed and open bag configuration to create an additional securing element 2 to drag on any surface.

In some embodiments, a durable surface 11 can comprise of at least one sheet of metal secured by at least one securing element 2 to the external surface 11*a* of the closed bag configuration 100 for dragging on any surface. In some instances, a sheet of metal can comprise PVC and/or PU coating to protect and eliminate rust when dragging on surfaces that may cause damage over time.

In some embodiments, a sheet of metal can wrap around the periphery 11*b* and top external surface 11*a* of the closed bag configuration 100.

In some embodiments, the ending of a hook and loop fastener 5 of the training bag 100 may fold over the durable surface 11 which can be viewed as the main fabric of the training bag 100 in an external closed bag configuration.

In some embodiments, the durable surface 11 can have a visual of objects in the compartment such as a detachable durable surface 27 in an external compartment 30 which will be elaborated in the upcoming embodiments and figures.

In some embodiments, a partial and/or half of the external rear surface can comprise of a durable surface 11 and the opposite half comprises of the training bag 100 fabric. For example, it may be convenient to retail the external rear surface for leisure activities such as hiking. A user can then place half of the training bag 100 durable surface 11 onto the ground with the remaining half intended for other purposes such as folding the training bag 100 in half with one or more connecting straps 14*a*-14*b* and/or similar straps.

It is to be understood the durable surface 11 can be manufactured with one fabric to remain flexible to hold as a regular bag structure. For example, a user can request before manufacturing one layer of a durable surface 11 to use as a backpack and in another instance, a user can request to have one than one layer to use for hard impact slams, throws, and/or dragging on any surface.

In some instances, a user can request prior to manufacturing the complete closed bag configuration 100 surface to comprise of one or more layers of a durable surface 11, depending on the intended purpose.

With respect to the loops 4 around the external surface 11*a* and periphery 11*b*, a user has the option to attach one or more individual straps of a connecting strap 14*a*-14*b* onto the lateral side of the training bag 100 which will be elaborated in the upcoming embodiments and figures. However, the user also has the ability to attach one or more individual straps of a connecting strap 14*a*-14*b* to one or more loops 4 around the periphery 11*b* of the training bag 100, over top the external surface 11*a*, over and under one or more grips 1, around the entire periphery 11*b* of the training bag 100 to utilize as a dragging tool as depicted in FIG. 1*f*.

It is to be understood a user can utilize one or all attachment points to haul the training bag 100 as a dragging tool.

Rear Foam Surface 16

In some embodiments, a rear foam surface can be considered as compressed lining 16 which is substituted of a durable surface 11 depending on the usage of the training bag 100. However, the rear foam surface 16 is selected from: foam padding, compressed lining, mesh, webbing, nylon, ballistic nylon, canvas, polyester, water-proof coating, chlorosulfonated polyethylene (CSPE) synthetic rubber (CSM), polyvinyl chloride (PVC), and/or with a mixture of polyurethane (PU), PVC tarpaulin secured by one or more securing elements 2 in combination thereof.

Figure 10:
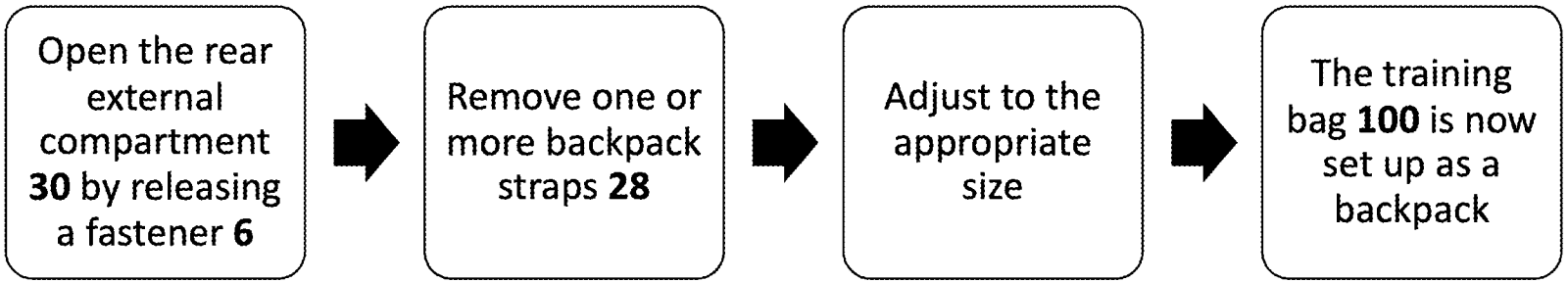
FIG. 10 is the preferred method for a transition from a training bag to a backpack set up.
Figure 12:
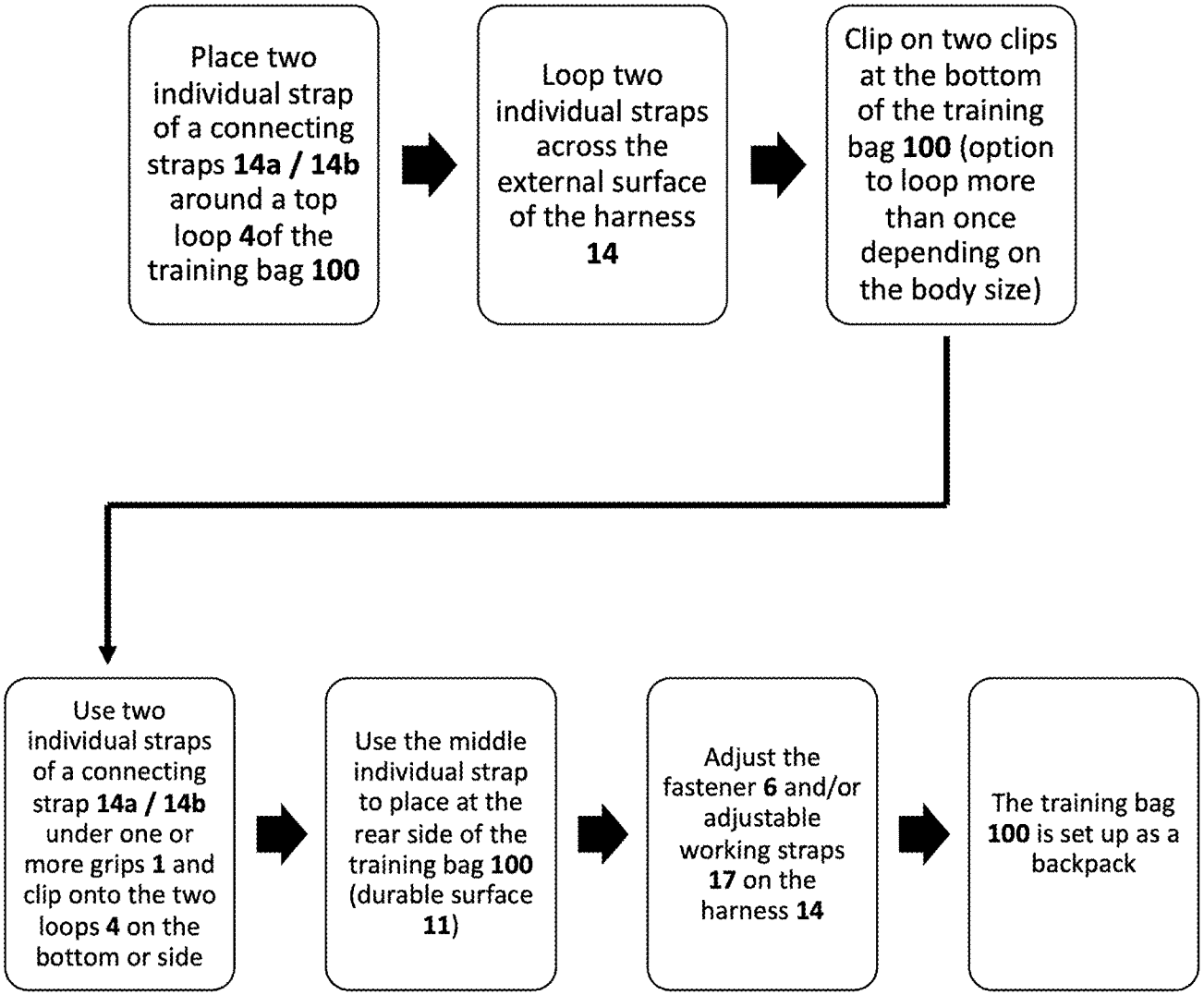
FIG. 12 is the preferred method for a harness and connecting strap for a backpack set-up.

FIG. 10 illustrates the preferred transition from a training bag 100 to a backpack set up. It is to be understood the method is a preferred and is not required. The intended purpose for the rear foam surface 16 is to utilize the training bag 100 as a comfortable backpack as illustrated in FIG. 11*d* with similar usage. For example, a user may require a training bag 100 to be utilized as an exercise bag with grips 1, filler weights 20, backpack straps 28 and sled without dragging on a durable surface 11 can request a rear foam surface 16 instead of a durable surface, prior to manufacturing.

It is to be understood the rear foam surface 16 can still be dragged and slammed however, the density and durability of the training bag 100 will not have a long-lasting as a durable surface 11.

In some embodiments, a rear foam surface 16 can be located on the rear end of the training bag 100 which is overlapped onto the periphery 11*b* of the training bag 100 which is then led to the internal of the training bag 100 secured by one or more securing elements 2. For example, during manufacturing, at least one layer of fabric, similar to the constructed fabrics as the external surface 11*a* of the training bag 100 can comprise the first layer, followed by the rear foam surface 16 secured in the external 11*a* and internal 12 training bag 100 configurations.

In some instances, the rear foam surface 16 can comprise of one or more loops 4 around the periphery 11*b* surface for attachments such as one or more connecting straps 14*a*-14*b* and/or unrelated accessories to the training bag 100 components. Additionally, the user has the option to attach a removable adjustable working strap 17 around the external surface 11*a* of the training bag 100 to wrap around the rear foam surface 16.

In some embodiments, a rear foam surface 16 can comprise one or more layers of compressed fabric 16 to allow the user to comfortably carry significant weight in the training bag 100 when utilized as a backpack.

In some embodiments, the rear foam surface 16 can comprise of a thin divot, vertically to allow the user's spine to comfortably size when utilizing the training bag 100 as a backpack. Current backpacks on the market comprise a standard foam padding with no divots, accommodating to the user's posture.

In some instances, hikers utilizing the training bag 100 as a regular hiking bag can wash the external surface 11*a* of the training bag 100 in a pool of water without the training bag 100 sinking. The rear foam surface padding 16 and mesh allows the training bag 100 to float with or without weight in the enclosure 101.

In some embodiments, a grip 1 constructed with nylon and/or similar fabrics depicted in previous embodiments can be secured on one or more periphery and/or external surfaces of the rear foam surface for gripping the training bag 100 for exercises.

In some embodiments, the external compartment 30 can deposit one or more backpack 28 straps around the periphery 11*b* of the training bag 100 to utilize as strictly a backpack.

It is to be understood the rear foam surface 16 can still be utilized with the harness 14 and one or more connecting straps 14*a*-14*b* to use as a backpack and/or sled.

External Compartment 30

The training bag 100 can be adaptable for speed, strength training and recovery exercises. Additionally, the apparatus can also be utilized as a backpack for training or leisure usage.

In some embodiments, one or more external compartments 30 is secured by at least one securing element 2 and/or fastener 6 such as a zipper 6*a* for opening as depicted in FIG. 11*a*-11*b*.

In some embodiments, one or more external compartments 30 can be located at the rear of the durable surface 11 in which is opened by a fastener 6 to add or remove objects as depicted in FIG. 11*c*.

In some instances, one or more external compartments 30 can be utilized with speed or strength training components such as a detachable durable surface 27 which will be elaborated in the upcoming embodiments.

In some embodiments, the interior of one or more external compartments 30 around the external surface area 11*a* and/or periphery 11*b* of the training bag 100 can comprise of one or more layers of compressed lining 16 such as foam with or without water-proof coating such as PVC and/or PU coating to prevent any damage when utilizing the training bag 100 for leisure activities such as a school backpack. Additionally, this allows expansion when a user would utilize the training bag 100 for large objects.

In some embodiments, one or more external compartments 30 can comprise of a fastener 6 such as a hook and loop fastener 5 on the top, bottom and/or side which allows the user to conveniently place small or large objects without damage to the enclosure of an external compartment 30.

In some embodiments, the external compartment 30 can comprise of one or more openings with a separate fastener 6 to release one or more backpack straps 28 which will be further elaborated in examples. The user can detach at least one opening for components such as backpack straps 28 to utilize regular backpack and/or weighted vest.

In some embodiments, the external compartment 30 can be manufactured to end mid-way around the periphery 11*b* of the training bag 100 (not shown) and in some instances, the external compartment 30 can partially open with a similar visual as the main training bag 100 portion, open configuration 101 to conveniently add or remove objects.

In some instances, one or more external compartment 30 can be located on the periphery 11*b* of the training bag 100 for additional support and comfort when utilizing the training bag 100 as a backpack. For example, one or more external compartment 30 can comprise of similar functions and working parts as the top and/or bottom to release objects such as a waist belt 34 and/or side backpack strap. A user can conveniently release one or more side panels of a backpack strap without causing damage when utilizing the training bag 100 as a sled component.

In some embodiments, one or more loops 4 is secured by one or more securing elements 2 on the circumference and/or periphery 11*b* of the training bag 100 to attach separate backpack straps 28 which can conveniently be removed at a face pace. For example, the durable surface 11 is proximal to the external compartment 30 which is distal in which one or more loops 4 are located on the periphery 11*b* of the training bag 100.

In some embodiments, the external surface 11*a* can comprise of similar and/or same securing devices such as adjustable weight strap 19 in the enclosure 101 (not shown) to hold multiple objects in place without damage. For example, a detachable durable surface 27 can be placed into the external compartment 30 and secure by one or more adjustable weight straps 19 while a weighted metal plate is secured in another section, opposite to the detachable durable surface 27.

In some embodiments, the user has the option to place one or more weighted metal plates into the external compartment 30 for additional resistances. This may be convenient when retailing as the training bag 100 side may not be expanded when filler weights 20 are secured in the enclosure 101. Also, this may be convenient when travelling to stow away laptops and/or similar objects.

It is to be understood one or more external compartments 30 can comprise of a separate compartment and/or an opening into the main body portion of the training bag 100 in the closed bag configuration. For example, one or more fasteners 6 comprising of a zipper 6*a* and/or hook can loop fastener 5 can comprise of a separate opening adjacent to the main portion to the open bag configuration 101. For example, in some embodiments, an external compartment 30 is distal to the durable surface 11 and in some instances, an external compartment 30 is proximal to the durable surface 11. It is to be understood one or more external compartments 30 are located on the circumference periphery 11*b* of the training bag 100 in the closed configuration.

It is to be understood the various elements of a training bag 100 can comprise of features related to speed and strength training and/or leisure activities. For example, a combination for both speed and strength exercises and also to be utilized as a leisure backpack, a compartment can be manufactured with minimal opening in which will prevent any damage when utilize the training bag 100 as a slam bag or sled. In some instances, there may be a slight elevation for speed and strength and to be utilized as a backpack. In other instances, no elevation can be viewed as the durable surface 11 is strictly for dragging with no compartments.

Example: External Compartment 30

Current exercise bags on the market are limited with functionality and versatility with limited to no accessories to use with the training bag 100 components to slam, carry, drag as a whole system and/or individually.

The training bag 100 comprises of an external compartment 30 for objects such as a detachable durable surface 27, backpack straps 28, harness 14 and components (connecting strap 14*a* variation connecting strap 14*b*, front kit 14*c*, side kit 14*d* training bag cover, rescue basket 32, not limiting to similar and/or unrelated objects.

A user can open the external compartment 30 by releasing a fastener 6 such as a zipper 6*a* and/or buckle which allows passage for objects previously mentioned.

During push and pull exercises without the training bag 100 a user can open the external compartment 30 by releasing one or more fasteners 6, remove the object such as detachable draggable surface 27 and perform exercises strictly with the detachable durable surface 11. This is convenient for personal trainers conducting boot camps. A trainer can conduct more than one station for speed or strength exercises, utilizing a detachable durable surface 27 and the training bag 100 as two separate components.

In some instances, at least one backpack strap 28 can be removed from one or more openings of the external compartment 30. For example, at least one backpack strap can be deposited and a user can wear the training bag 100 as a backpack on one shoulder. It is to be understood the slight opening previously described will not have any damage due to the securing elements 2.

During fast pace exercises such as utilizing the training bag 100 as a dragging tool, a user can attach on one or more hooks 18 onto one or more grips 1 to drag the training bag 100. The securing elements 2 around the grips provide an additional securing element.

Transition Between a Closed Bag 100 to Open Bag Configuration 100

As previously depicted in FIG. 4, the transition steps from a closed bag 100 to open bag 101 configuration.

FIG. 4 further illustrates a visual for the transition from a closed to open bag configuration. For example, FIG. 4*a* illustrates the front perspective view of the training bag 100 and FIG. 4*b* illustrates an external fastener fold over 7 detached, followed by FIG. 4*c* depicting the fastener 6 extending from the top external surface to a periphery surface, more particularly a zipper 6*a* comprising of a first component and a second component, on the external surface 11*a* of the training bag 100 followed by FIG. 4*d* which is the released by unzipping the first component and the second component of the zipper for the transition to the closed bag 100 to open bag 101 configuration.

In some embodiments, at least one fastener 6 such as a zipper 6*a* and/or hook and loop fastener 5, not limited to similar fasteners 6 can be secured to the external surface area 11*a* of the training bag 100 in a closed bag 100 configuration for transition to an open bag 101 configuration.

The starting point can start either on one end or another as previously illustrated in FIG. 4*c*. For example, a zipper can comprise two zipper heads which creates convivence to open and close a training bag 100.

In some instances, the training bag 100 can comprise of one zipper head with a pulling end fabric to secure all weight inside. For example, the training bag 100 can comprise one or more filler weights with fillable minerals such as sand and/or water. To prevent any possible leakage, one zipper head with a fabric ending may be beneficial to manufacture before retailing.

In some embodiments, a zipper can comprise of an external fastener fold-over 7 to prevent damage to the zipper thread during physical activities. For example, when zipping up one end, the fabric can fold over during the close bag 100 to open bag 101 configuration.

It is to be understood the external fastener fold over 7 can comprise of the selected from textiles such as nylon, canvas, hook and loop fastener, and similar fabrics in combination thereof. Additionally, prior to manufacturing, a user can request a training bag 100 to be utilized in an outdoor setting which will then comprise of at least one layer of a water proof coating such as PVC and/or PU coating but not limiting to similar textiles.

In some instances, a cosmetic feature for the training bag 100 can be retailed in various colors. For example, the training bag 100 can comprise of black fabric and the external fastener fold-over can also comprise black fabric which will cause minimal to no vision of a zipper.

In some instances, a user can request customized colors of the training bag 100 and working parts.

In some embodiments, a zipper can be manufactured without a fabric fold which depends on the usage. For example, if a user will utilize the training bag 100 strictly indoors, a fabric fold-over may not be required which can also minimize cost.

In some embodiments, a fabric fold-over may comprise of at least one layer of a hook and loop fastener 5 to secure In some embodiments, the training bag 100 can comprise of one or more zippers around the surface area and/or perimeter and/or periphery to completely open and remove (not shown) for activities in the enclosure.

In some embodiments, a fastener such as a zipper can further comprise of an additional securing element such as at least one layer of a hook and loop fastener. This reassures the user all minerals such as sand and/or water will not deposit when using the training bag 100 as a slam bag and/or for other physical activities.

It is to be understood, that the hook side of a hook and loop fastener 5 may be flat on the external surface 11*a* of the training bag 100 while the loop is on the fold over to secure over top of the zipper. However, prior to manufacturing, the user can request the loop of the hook side of a hook, and the loop fastener may be flat on the external surface 11*a* of the training bag 100 while a hook 18 is on the fold over to secure over top of the zipper 6*a*.

In some embodiments, at least one layer of a hook and loop fastener 5 can further comprise of at least one layer of PVC and/or PU coating to reassure the user the training bag 100 will comprise of durability in an indoors and/or outdoors setting.

In some embodiments, one-half of the training bag 100 can comprise of one or more compartments to hold objects related or unrelated to the apparatus and functionalities such as coins, electronic devices, and water bottles.

In some embodiments, a training bag 100 can comprise of a zipper 6*a* without additional fasteners, as illustrated in FIG. 4*c*. A user is provided with the option to choose the type of training bag 100 for physical activities. For example, a user can purchase a training bag 100 for activities strictly for a leisure bag without hard impact slams and/or dragging exercises. This is convenient and more sustainable to have multiple options prior to retailing.

In some instances, the external fastener fold over 7 and zipper 6*a* can be viewed in a C shaped, more particularly mid-way distal end to the training bag 100. It is to be understood the external fastener fold over 7 and zipper 6*a* can be manufactured on a proximal and/or distal end, horizontal, vertical on the external surface. Additionally, the user can request prior to manufacturing the external fastener fold over 7 and zipper 6*a* to be secured around the periphery mid-way and/or completely around the training bag 100 to detach as two separate panels (not shown). For example, the external surface 11*a* can completely detach from the rear, more particular the durable surface panel for cleaning, not limiting to other intended purposes.

Enclosure 101 and Internal Surface 12

In some embodiments, the enclosure is interpreted as the internal surface 12 of the open bag configuration 101.

In some embodiments, during the transition from a closed bag 100 configuration to an open bag 101 configuration, the periphery of the internal surface 12 can comprise of bounding flaps which is also interpreted as internal fold over 13 when in the open configuration, as depicted in US Parent U.S. Pat. No. 10,561,886 B2 to secure all minerals, such as sand.

Previously illustrated in US Parent U.S. Pat. No. 10,561,886 B2, the internal fold over 13 is in an upright position to hold sand and/or other objects. This current apparatus is an improvement by adding one or more securing elements, fixed and removable loops 4, adjustable weight straps 19 which will be further elaborated in the upcoming embodiments.

It is to be understood the bounding flap element in previous parent patent is now considered as the similar and/or same internal fold over 13.

It is to be understood the periphery of the external surface 11*a* of the training bag 100 is the same structure of the enclosure internal fold over 13.

In some instances, one or more adjustable weight strap can comprise of various fasteners such as adjustable working strap, hooks, loops and previous securing elements described.

Figure 16:
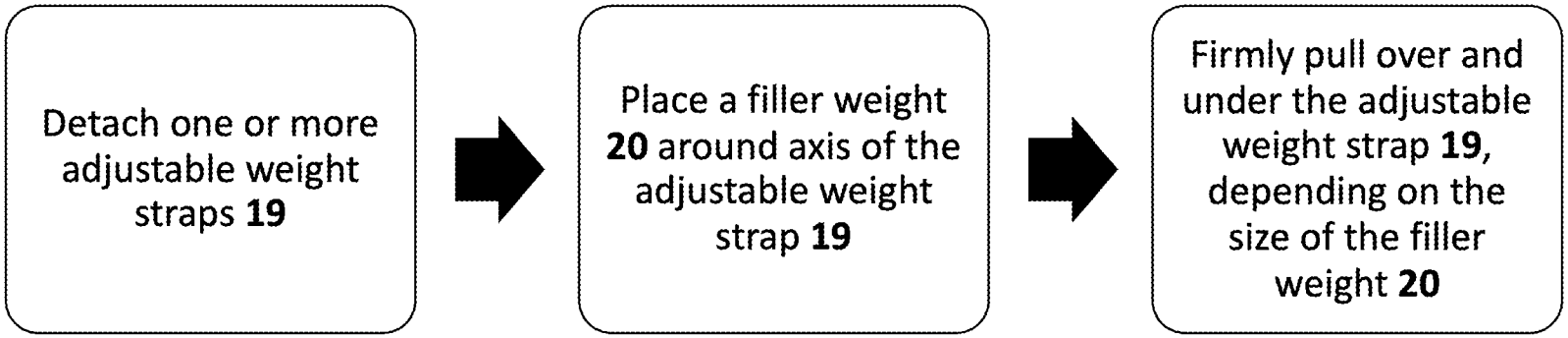
FIG. 16 is the preferred method for a transition to an alternative to secure filler weights in the enclosure.

FIG. 16 illustrates a preferred method to place one or more filler weights 20 in the enclosure 101 followed by an adjustable weight strap 19 to fold on top which will be further elaborated in embodiments and illustrations.

In some embodiments, a fixed loop with the similar and/or same structure of the external surface 11*a* and periphery loops 4 of the training bag 100 can be secured by one or more securing elements 2 on the internal surface 12 as depicted in FIG. 17*b*.

In some embodiments, a fixed adjustable working strap 17 with the similar and/or same structure of the external surface 11*a* and periphery adjustable working straps 17 of the training bag 100 can be secured by one or more securing elements 2 on the internal surface.

In some embodiments, at least one fabric layer in the enclosure 101 can further comprise of adhesive to secure the training bag 100 exterior fabric with the enclosure fabric. In some instances, a securing element 2 such as binding and/or nylon threading can be seen around the enclosure 101 which overlaps from the exterior and interior fabric.

In some embodiments, one or more loops 4 and/or adjustable working straps 17 can be located at the bottom corner internal surface 12, proximal end and/or distal end adjacent to one another, transverse in an alternating patter for a removable adjustable weight strap 19 and/or fixed securing elements 2 which will be further elaborated in the upcoming embodiments.

In some embodiments, the internal surface 12 can comprise of the outer layer of the external surface 11*a* of the training bag 100 in the closed configuration with or without waterproof coating selected from chlorosulfonated polyethylene (CSPE) synthetic rubber (CSM), polyvinyl chloride (PVC), and/or with a mixture of polyurethane (PU), PVC tarpaulin combination thereof. For example, the durable surface 11 of the external surface 11*a* of the training bag 100 can comprise of rubber which will contain the same layer as the internal surface 12 of the open bag configuration 101.

Adjustable Weight Strap 19

Figure 14:
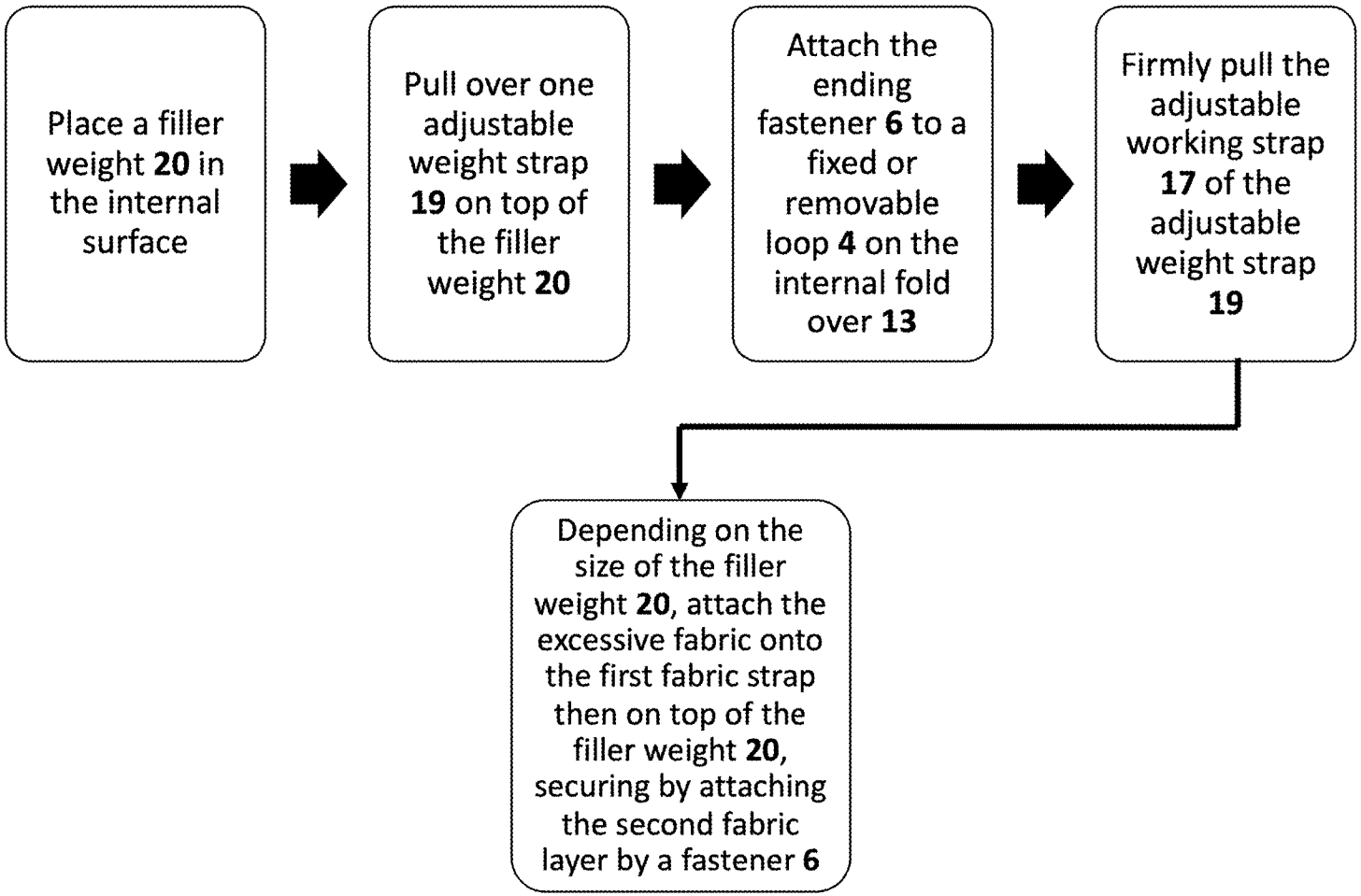
FIG. 14 is the preferred method for a filler weight secured in the internal surface secured by an adjustable weight strap.

FIG. 14 illustrates the appropriate method to place a filler weight 20 onto one adjustable weight strap 19. It is to be understood filler weights is not required and other objects can be utilized as weights in the enclosure 101.

Figures 15, 15A, 15B, 15C, 15D, 15E, 15F:
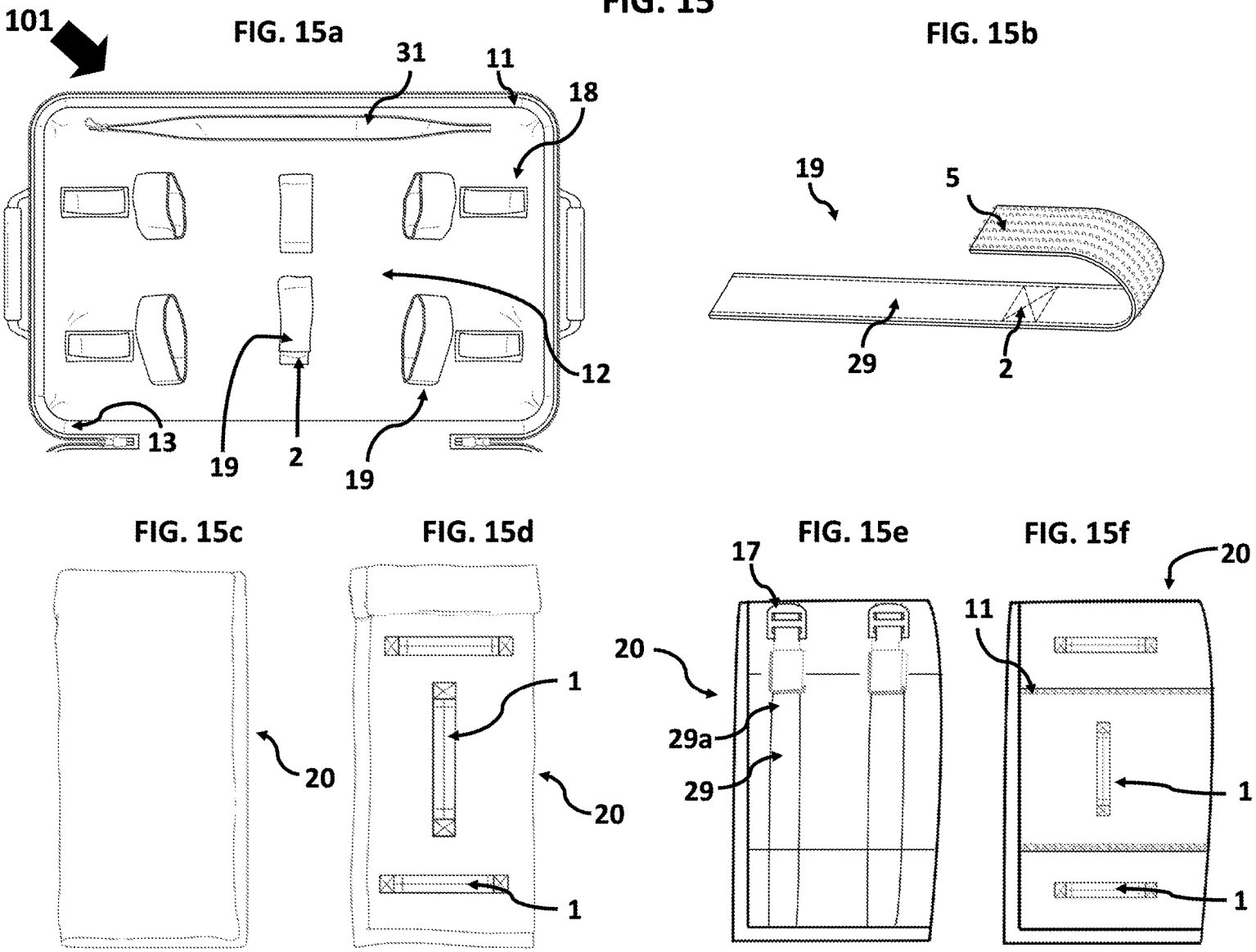
FIG. 15 is a front top perspective view of a training bag with components, more specifically
FIG. 15*a* illustrates a top view of the training bag in an open bag configuration with a portion of a fastener extending from an outer surface of a top external surface disengaged with the periphery surface revealing an internal surface and half of the enclosure comprising of ten adjustable weight straps with no weights.
FIG. 15*b* illustrates a detached adjustable weight strap.
FIG. 15*c* illustrates a front perspective view of a filler weight.
FIG. 15*d* illustrates a rear perspective view of a filler weight comprising of three grips.
FIG. 15*e* illustrates a front perspective view of a filler weight comprising of two adjustable working straps and FIG. 15*f* illustrates a rear perspective view of a filler weight comprising of three grips.

FIG. 15*a* illustrates the training bag 100 in an open bag 101 configuration further comprising of adjustable weight straps 19 in direction of vertically and lateral on one or more loops on one or more periphery internal fold over 13.

It is to be understood one or more fixed adjustable weight straps 19 can be fixed on top, mid-point and/or at the bottom of the internal fold 12 over which is then horizontal and/or vertical to the opposite end of the internal fold over 12.

The enclosure can be viewed as multiple fixed and/or removable adjustable weight straps 19 in different directions such as, horizontal, vertical, proximal end, distal end in combination thereof.

It is to be understood the training bag 100 can comprise of at least one fixed adjustable weight strap 19 and/or one removable adjustable weight strap 19 as illustrated in FIG. 15*b*, depending on the usage of the training bag 100. For example, a user can request to secure all objects in place which will further comprise of more than one adjustable weight strap 19.

In some instances, a training bag 100 can comprise of water and/or similar liquids to use for weight which will not require adjustable weight straps 19.

In some embodiments, at least one adjustable weight strap 19 can be fixed on one end of the internal fold over 13 loop 4 in the enclosure 101 which the other end of the internal fold over 13 can be loose to secure one or more weights in place.

For example, a user can place and secure a large filler weight 20 in the enclosure 101 and another filler weight 20 which dimension is smaller. The adjustable weight straps 19 can conveniently adjust to the appropriate weight.

In some embodiments, at least one adjustable weight strap 19 can comprise of one or more fasteners 6 selected from hook and loop fasteners with a waterproof coating such as PVC and/or PU in combination thereof.

FIG. 16 illustrates another optional transition to securing a filler weight 20 onto one or more various adjustable weight satraps 19. It is to be understood there can be more than one filler weight 20 secured by one or more adjustable weight straps 20. In some instances, an adjustable weight strap 19 is not required to secure one or more filler weight 20 and/or other objects as depicted in FIG. 17*a*.

In some instances, at least one adjustable weight strap 19 can be viewed as a shoe adjustable strap that provides similar functions to tighten and/or loosen the fabric, depending on the weight in the enclosure 101.

In some instances, at least one adjustable weight strap 19 can be interpreted as a fabric strap further comprising of at least one layer of the fabric selected from nylon, canvas, polyester, Cordura, and/or rubber, one or more layers of the waterproof coating such as PVC and/or PU coating in combination thereof.

In some embodiments, the layer of the training bag 100 enclosure can comprise of thin fabric such as polyester, not limiting to similar fabrics which also may comprise of at least one layer of PVC and/or PU coating to maintain the flexibility of the training bag 100.

It is to be understood the ending point of one or more internal fold over 13 is to secure one or more weights in the enclosure comprising of other securing devices such as plastic and/or metal hooks 18, buttons, clips and/or buckles from one ending point to the other.

In some embodiments, a filler weight 20 can be viewed with at least one ending of one adjustable weight strap 19 wrapped under and/or over top to the opposite ending to securely hold the filler weight 20 in place.

It is to be understood the preferred adjustable weight straps 19 are not mandatory and a user can secure a filler weight 20 without wrapping over and/or under as previously depicted in FIG. 17*a*.

In some embodiments, at least one adjustable weight strap 19 can be secured horizontally and/or vertically which is determined of the usage of the training bag 100. For example, a user can request a larger training bag 100 with will then require an additional adjustable weight strap 19 on either end of the internal fold over 13 as depicted in FIG. 17*b*.

In some embodiments, an adjustable weight strap 19 can comprise of one starting point on the bottom vertical to the top vertically of one or more internal fold over 13 loops 4 and vice versa as previously depicted in FIG. 17*b*.

In some embodiments, an adjustable weight strap 19 can comprise of one starting point on the bottom horizontally to the top horizontally of one or more internal fold over 13 loops 4 and vice versa.

In some embodiments, an adjustable weight strap 19 can comprise of one starting point on the bottom vertically to the top horizontally of one or more internal fold over 13 loops 4 and vice versa.

In some embodiments, a loop 4 can comprise of one or more layers of a securing element 2 such as woven tape on one endpoint of the training bag 100 in an open configuration 101 to the other which is then looped around by a hook and loop fastener 5 then folded over to secure one or more weights in the enclosure.

In some embodiments, the axis of at least one securing element 2 of an adjustable weight strap 19 can swivel to accommodate to the objects placed in the enclosure. For example, prior to manufacturing, a user can request two large adjustable working straps 17 from one end to another to strictly carry metal weighted plates. This would also allow the user to place objects that may be constructed in different angles.

In some embodiments, a fixed and/or removable adjustable weight strap 19 can comprise a fastener 6, such as a hook 18 and/or adjustable working strap 17 on one ending point from another, configured for other intended purposes with or without the training bag 100 components.

It is to be understood the enclosure bag configuration 101 can comprise of one or more fixed and/or removable adjustable weight strap 19 in different directions from other adjustable weight straps 19.

It is to be understood the adjustable weight straps 19 can comprise of the similar and/or same structure for fasteners 6 selected from adjustable working strap 17, fasteners 6, hook and loop fasteners 5, buckles, hooks, zip ties, buttons, zippers, clips, fixed and removable rods in combination thereof, located on the periphery and external surface of the training bag 100 in a closed configuration.

In some embodiments, one layer of the adjustable working strap 17 can comprise of one side of a hook and loop fastener 5 with an ending point of a fastener 6 such as a hook and/or similar securing devices previously mentioned with the components of the training bag 100. The second fabric strap can comprise of a hook and loop fastener 5, which can then pass through the loop 4 on the internal fold over, then wrapped around onto the top of the filler weight, followed by attaching onto the first fabric layer of the adjustable weight strap 19.

The user can request the adjustable weight strap 19 to comprise of other fasteners 6 such as adjustable working straps 17 and/or buckles 6 in substitute of a hook and loop fastener 5. The intended purpose is to secure all weights in the internal surface with minimal to no movement.

In some instances, one or more adjustable weight straps 19 can be secured to the bottom of the internal fold over 13, to fold over smaller objects such as metal plates with minimal to no movement. This allows the user to have multiple options to add weight in the internal surface 12 with no damage.

As previously elaborated, the user is required to choose from a listing of options, depending on the usage of the training bag 100. For example, a user can utilize the training bag 100 as a travel bag. Adjustable weight straps 19 will not be necessary which is more economical during manufacturing and when retailing. Also, the internal surface 12 can be viewed as regular suitcase straps with fasteners and/or adjustable working straps 17 and/or hooks 18 to secure objects in place with minimal to no movement. For example, a user carrying clothes can attach one or more adjustable working straps 17 and/or hooks 18 to one ending point of the training bag 100 internal enclosure to secure all clothes in place. Also, the user can conveniently utilize one or more adjustable weight straps 19 with a hook to fold over and/or under and/or in between objects to have a divided area.

Example: Adjustable Weight Strap 19

The training bag 100 is designed to be a multi-functional exercise tool designed for beginners to advanced users. To carry the training bag 100 with minimal weight, a user can attach one or more adjustable weight straps 19 on either corner of the training bag 100 enclosure, more specifically near the internal fold over 13 with no filler weights 20 in the mid-section of the enclosure of the training bag 100. A user can then place the training bag 100 near the neck and grasp the periphery grips of the training bag 100 for exercises such as squats and lunges. This allows the user to have the flexibility of the training bag 100, more specifically the durable surface 11 side which will decrease stress on the neck. Other exercise bags on the market strictly has one weight across the entire bag without any adjustable weight straps.

To load up the training bag 100, two larger filler weights 20 can be secured in the training bag 100, more specifically the two mid adjustable weight straps 19 then added in two smaller size filler weights 20 onto the outer adjustable weight straps 19 near the internal fold over 13. This distributes the weight evenly around the enclosure of the training bag 100. Additionally, a more advanced user can stack one or more filler weights 20 on top and/or bilateral to increase the weight. The training bag 100 can expand and/or decrease in size in respect to the adjustable working straps 19 on the periphery 11*b* and/or external surface 11*a* of the training bag 100.

Filler Weight 20

Figure 18:
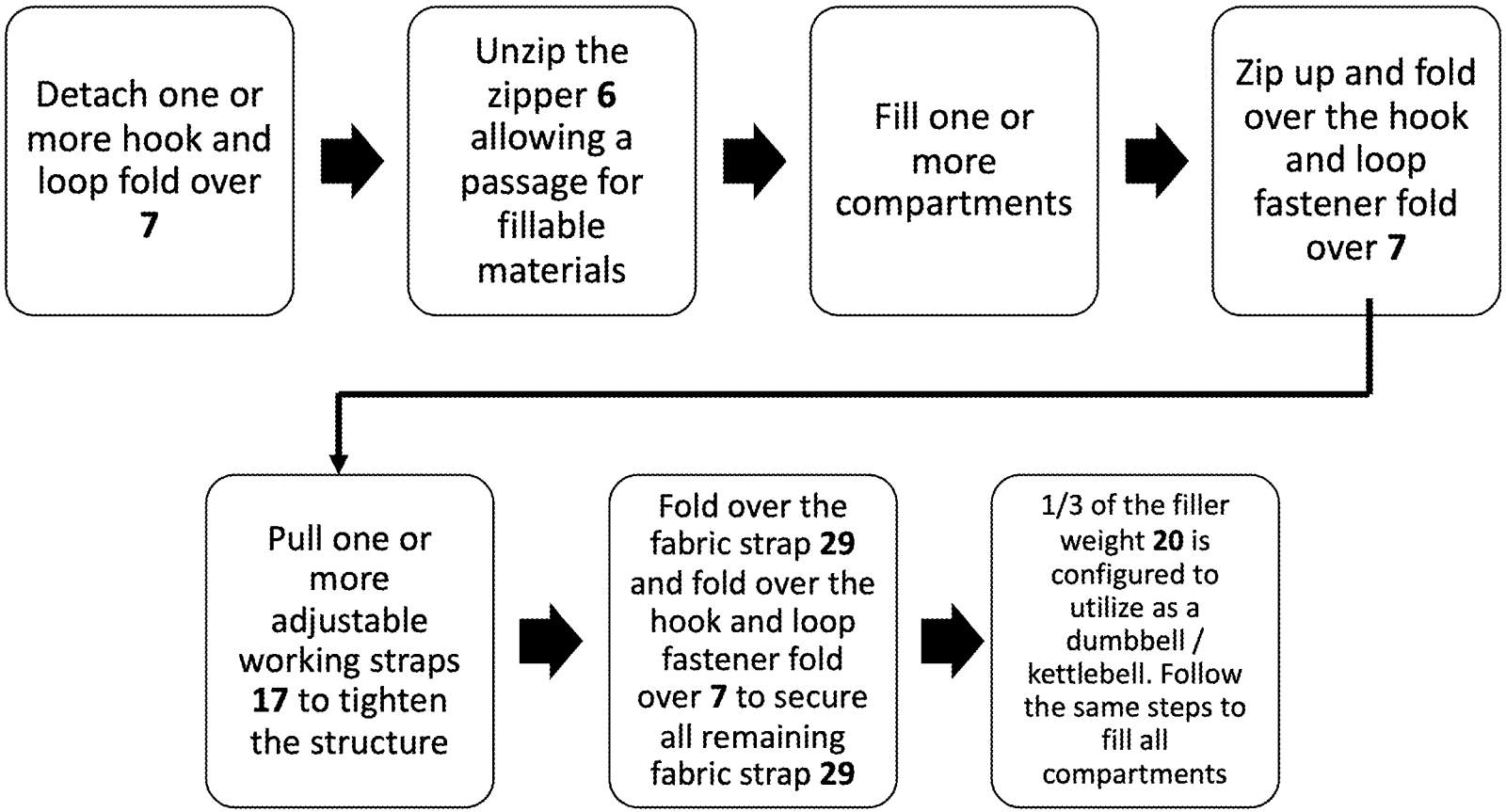
FIG. 18 is the preferred transition to filler one or more compartments of a filler weight.

FIG. 18 illustrated the preferred method to fill a filler weight 20 however, it is to be understood the method is a preferred method and not required.

In some embodiments, the filler weight is closed using one or more hook and loop fasteners 5, and in some embodiments the filler weights 20 include a grip 1 or other gripping surface to be used in lifting them in and out of the training bag 100. Also, this can be an addition for exercises such as bicep curls, shoulder flexion, extension, substitution of a kettlebell swing, to name a few.

In some embodiments, one or more filler weights 20 may comprise of a mixture of minerals and/or textile such as Nylon, polyester, canvas with a coating of polyvinyl chloride and/or polyurethane to hold the minerals in the enclosure. It is to be understood each filler weight 20 can various number of pounds. For example, soil can be contained in the enclosure halfway with moisture, resulting in the weight having a larger amount of density compared to a filler weight 20 with regular beach sand halfway weighing in a decreased quantity of weight. Additionally, the interior of one or more filler weights 20 may comprise polyvinyl chloride (PVC)

and/or with a mixture of polyurethane (PU) to allow such minerals such as saltwater to remain in the enclosure, eliminating the likely hood of fabric damage over time.

Depending on the usage of the filler weight 20, it may be convenient to manufacture one or more layers around the surface area and perimeter of one or more filler weight 20 with a mixture of minerals and/or Nylon, vinyl, linen, cotton, canvas, polyester, or microfiber with one or more waterproof coatings selected from the group of polyvinyl chloride and/or wherein specific machinery can be used.

In some embodiments, a filler weight 20 may comprise of one or more MOLLE attachments around the surface area to be used as a cosmetic appearance and/or for optional attachments related with or without the usage of the training bag 100 and accessories.

In some instances, individual environmentalists and organizations can request customized fabrics and/or minerals prior to manufacturing. For example, a mixture of minerals can comprise of current fabrics that are unused and/or used recycled materials such as glass, paper, cardboard, metal, plastic, tires, rubber, and metal.

In some embodiments, one or more MOLLE attachments comprise of at least one layer of woven tape 3 with optional textile mineral mixture with one or more securing elements to hold the structure and for weighted objects to increase additional weight for exercises with or without the training bag 100 and accessories.

In some embodiments, the filler weight 20 can be formed of semi-ridged material forming rectangular shapes to allow the filler weights 20 to be more easily stacked on top of each other and/or bilaterally within the training bag 100 for optimized storage and to allow a user to maximize the weight of the training bag 100 when used as a weight. Although in other embodiments the filler weight 20 can be made of a the flexible material and can still be able to be stacked on top of each other and/or bilaterally.

The filler weight 20 can be supplied with sand and/or minerals, or a user can be required to fill the filler weight 20 themselves. The filler weight 20 can be designed to allow sand to be neatly contained when not needed, such as to not mix loosely with other contents of the training bag 100.

It is to be understood one or more filler weights 20 may be retailed with or without minerals fixed in a filler weight 20 with no visual opening. This will be more convenient for a user when a local beach or store is not within distance. Also, it may be convenient to retail the filler weight 20 with a compound fixed in the enclosure of the filler weight 20 for additional weight.

It is to be understood at least one filler weight 20 can be used as a weight with or without the training bag 100.

In some embodiments, at least one fastener 6 around the perimeter of the training bag 100, may have a coating of polyvinyl chloride (PVC) and/or a mixture of polyurethane (PU) to prevent rusting if any minerals are in contact with one or more fasteners 6.

Figure 19:
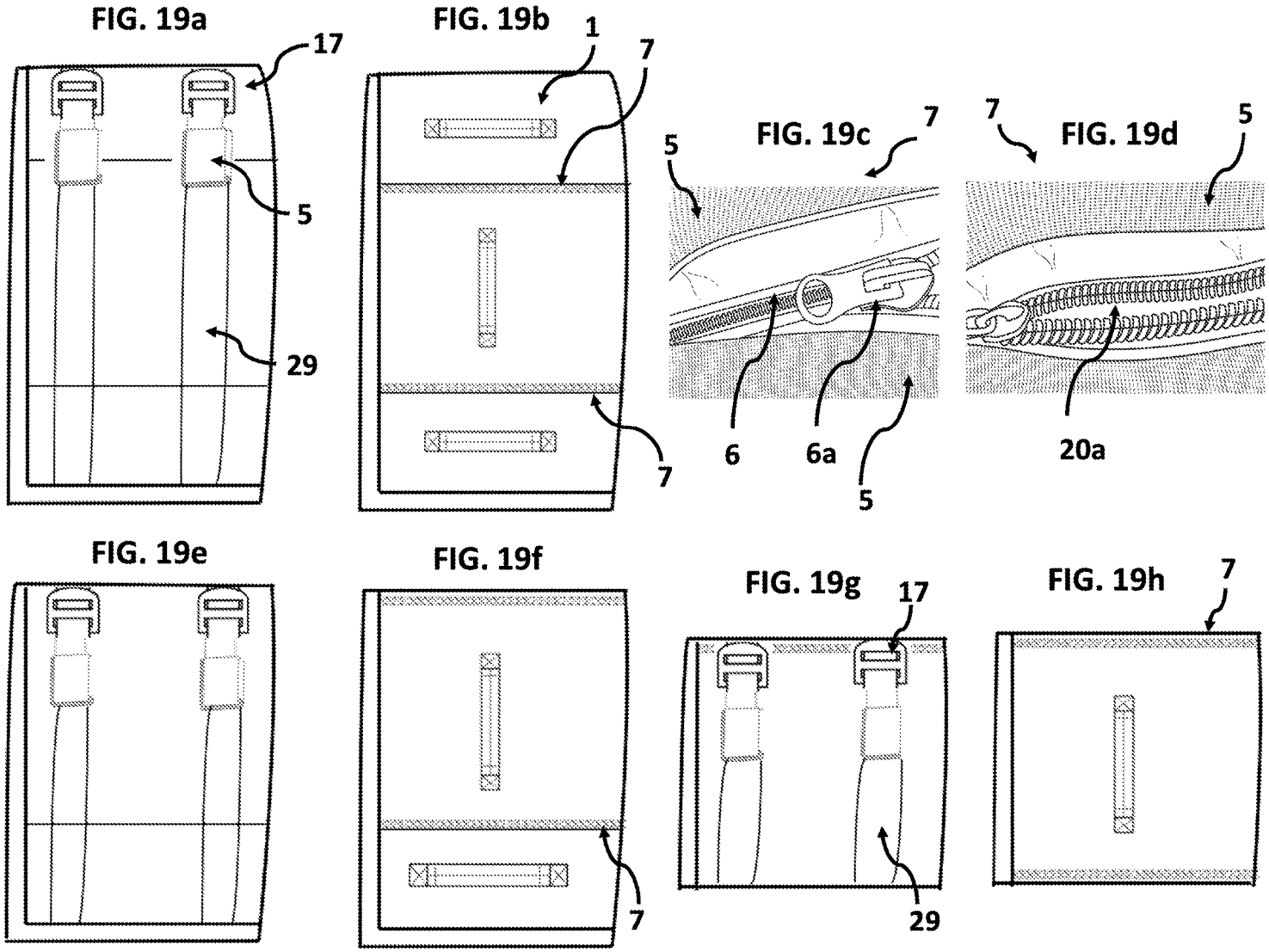
FIG. 19 is a perspective view of filler weights with working parts, more specifically

In some embodiments, a filler weight 20 can comprise of one or more grips 1 secured by one or more securing elements 2 on the external surface as depicted in FIGS. 19*b*, 19*f* and 19*h*. In some instances, one or more grips can be viewed as the same and/or similar structure of a grip 1 on the training bag 100. In some instances, one or more grips 1 can be in different directions for exercises targeting specific muscle groups which will be further elaborated in examples.

In some embodiments, the ending of the fabric is attached to the front and rear external surface to use as a kettlebell, which will be further elaborated in examples.

In some embodiments, a filler weight 20 can be viewed as a cylinder shape and in some embodiments, one or more filler weights 20 can be viewed as a square and/or rectangular shape.

In some embodiments, a filler weight 20 can comprise of one or more fasteners 6 such as a hook and loop fastener 5 on the external surface secured by at least one securing element 2.

In some embodiments, a user can request additional securing element such as one or more layers of a hook and loop fastener 5 to fold over top the zipper 6*a* to protect all fillable weights in the enclosure.

It is to be understood a filler weight 20 can comprise of an invisible zipper 6*a* secured by one or more securing elements 2 and waterproof coating selected of: rubber, latex, petroleum and/or similar minerals with at least one layer of waterproof coating, chlorosulfonated polyethylene (CSPE) synthetic rubber (CSM), polyvinyl chloride (PVC) and/or with a mixture of polyurethane (PU), PVC tarpaulin, materials metals, aluminum, silver, copper and alloys secured by one or more layers of adhesive and stitching on and around the periphery, internal and/or external in combination thereof.

In some embodiments, a filler weight 20 can comprise of at least one layer of hook and loop fastener 5 as the first securable fastener in the enclosure.

In some embodiments, a filler weight 20 can divide and fold more than one to adjust the selected weight. For example, a user can select 10 LBS of a 30 LBS filler weight 20. The user would then fold over one or more dividers as illustrated in FIG. 19*e*-19*f*, configured to secure the dividers by one or more fasteners such as a zipper 6*a* and/or hook and loop fastener 5. This allows the user to 10 LBS in the middle as depicted in FIG. 19*g*-19*h*. It is to be understood fillable weight can vary from weight and/or sizes which does not limit to specific weight and/or size.

It is to be understood a filler weight 20 can comprise of more than one divider which is further comprising of a securing element 2. This will be convenient to retail with endless amounts of sizes for a user to choose for the desired exercise goal.

In some embodiments, the periphery and/or external surface can comprise of the similar structure of the adjustable working strap 17 located on the training bag 100 to tighten and/or loosen the filler weight 20 to decrease in size. Additionally, a filler weight 20 can comprise of a loop on one end around the external surface and/or periphery of the filler weight 20 which is then looped around with a fastener 6 such as a hook and a loop fastener 5, which is then folded at least one by one or more dividers which are then viewed as an adjustable ankle weight.

In some instances, one or more grips 1 can be secured by one or more securing elements 2 on the front and back external surface which allow the user to utilize the filler weight 20 like a dumbbell and/or kettlebell when folding the filler weight 20 more than once.

In some embodiments, a filler weight 20 can comprise of one or more grips 1 with a securing element 2 that has increased fabric length for a user to utilize as an ankle weight which will be further elaborated in examples.

In some embodiments, one or more finger straps, viewed as similar shapes to boxing pads can be secured by one or more securing elements on the periphery and external surface for an option on how to lift the filler weight 20.

It is to be understood a filler weight 20 can be utilized as the training bag 100 but in a smaller fashion.

Example: Filler Weight 20

To add fillable materials in the filler weight 20, a user can detach the hook and loop fastener 5, unzip the zipper and detach the hook and loop fastener 5 in the internal enclosure of the filler weight 20.

A user can conveniently target different muscle groups during push and pull exercises, such as shoulder flexion previously depicted in FIG. 1*e*. For example, a kettlebell swing requires a hip hinge with the kettlebell in front with both hands over one another. In this scenario, the kettlebell is a filler weight 20 and the middle grip is utilized.

During the front squat to push press, a user can grasp the horizontal grips 1 to evenly distribute the weight in between the center of gravity. A dumbbell and/or kettlebell increase the likely hood of hyperextension in the wrist which can also cause injuries to the lower body as the focus will be on the wrist.

During boot camps, multiple free weights such as dumbbells, kettlebells, and ankle weights are required for strength and endurance workouts. Personal trainers can utilize the filler weight 20 which folds at least once and can conveniently fit in a pants pocket. To add weight, a user can detach the hook and loop fastener 5, unzip the invisible fastener 6, detach the internal hook and loop fastener 5 and fill the filler weight 20 with minerals selected from sand, water, soil, rocks, marbles, pea gravel, compound in combination thereof. For a beginner's boot camp, the user can either fold the filler weight 20 at least once over the divider followed by securing at least one adjustable working strap 17 on the external surface and/or periphery of the filler weight 20. Additionally, prior to folding the filler weight, a user can place the filler weight 20 around the ankle, fold at least once and then secure the adjustable working strap around the external surface and/or periphery of the filler weight 20. Also, the same steps can be followed to utilize as a wrist weight. The opposite side of the external surface of a filler weight 20 can comprise of grips as previously mentioned to either use as an adjustable dumbbell and/or ankle weight which is strictly decided upon the user.

Internal Compartment 31

In some embodiments, one or more internal compartments 31 can configure around the enclosure, secured by a fastener 6 to hold objects related or unrelated to the functions of the training bag 100 enclosure 101. For example, a user can place one or more connecting straps 14*a*-14*b* in the internal compartment 31 to conveniently and neatly stow away when transporting and/or utilizing as a slam bag, not limiting to further physical activities.

In some instances, a user can utilize the training bag 100 as a backpack and to stow away personal belongings such as phones, wallets, and water bottles, not limiting to related or unrelated objects to the training bag 100.

In some embodiments, at least one internal compartment 31 can further comprise of the main enclosure layer on the internal compartment 31 with additional layer on the exterior compartment. For example, the internal compartment 31 can expand and/or loosen depending on the objects held in the compartment.

It is to be understood figures can illustrate internal compartments 31 around the enclosure, more specifically the internal fold over 13 and the opposite side of the training bag 100 durable surface 11, external surface 11*a* and/or periphery 11*b*.

Figures 5, 5A, 5B, 5C:
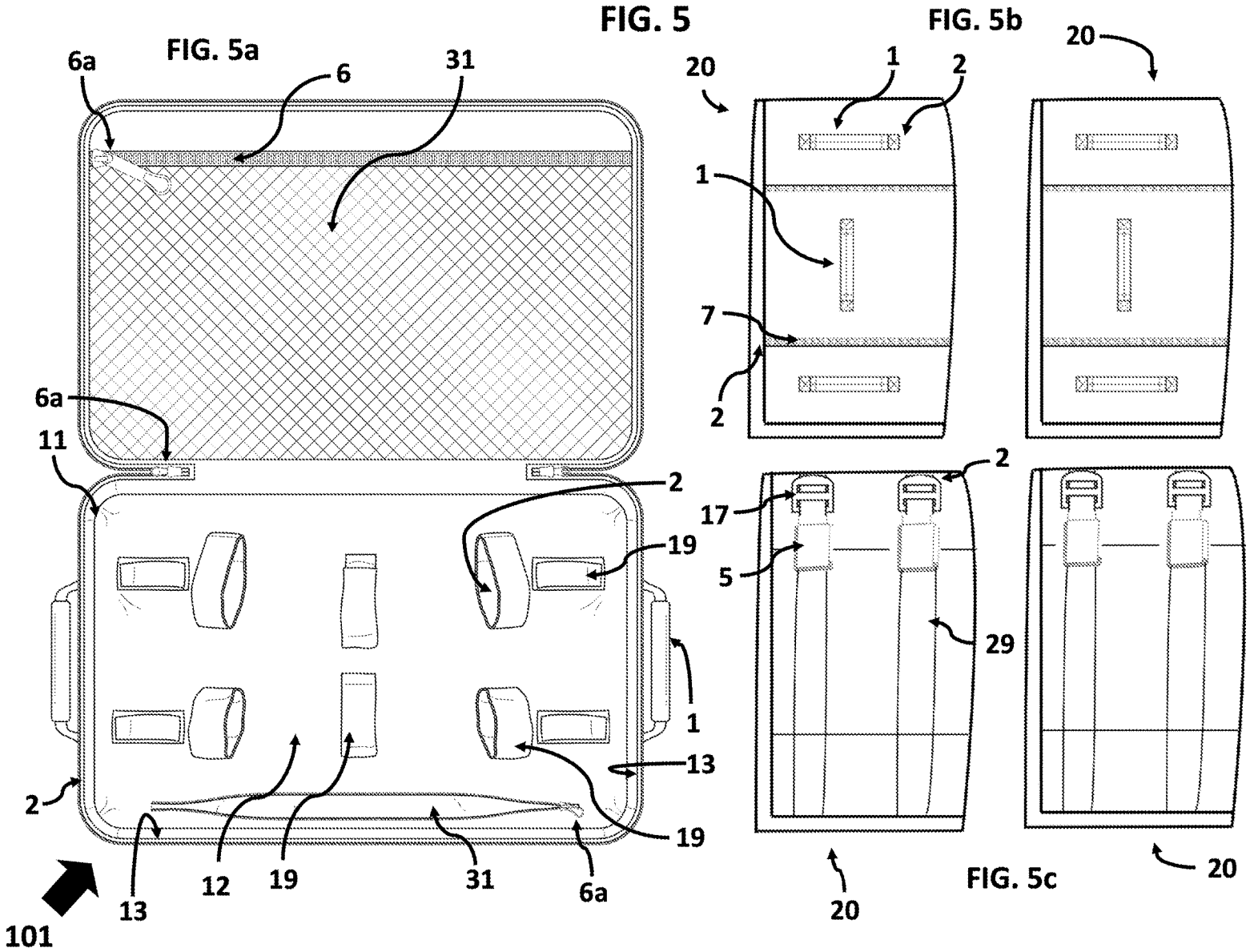
FIG. 5 is a perspective view of a training bag and filler weights, more specifically
FIG. 5*a* illustrates a top perspective view of a portion of the top external surface of the training bag in contact with a ground surface, comprising of two internal compartments in the open configuration.
FIG. 5*b* illustrates two filler weights with three grips on each external surface.
FIG. 5*c* illustrates two filler weights with two adjustable working straps on each external surface.

For example, referring to the previous FIG. 5*a*, an external compartment 31 is located on one side of an internal surface 12 comprising of a fastener 6 and further comprising of a fabric layer such as but not limiting to the training bag 100 fabric.

Another example, referring to the previous FIG. 15*a*, an external compartment 31 is located on the internal fold over 13 comprising of a fastener 6 and further comprising of a fabric layer such as but not limiting to the training bag 100 fabric. As shown on Fig. 5a, the transition between the closed bag configuration and the open bag configuration via the first component and the second component of the fastener extending from the top external surface to the periphery surface, a portion of the top external surface is configured to contact a ground surface, thereby revealing an internal surface of the training bag in the open bag configuration.

It is to be understood one or more internal compartment 31 can further comprise of the selected from compressed lining 16, nylon, canvas, polyester, Cordura, PVC, PU, breathable mesh in combination thereof. One or more internal compartments 31 can comprise of a securing element to open or closed the internal compartment. This presented feature allows the user to stow away objects such as food, gym clothes, and shoes to allow airflow.

In some embodiments, at least one adjustable weight strap 19 can be located on the vertical and/or horizontal side of the training bag 100 enclosure, and in some instances, one internal compartment 31 can utilize the entire enclosure to secure long objects such as a connecting strap 14*a*-14*b*.

In some instances, a zipper 6*a* may have an ending head which further comprises of a fabric loop 4 to easily pull and tighten. The fabric loop can further comprise of at least one layer of nylon and may also comprise of PVC and/or PU coating.

In some embodiments, one or more internal compartment 31 can be located on one surface of the enclosure 101 to strictly secure the training bag 100 accessories such as harness 14, connecting straps 14*a*-14*b*, shoulder straps 15, empty filler weights 20, not limiting to related or unrelated items.

In some embodiments, at least one fastener 6 such as a zipper can be secured around the top surface area of the internal compartment 31 with at least one layer of mesh to hold objects which was previously mentioned.

In some embodiments, a mesh cover can comprise of water-repellent coating such as PVC and/or PU coating, not limiting to similar water-repellent coatings.

In some embodiments, the periphery of the internal compartment can comprise of binding secured by at least one layer of nylon and similar securing elements 2.

In some embodiments, the fastener such as a zipper can comprise of the same elements as the external fastener located on the periphery of the training bag 100. For example, the top stops, elements, woven tape, slider, pull cord, bead, chain, bottom stop and tape end can be reversed which will then be utilized as the internal compartment.

In some embodiments, the mesh cover can expand, depending on the objects being held.

Backpack Straps 28

In some embodiments, one or more backpack straps 28 are released from the external compartment 30 to utilize as a weighted bag exercise and/or a leisure bag.

In some embodiments, one or more backpack straps 28 are released from a periphery 11*b* external surface 11*a* for side panel straps. The side panel straps are designed to support the user's body and to comfortably wear the training bag 100 as a backpack.

FIG. 11*c*-11*d* illustrates the rear side of the training bag 100 with two backpack straps 28 released from the top external compartment 30 as previously mentioned.

It is to be understood "removable backpack strap" can be fixed and secured into the external compartment 30 with one or more securing elements 2 and another backpack strap 28 can be removable which is interpreted as detachable.

In some embodiments, one or more backpack straps 28 can be removable for other intended purposes such as to substitute as a harness 14 when using the training bag 100 as a sled which will be further elaborated on in examples. The training bag 100 novelty feature is to utilize the backpack straps 30 as a harness which can then connect one or more connecting straps 14*a*-14*b* onto one or more loops 4 around the harness 14 followed by attaching the connecting strap 14*a*-14*b* onto the training bag 100. Additionally, the backpack straps 30 can be utilized as bungee cord for carrying the training bag 100 as a weight by one or more grips 1 located around the connecting strap 14*a*-14*b* and in some embodiments is considered as a grip variation connecting strap 25-25*a*.

In some embodiments, one or more backpack straps 28 can comprise of a compartment on one or more layers (not shown) further comprising of a cooling gel to comfortably allow the user to either carry or drag the training bag 100 for a long duration. In some instances, one or more compartments can comprise of the same and/or similar fabrics as the internal and external compartment which was previously described in embodiments.

In some embodiments, one or more backpack straps 28 can comprise of fasteners 6, more specifically a hook and loop fastener 5, further comprising of a fixed and/or removable hook 18 to attach on one or more loops 4 around the periphery 11*b* and/or external surface 11*a* of the training bag 100. For example, a user can request a training bag 100 without any external compartments 30 to utilize the training bag 100 as a dragging device and backpack which then allows the user to attach one or more hooks 18 on one or more loops 4 which is then adjusted by firmly pulling one layer, preferably the top layer comprising of a hook and loop fastener 5 over the bottom layer to firmly adjust the size and/or length.

In some embodiments, the proximal and distal end of one or more backpack straps 28 can comprise of one or more MOLLE attachments and adjustable working strap 17 with a fabric strap 29 to adjust size which then passes throughout the backpack strap 28 ending with a hook and loop fastener 5 to fold over at least once to cover the excess fabric strap 29 from one or more adjustable working straps 17. It is to be understood the bottom of a harness 14 can comprise of similar and/or same features to adjust to the user's body.

In some embodiments, one or more backpack straps 28 can comprise one or more layers of compressed lining 16 with one or more loops 4 around the waist of the periphery of the backpack straps 28 which can be viewed as a similar structure to the harness 14.

In some embodiments, one or more backpack straps 28 can comprise of an elastic in between the fabrics; backpack strap 28 further comprising of a grip 1 to utilize the backpack strap 28 as a sling 23 to carry the training bag 100 overhead by attaching one or more hooks 18 around the external surface 11*a* and/or periphery 11*b* of the training bag 100. For example, this feature can be viewed as a sling 23.

Example: Backpack Straps 28

A user can conveniently release one or more backpack straps 28 from one or more external compartments 30 to utilize as a regular backpack and/or dragging component.

The user can utilize the removable backpack straps 28, attaching one or more connecting straps 14*a*-14*b* around the periphery of the lower waist 34 belt of the backpack straps 28 then connecting one or more hooks 18 on the training bag 100 to use as a sled. This is also viewed as a harness 14 which will be further elaborated in the upcoming embodiments.

Waist Belt 34

Figures 21, 21A, 21B, 21C, 21D, 21E, 21F, 21G:
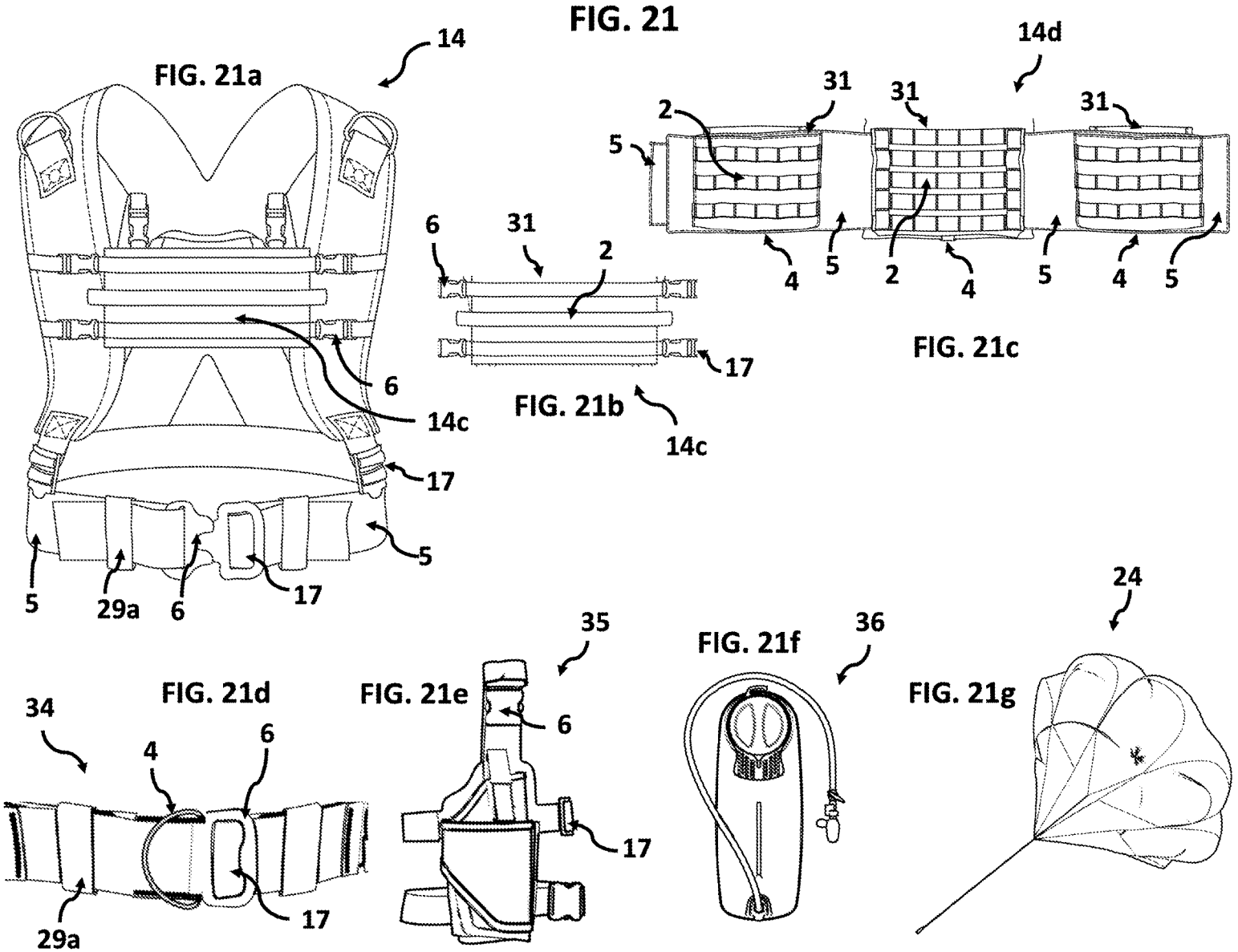
FIG. 21 is a perspective view of a harness and option attachments, more specifically
FIG. 21*a* illustrates a front view of a harness and chest kit attached.
FIG. 21*b* illustrates a chest kit detached.
FIG. 21*c* illustrates a waist kit detached.
FIG. 21*d* illustrates a waist belt.
FIG. 21*e* illustrates a holster.
FIG. 21*f* illustrates a hydration pack and FIG. 21*g* illustrates a parachute.

In some embodiments, a waist belt 34 can be provided as an additional accessory for the user to either use as a dragging component with the training bag 100 and/or for individual usage as depicted in FIG. 21*d*.

In some embodiments, a waist belt 34 can comprise of the selected: compressed lining 16, nylon, canvas, polyester, Cordura, PVC, PU, breathable mesh on the internal and external surface in combination thereof.

In some embodiments, an individual fabric can be secured around the waist belt 34 by one or more securing elements 2 which are intended for a gliding loop 4 for attachments such as a connecting strap 14*a*-14*b*.

In some embodiments, a fastener 6 such as a hook and a loop fastener 5 can be located on the external surface 11*a* with at least one adjustable working strap 17 on the ending to lose and/or tighten, depending on the user's body composition.

In some embodiments, a fastener 6 such as a buckle 6 can be located on the external surface with at least one adjustable working strap which is a more convenient method to loosen and/or tighten the structure of the waist belt.

In some embodiments, a movable loop 4 can glide around the entire waist belt 34.

In some embodiments, a waist belt 34 can comprise of one or more MOLLE attachments for additional attachments and/or cosmetic purposes.

In some embodiments, a waist belt 34 can comprise of a fixed compartment which is a similar structure to the internal compartment of the training bag 100 open configuration.

In some embodiments, a waist belt 34 can comprise of a fixed loop 4 located in the front, slightly to the left and/or right of the fastener 6, such as a buckle 6 for pulling exercises such as but not limiting to reverse lunges with one or more straps which is then attached to the training bag 100.

In some embodiments, a waist belt 34 can comprise of a fixed loop 4 on the proximal end and/or distal end to attach the bottom of the backpack straps 28 which is then attached to a loop 4 on the training bag 100, preferably the periphery loops 4 but not limiting to loops 4 on the external surface 11*a* in the closed 100 and open bag 101 configuration to increase the posture of the user. This also allows the user to increase additional weight in the enclosure 101 without discomfort to the users back.

In some embodiments, a waist belt 34 can be a fixed structure with similar elements to the backpack strap 28 as one complete set, comprising from the selected fixed and removable loops 4, hooks 18, MOLLE attachments, compartments, fasteners 6, hook and loop fasteners 5 in combination thereof.

In some embodiments, a waist belt 34 can comprise of a fixed loop 4 around the external surface for attachments when detached from the training bag 100. For example, the waist belt 34 can be utilized to drag the training bag 100 by attaching one or more straps such as a connecting strap 14*a*-14*b* to one or more loops 4 on the external surface then to the training bag 100. This allows the user to solely purchase the waist belt 34 and backpack strap 28.

Example: Waist Belt 34

A user can request a waist belt 34 with a fixed loop 4 or a gliding loop. The benefit of a fixed loop 4 is a fixed position when using the belt as the pulling component to drag the training bag 100 as a sled. The benefit of a gliding loop 4 is that the user does not have to attach and detach a hook 18 on one or more connecting straps 14*a*-14*b* when using the training bag 100 as a sled. However, the gliding loop 4 can create a swivel movement on the training bag 100 which decreases the working load.

A waist belt 34 can be purchased with MOLLE attachments for cosmetic purposes and/or for attachments. For example, a user can attach a holster 35 to one or more MOLLE attachments around the periphery and/or surface area of the waist belt 34 for quick access. In some instances, a user can attach a hook on one or more connecting straps 14*a*-14*b* followed to the training bag 100 to use as a sled. In other instances, a user can attach a removable compartment to stow away personal belongings.

A user can request a fixed compartment around the external surface of the waist belt 34 to utilize as a general leisure tool. For example, a user can correct the posture when running which will eliminate the lumbar extension and flexion.

A user can utilize the waist belt 34 when squatting and deadlifting during the concentric and eccentric motions. The general population tends to lean forward when performing squatting or deadlifting which causes strain to the back. A waist belt 34 can be a reminder of when to stop and correct the posture.

Harness 14

Figure 20:
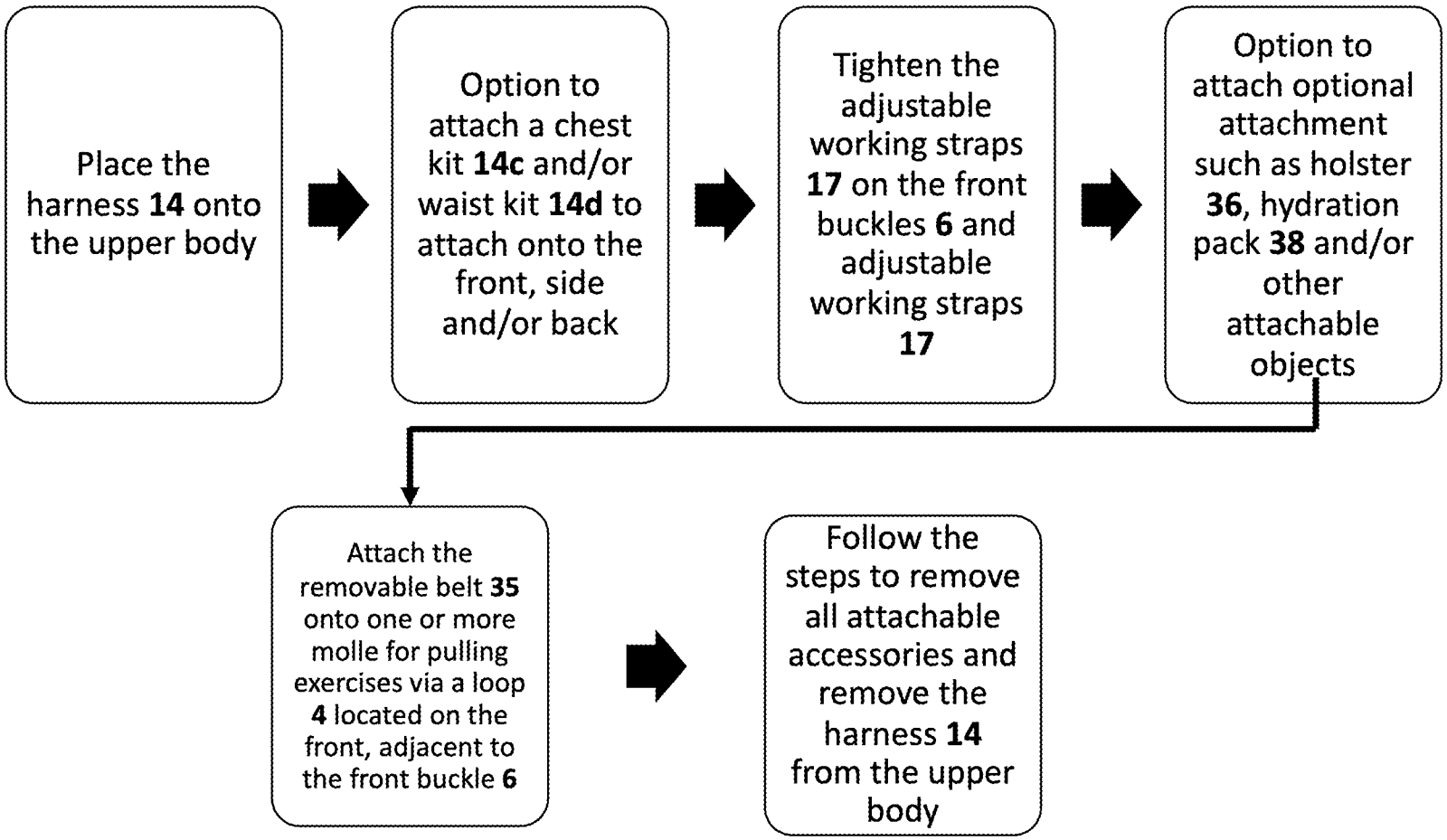
FIG. 20 is the preferred transition for a harness and optional attachments.

FIG. 20 illustrates the preferred method to place a harness 14 and components, however, this is a preferred method and not required.

In some embodiments, a harness 14 can be utilized as a training bag 100 component and/or for unrelated activities with or without one or more accessories. It is to be understood before manufacturing, one or more layers of the external surface and periphery and/or one or more layers of the interior fabric can comprise a selected group of the canvas, nylon, ballistic nylon, polyester, cotton, Cordura, Kevlar, leather, silk, PVC, PU coating and combinations thereof.

In some embodiments, a harness 14 can be viewed as an upper-body device to drag the training bag 100 with one or more loops 4 around the periphery belt side with additional fasteners 6 selected group of buckles, adjustable working strap, hook and loop fastener, zipper, and combinations thereof.

In some embodiments, a harness 14 can be viewed as a smaller size however, the one or more fasteners 6 can securely tighten and/or loosen shoulder straps and/or waist by pulling on one or more adjustable working straps 17. It is to be understood a user can fold one or more fabrics in one or more compartments.

In some embodiments, a user can attach loose fabric into one or more MOLLE attachments to neatly secure the fabric. Additionally, one or more adjustable working straps 17 can comprise a hook and loop fastener 5 at the endpoint to conveniently fold more than one to decrease the fabric.

In some embodiments, one or more adjustable working straps 17 can comprise of a fabric strap fold to secure the remaining fabric when adjusting the body portion of a user. For example, smaller body composition will require the user to firmly pull one or more adjustable working straps 17 on a fastener 6 which will result in loose fabric. To eliminate the loose fabric, the user has the option to adjust the fabric strap fold near the ending point to eliminate movement.

In some embodiments, a harness 14 can comprise of one or more adjustable working straps 17 which comprises of fabric under one or more MOLLE attachments and/or similar securable elements 2 with a loop 4 to adjust the upper body portion. It is to be understood a harness 14 can be viewed as a removable backpack strap 28.

In some embodiments, a harness 14 can comprise fixed lower body adjustable straps for the lower limbs to uplift the user's body during leisure activities and/or tactical military training. In some instances, the lower part of a harness 14 can be viewed as a tether for usage when rock climbing and/or high climbing activities.

In some embodiments, the lower part of a harness 14 can be viewed for additional posture for a user and mammals such as a dog to correct and uplift and correct the posture.

In some embodiments, the lower part of a harness 14 can comprises one or more loops 4 and/or fasteners 6 similar to the upper part of the harness 14 to adjust to the lower limbs of a user and/or mammal. In some instances, the lower part of the harness 14 can be removable by one or more fasteners 6 of the external surface and/or periphery of the harness 14.

In some embodiments, the interior of one or more shoulder straps and/or waist belt 34 can comprise of pouches for cooling gel inserts. It is to be understood one or more pouches can also comprise of other cooling devices such as liquids and/or frozen liquids.

In some embodiments, one or more straps of a shoulder strap on a harness 14 can comprise of a compartment that can be utilized for phones, water bottles, and for other objects the user may have.

In some embodiments, one or more compartment straps are selected group of: a mixture of textile fabric, mesh, nylon, canvas, nylon thread stitching, securable devices, buckle, zipper, hook, and loop fastener, adjustable working strap, and a hook and combinations thereof.

In some embodiments, one or more loops 4 can be secured to the periphery of the harness 14 waist. It is to be understood one or more loops 4 can be fixed and one or more loops 4 can be movable with a selected group of shapes: triangle, right triangle, rectangle, parallelogram, circle, square, rhombus, oval, pentagon, hexagon, octagon, cylinder, cube, star, heart and/or arrow and combinations thereof.

In some embodiments, at least one fastener 6 such as a buckle can slightly be viewed to one side which allows a fixed loop 4 to be secured for pulling exercises which will be explained in the upcoming examples.

In some embodiments, a harness 14 can comprise of a cosmetic patch such as a hook and loop fastener patch for attachments such as country flags, print screens, and/or logos. Additionally, one or more MOLLE attachments can be secured around the shoulder straps in the front and/or back with one or more MOLLE attachments on the waist.

In some embodiments, the lower part of the harness 14 which can be interpreted as the waist belt 34 and can comprise a wider range which can be interpreted as side panels for support padding which can fold over to your rib cage and connect in the front via a fastener. This allows the user to utilize the harness 14 as a backpack with the training bag 100, which will be explained in the upcoming examples.

In some embodiments, one or more waist belt 34 can comprise of one or more MOLLE attachments around the external surface, in different directions for attachments and/or cosmetic purposes.

In some embodiments, one or more side panels of the harness 14 can comprise one or more compartments with an opening of one or more fasteners 6 such as a buckle, hook and loop fastener 5, adjustable working strap 17, and/or similar fasteners 6 to open and close the compartment.

In some embodiments, the side panel can comprise anti-gravity foam padding which can be interpreted as compressed lining 16 for comfort.

In some embodiments, the interior fabric can comprise one or more layers of anti-gravity foam padding 16 to correct a user's posture and comfort.

In some embodiments, the external outer layer can comprise of ballistic nylon for combat scenarios. For example, a user can wear the harness 14 for gun holsters on one or more side panels. One or more side panels and/or shoulder padding can be interpreted as bulletproof with one or more layers of ballistic nylon and/or similar bulletproof fabrics such as Kevlar.

It is to be understood the harness 14 does not require the training bag 100 and/or one or more connecting straps. A user can utilize the harness to their desire.

In some embodiments, the user can adjust the harness 14 and adjustable working straps 17 and/or fasteners 6 around the harness for a smaller body portion and/or mammal such as dogs for leisure and/or training.

It is to be understood the harness 14 can be utilized for attachments such as go-pro cameras and/or other electronics attach onto one or more MOLLE attachments and/or similar attachments for leisure activities.

In some embodiments, the front of the harness 14 can comprise of a removable front kit 14*c* as illustrated in FIG. 21*b* which can be interpreted as a chest rig which is designed for tactical training and/or military. The user has the option to attach a front kit 14*c* to one or more fasteners 6 and/or MOLLE attachments in the front and/or rear of the harness 14 for attachments such as holsters 35, and compartment, not limiting to other attachments a user may have.

FIG. 21*a* illustrates a harness 14 with a chest kit 14*c* attached upper torso.

In some embodiments, a harness 14 may comprise of a fixed chest rig which comprises of a selected group of compartments, fasteners, zippers, hook and loop fasteners, a compartment for weights, a side panel with one or more fasteners, adjustable working straps on the external surface and periphery and MOLLE attachments and combinations thereof.

In some embodiments, a harness 14 can comprise of one or more loops 4 around the external surface area of one or more shoulders straps secured by one or more securable elements 2. The intended purpose for one or more loops 4 is to utilize the training bag 100 which is then looped around one or more loops 4 on the waist and shoulder straps and then secured by one or more individual straps on either side. In other instances, a user can attach one or more connecting straps to one or more loops 4 around the periphery and/or shoulder straps to one or more loops 4 on the external surface 11*a* of the training bag 100 for dragging activities.

In some embodiments, a harness 14 can comprise of a similar compartment as the front shoulder strap which can be intended for a removable hydration pack 36 for physical activities.

A hydration tube can be secured through one or more loops 4 on one or more shoulder straps. To minimize movement in one or more hydration tubes, one or more stabilizers comprising of one or more fasteners such as at least one layer of a hook and loop fastener 5 to fold over near the mouthpiece.

Additionally, the rear compartment can be utilized for other objects such as personal belongings and/or physical training exercises. The user has the option to request a larger compartment that can hold babies for physical activities such as hiking.

In some embodiments, a compartment can comprise mesh to allow airflow for liquids that may have been deposited in the compartment. Other harnesses 14 on the market does not have a visible hydration pack with working features presented in the present harness. This is convenient for the user to remove the hydration pack at a fast pace.

It is to be understood one or more compartments can comprise one or more textiles selected group of nylon, canvas, polyester, rubber, cotton, Cordura and Kevlar, PVC, PU, and combinations thereof.

In some embodiments, one or more securable elements 2 can be around the surface area, and periphery in the external and internal configuration to secure the structure of the harness 14.

Harness Chest Kit 14*c*

FIG. 21*b* illustrates a harness chest kit 14*c* which is an optional attachment to the harness 14 as additional storage compartment and attachments.

In some embodiments, a harness chest kit 14*c* can comprise of one ending of a fastener 6 such as a buckle to attach onto the harness 14 fastener which is then adjusted by firmly pulling the adjustable working strap 17 on either the harness 14 or harness chest kit 14*c*.

In some embodiments, the harness chest kit 14*c* can comprise of a loop 4 constructed as a similar feature as the loop 4 on the training bag 100 to utilize as a pulling device such as attaching one or more straps of a connecting strap 14*a*-14*b* to the training bag 100 loops 4 for reverse lunges.

In some embodiments, a harness chest kit 14*c* can comprise of securing elements 2 such as a MOLLE attachments for additional attachments such as a holster 35, and a hydration pack 36.

In some embodiments, a harness chest kit 14*c* can comprise of a compartment with at least one fastener 6 on the top, bottom and/or side for weighted plates utilized as a bulletproof vest and/or for exercise increasing the resistance.

Harness Waist Kit

FIG. 21*c* illustrates a harness waist kit 14*d* which can be viewed with the similar structure and features as the harness chest kit 14*c*.

In some embodiments, the harness waist kit 14*d* can comprise of a fastener 6, such as a buckle with an adjustable working strap 17 and loop 4 to attach onto the harness 14 and also for other attachments. This allows the user to utilize the harness 14 as a separate device for resistance exercises and for leisure activities such as hiking.

In some embodiments, the interior harness waist kit 14*d* can comprise of a compartment to stow personal belongings. Additionally, the harness waist kit 14*d* can comprise of a compartment with at least one fastener 6 on the top, bottom and/or side for weighted plates utilized as a bulletproof vest and/or for exercise increasing the resistance.

In some embodiments, one or more compartments can comprise of a loop (not shown) around the external surface and periphery for attachments such as to utilize as a pulling device to drag the training bag 100 in a frontal and/or lateral direction.

In some embodiments, a harness waist kit 14*d* can comprise of securing elements 2 such as a MOLLE attachments for additional attachments such as a holster 35 and hydration pack 36.

As depicted on FIG. 21*d*, a waist belt 34 can comprise of a similar and/or same appearance as a harness waist kit 14*d* also comprising of similar and/or same functions to utilize the training bag 100 as a backpack. For example, the waist belt 34 can attach onto one or more MOLLE attachments on the harness waist kit 14*d* to provide additional support of the user's body. Additionally, the harness waist kit 14*d* can provide the user to stow personal belongings around one or more compartments.

It is to be understood the harness waist kit 14*d* can be utilized as a separate device with other related components such as a waist belt 34 which will be further elaborated in the upcoming embodiments.

Training Bag with a Harness 14 and One or More Straps

It is to be understood a harness 14 for dragging exercises with the training bag 100 can also be used for a weighted bag exercises which is viewed as a backpack. However, the user has an option to purchase a separate harness 14 with limited and/or no functions related to the harness 14 disclosed.

FIG. 13*a*-13*c* illustrates a harness 14 connecting strap 14*a* and a training bag 100 set up for weighted bag exercises. The training bag 100 is attached by at least one strap from a connecting strap 14*a* around the perimeter to be held as one of the main structures which is then looped around to the rear side, in particular, durable surface 11 which is then wrapped and/or attached to at least one loop 4 on the harness 14 and at least one loop 4 and/or grip 1 on the training bag 100 which can be viewed in detail on FIG. 13*c*.

In some embodiments, at least one strap is around the area surface shoulder of the harness 14 loop 4 via a hook 18 on at least one strap of the connecting strap 14*a*. In some examples, there can be a hook 18 on every other loop 4, or any combination of hooks 18 in order to ensure a secure fit and ease of accessibility.

The user has the option to purchase a connecting strap 14*a* and/or variation connecting strap 14*b*. For example, it may be convenient for a user to purchase a variation connecting strap 14*b* for increased posture support for long distances and/or any activity that requires demand on the body.

It is to be understood at least one attachment such as a hook 18 can be detached from a connecting strap 14*a* for other purposes, with or without the harness 14 and/or training bag 100.

With one or more loops 4 around the perimeter of the training bag 100 a user has many options to perform specific exercises. Below are exercises preferred and recommended, however the user can use the training bag 100 for other purposes. One or more loops 4 can be utilized in any combination by the user in order to perform an exercise.

It is to be understood that the training bag 100 may have a fixed durable surface 11 and a detachable durable surface 27. Behind the first layer of the durable surface 11 can be one or more hidden compartment straps for at least one backpack strap, to use the training bag 100 for weighted exercises which may been seen in previous reference FIG. 13*a*-13*c*, around the area surface and perimeter of the training bag 100. However, for a more secure and firm position, a harness 14 may be recommended to use as a backpack strap as previously depicted in FIG. 11*c*-11*d*.

In some instances, individual environmentalist and organizations can request customized fabrics and/or minerals prior to manufacturing. For example, a mixture of minerals can comprise of current fabrics that are unused and/or used recycled materials such as glass, paper, cardboard, metal, plastic, tires, rubber, and metal for one or more backpack straps.

In some embodiments, one or more backpack straps can comprise of at least one loop 4, MOLLE attachments, fastener 6 and adjustable working strap 17 to hold weighted objects in the training bag 100 and for a quick release for leisure and/or physical activities.

In some embodiments, one or more MOLLE attachments may comprise of at least one layer of woven tape 3 with optional textile mineral mixture with one or more securing element 2.

In some embodiments, one or more backpack straps can comprise of compressed lining 16 to support weighted objects in the enclosure of the training bag 100 and also to prevent discomfort and slouching of the shoulders.

In some embodiments, one or more straps may be viewed as a shoulder strap wherein the training bag 100 can be used as a duffle bag.

It is to be understood the training bag 100 can be worn vertical and/or horizontal with minimal to no tilts, depending which loop 4 and hook 18 is attached.

Harness and Connecting Strap

In some embodiments, the interior fabric of the harness 14 may have at least one layer of compressed lining 16 which is intended for soft padding. The exterior fabric of the compressed lining 16 can have at least one layer of Nylon which is also flexible for the user when pulling, dragging and/or carrying objects such as the training bag 100. In some instances, there can be multiple layers that can be adjacent or interchangeable that comprise of both Nylon and compressed lining 16, or any combination thereof.

In some embodiments, the harness 14 can be viewed with one or more fasteners 6 around the perimeter of the harness 14 to hold an up-right position when being used as a pulling device for heavy devices such as a truck, as a backpack, for rock climbing, and as a speed and agility device with or without a partner. The fasteners 6 may include an adjustable working strap 17 for expansion to accommodate to the user's body composition. It is to be understood one or more fasteners 6 and/or adjustable working strap 17 may be in different areas for different purposes such as securing the users torso when using the harness 14 with the training bag 100 as a dragging tool and/or when rock climbing.

In some embodiments, at least one fastener 6 can have a quick release point to release the harness 14 at a fast pace, preferably when being used as a sled. Also, behind and/or adjacent to at least one fastener 6 can have an optional loop 4 for attachments with or without the training bag 100.

In some embodiments, the harness 14 may be viewed as a separate backpack strap in regards to the structure on the rear side, covering the majority of the shoulders, specifically, the trapezius, levator scapulae, rhomboid minor and major, latissimus dorsi and in the anterior, pectoralis minor and major, subscapularis, deltoid, serratus anterior and under lying muscles, joints and ligaments. It is to be understood the rear perimeter of the harness 14 can include one or more loops 4 to attach a backpack or similar bags such as an training bag 100 to be used as a daily bag, weighted exercises bag, dragging tool such as a sled.

In some embodiments, at least one fastener 6 around the perimeter of the harness 14 can be secured and attached by one or more layers on either side of the harness 14 with webbing and/or similar fabric through one or more side of a fastener 6, and may include one or more adjustable working strap 17 to accommodate the users body composition. Additionally, adjusting one or more adjustable working straps 17 can uplift the users torso, correcting and/or improving acute or chronic dysfunctions.

In some embodiments, additional fabric is viewed loosely prior and after adjusting to the users body composition via an adjustable working strap 17. To minimize the fabric, the ending point may have a structure of woven tape which can be interpreted as a securing element 2 with a x shaped and/or thread around the perimeter with a hook and loop fastener 5 for the user to fold at least once and then secure the fabric by at least one layer of a hook and loop fastener 5. This is strictly up to the user and can be adjusted at any length. The hook and loop fastener 5 can be configured to be adjustable to extend or retract to one or more lengths, by the user, in order to ensure a more secure fit.

In some instances, the user has an option to fold and hide the extra fabric inside one or more compartment straps in the interior of the harness 14. For example, at least one compartment strap lined near the fastener 6 structure may have a compartment strap that is also viewed as a storage for the loose fabric but is up to the user. The compartment straps can be strategically located close to the harness 14 in order to ensure a flush fit of the extra fabric.

In some instances, it may be convenient to retail at least one harness 14 with at least one fastener 6 and excluding other features previously explained for the user to utilize the harness 14 as a postural correction. Additionally, any combination of the embodiments above, can be utilized in order to form the at least one harness structure with one or more fasteners.

In some embodiments, at least one fastener 6 can be plastic, metal and/or both around the perimeter of the fastener 6 and can comprise of polyvinyl chloride (PVC) and/or with a mixture of polyurethane (PU) to be used in various weather conditions. It is to be understood one or more fastener 6 can be different sizes, for example, the top fastener 6 can be smaller to accommodate to females to prevent any uncomfortable pulling on their breast.

In some embodiments, one or more loops 4 around the perimeter of the harness 14 can be attached with an extra layer of fabric such as nylon, subsequently secured by one or more layers of binding thread and Nylon and/or similar thread around the interior and/or exterior perimeter of the extra fabric.

In some embodiments, the binding 10 can be vertical and/or horizontal with additional securing element 2 further comprising of rivets beneath one or more layers a woven tape 3. The one or more rivets can be strategically placed one or more distances apart from one another. In another example, the rivets can be positioned on opposite layers, the same layer, or any combination thereof.

In some instances, depending on the user request, a harness 14 can have a fixed and/or removable belt allowing a user to connect other attachments for various exercises which will be explained in examples. The belt can have securing elements 2 such as woven tape 3 around the perimeter of the belt securing the movable loop 4. This allows the user to use at least one fixed loop 4 around the perimeter of the harness 14 and at least one movable loop 4 with a fixed and/or removable loop 4 for other purposes. In some examples, there can be only fixed loops 4 around the perimeter of the harness 14. In another example, there can be only moveable loops 4 around the perimeter of the harness 14. In yet another examples, there can be a combination of fixed and moveable loops.

In some embodiments, the harness 14 may have attachments such as MOLLE attachments and can be manufactured with woven tape 3 and/or similar securing elements 2 for attachments, with or without the training bag 100.

In some embodiments, the interior may include one or more layers of binding 10 around the perimeter of the harness 14 to hold the structure. The binding 10 can be mixed with cotton, avoiding discomfort and irritation when in use. The binding can be secured in one or more ways, with a variety of stitching as disclosed above, and bound in layers to ensure durability.

Other harnesses 14 previously made usually tear damaging the structure and possibly injuring the user while using the harness 14. Additionally, the embodiments disclosed have at least one fixed loop 4 with no space around the perimeter, preventing possible release when carrying heavy objects. In some examples, there can be at least one fixed loop 4, or at least one adjustable/moveable loop 4, or any combination thereof.

As depicted in FIG. 2 one or more connecting strap 14*a*; and related connecting straps with comprising of an individual strap further comprising of one hook 18 and three connecting on the opposite end with at least one hook 18 on each. Securing the structure mid point can be a securing element 2 such as a woven tape 3 with thread, stitched like an x and/or around the perimeter of the base.

In some embodiments, the connecting strap 14*a* may have one or more layers of fabric such as Nylon, polyester, not limiting to similar durable fabric. When manufactured, one or more layers can hide additional securing elements 2 such as rivets and woven tape 3. Each of these layers can comprise of any combination of nylon or polyester, or a similar fabric. The layers can range from a single layer to multiple layers of each of the fabrics.

In some embodiments, the ending point of one or more straps has at least one woven tape 3 layer wrapped around to fit a hook 18 and/or similar attachment such as a clamp to secure and reinforce when using for excessive intense training exercises. Also, when manufactured, one or more layers may hide other securing elements 2 such as one or more rivets.

In some embodiments, the stitching structure around one or more hooks 18 can cause minimal to no movement in the hook 18 and/or similar attachment when using for excessive intense training exercises. In some examples, there can be a combination of stitching around the perimeter of the hooks, and under the hook in order to ensure durability and a secure fit.

In some embodiments, a harness 14 at and least one connecting strap 14*a*, 14*b*, 25 and 25*a* may comprise of one or more MOLLE attachments to be used as a cosmetic appearance and/or for optional attachments related with or without the training bag 100.

Depending on the usage of the harness 14 and one or more connecting straps, it may be convenient to manufacture with a mixture of minerals and/or Nylon, vinyl, linen, cotton, canvas, polyester, or microfiber with one or more water proof coating selected from the group of polyvinyl chloride and/or polyurethane.

In some instances, individual environmentalist and organizations can request customized fabrics and/or minerals prior to manufacturing. For example, a mixture of minerals can comprise of current fabrics that are unused and/or used recycled materials such as glass, paper, cardboard, metal, plastic, tires, rubber, and metal. It is to be understood prior manufacturing, a user can request to comprise of one or more minerals in a harness 14 and/or connecting strap 14*a* wherein a specific machinery can be used.

In some embodiments, one or more MOLLE attachments comprise of at least one layer of woven tape 3 with optional textile mineral mixture with one or more securing element 2 to hold the structure and for weighted objects related with or without the training bag 100.

In some embodiments, connecting strap 14*a* is viewed as a similar function and structure as an variation connecting strap 14*b*. However, the variation connecting strap 14*b* allows the user to attach one or more additional straps on one or more loops 4 around the periphery of the harness 14 which will elaborate in later examples.

It is to be understood one or more connecting straps 14*a*, 14*b*, 25 and 25*a* can have one or more hooks 18 detach and to be used for other usages with or without the training bag bag 100.

Example: Sled Drag Exercises Comparison

The training bag 100 can be viewed as a dragging tool with a harness 14, and connecting strap 14*a* configured to be dragged on either side of the training bag 100. The user can adjust the harness 14 according to the body composition via adjustable working straps 17 followed by attaching on one or more hooks 18 via connecting strap 14*a* on one or more loops 4 around the perimeter of the harness 14. The opposite ending of the connecting strap 14*a* can be attached to one or more loops 4 on the training bag 100. It is preferred to securely attach all three connecting straps 14*a* hooks 18, onto each of the three loops 4 on the training bag 100 to be used as a dragging tool. Attaching the connection straps onto each of the three loops 4 of the training bag 100 can distribute the enclosed weight evenly, preventing swivel and raising of the training bag 100 during running, speed and agility exercises. For example, a track and field athlete with a goal of improving a short distance goal such as the 40-yard dash, can utilize all weight in the enclosure of the training bag 100 and prevent swiveling by attaching all three connecting straps 14*a* hooks 18 on one side of the training bag 100. The friction of the durable surface 11 allows the training bag 100 to come to a stop when the user would complete the exercise on any surface in reference to the comprising fabric and coating on the durable surface 11. Other inventions may have one loop 4 which increases lifting of the dragging tool and swivel, which does not utilize the dragging tool. This particular method could cause the user to lose a smooth running form, and cause apparent injury if the training bag 100 were to pull the runner in an awkward direction, or not stop when the runner ceases running. In addition, other dragging tools on the market may not create enough friction, which would result in the dragging tool possibly causing an injury to the rear lower body when coming to a stop.

Speed and Agility Sled Exercises with a Harness 14 and Connecting Strap 14*a*

The preferred postural form at the start comprise of an off line slight bent position with an upright torso firm posture preparing for a running, sprinting and/or speed and agility exercise. The proper running mechanics starts from the mid foot which creates quick ground contact which is also known as the stretch shortening cycle (SSC) in the lower body hinge, in particular, hips knees and ankles. Using a dragging tool such as the training bag 100 with additional weight creates resistance for the user to move forward. This generates rapid, repetitive movements during the specific exercise which is then simulated in a sporting competition such as track and field. Also, a runner with poor running mechanics can use the training bag 100 as a sled to emphasize ground contact but still maintaining the forward movement. Some specific drills for quick ground contact are, high knees, A skips, B skips, and change of direction (COD) just to name a few.

A dragging tool such as the training bag 100 with any amount of weight builds strength in the lower body, particularly in the gluteus medius, minimus. While running forward, with the upper body harness 14 of the dragging tool such as the training bag 100, a limb is extended in a frontal plane back in conjunction with the tensor fasciae latae to the ground for quick ground contact. During flexion of the hip (hinge), the glute medius and minimus internally rotates the thigh which is then extends out the hip for a forward plane motion. These movements are important for sprinters, football, baseball, basketball and hockey athletes because the majority of their force is going forward, while performing sports moves during the respective sport. Having the training bag 100 as a resistance tool increases the strength and also the user's stamina.

To improve a user stamina, high intensity interval training (HIITs) are recommended at a precautionary level. For example, a user can jog with the training bag 100 as a sled, then gradually increase the speed and intensity to maximum with as many repetitions until reached the VO2 Max. This is also called anaerobic training.

Sport Specific Sled Training

In baseball, lateral moves are the primary movements utilized while performing baserunning, with a linear sprint being utilized as the secondary movement. Dragging a training bag 100 during practice on a side loop 4, preferably the left loop 4 of the harness 14, with at least one hook 18 via connecting strap 14*a* to one or more loops 4 on the side of the training bag 100 for simulation of a secondary lead. For example, a baseball player can practice side shuffles on or off the baseball field to simulate the movement as a game situation. This will increase strength and also muscle memory during games.

Speed requires a user's ability to move the body in one direction as fast as possible. Agility is the ability to accelerate, decelerate, stabilize and quickly change directions with proper posture through the exercises. These exercises can be used to improve on the change of direction (COD). In order to improve upon COD, a user may attach one hook 18 onto at least one of the front loops 4 on the harness 14 then attach at least one hook 18 onto one or more loops 4 on the training bag 100 for reverse lunges and/or sprints. Throughout the set, the user has the ability to quickly release a fastener 6 to disassemble the harness 14 and sprint in another direction without any assisted tools.

For specific agility exercises utilized for track and field athlete training, for a short and/or long distance, requires the upper torso to be in a firm position from the start of an explosive running action, through at least six strides leading to an uplifting of the body into a firm upright position. The track and field athlete can use the harness 14, connecting strap 14*a* and training bag 100 as an assisted tool to correct and/or improve a firm up right posture throughout the start to finish line. The benefit about the training bag 100 and harness 14 is that both tools work together for an all-around advantage for athletes training for speed and agility. Other dragging tools may include a waist belt to a dragging tool. The waist belt does not support the posture from the starting point to the finish line. For example, if a user is wearing a waist belt with a dragging tool, the upper body, in particular the lumbar to cervical spine may be rounded if the user does not have the correct techniques. This may create pool habits and decrease performance and possible lead to future injuries.

In some instances, a user has the ability to wear the harness 14 backwards for reverse exercises such as reverse lunges, sprints and runs. For example, military personnel have the dummy carry as a mandatory test. To train for the test, military personnel may wear the harness 14 backwards as an alternative instead of using the front loop 4. It is to be understood these are recommendations are not mandatory and/or required.

It is to be understood the three hooks 18 on a connecting strap 14*a* may attach onto three loops 4 around the harness 14 and one onto another device such as an training bag 100. In some instances, the harness 14 and connecting strap 14*a* can be used for other purposes such as dragging and/or pulling vehicles from lower body strength training. It is recommended but not required to attach at least three hooks 18 on the connecting strap 14*a* onto one or more loops 4 around the harness 14 for the correct balance of dragging a vehicle. For example, if a user has one hook 18 attach to one loop 4 on the harness 14, there can be possible shifting movements in the body with extended strides. It is to be understood these are recommendations and not mandatory and/or required.

Example: Speed, Agility and Conditioning with a Harness and Sling

In some embodiments, a sling 23 that can configure to utilize with a harness 14, with or without a partner. Although the harness 14 can be viewed as a compound weight lifting device, the harness 14 can be used for activities such as running, sprinting, multi-direction, change of direction speed and agility drills. For example, a user can wear the harness 14 and a partner can then pull the sling 23 at a firm grip while the user is running and/or sprinting in a linear, lateral and/or reverse and then the partner can release one grips 1 by letting go but still holding on the other hand, forcing the user to run without any resistance. This can also be viewed as a drop set, increasing resistance then decreasing resistance at a short duration. Additionally, this exercise is to increase VO2 max.

For law enforcement personnel, a K-9 can use the harness 14 with the law enforcement personnel pulling at a firm grip then releasing the sling 23, increasing the demand of the K-9 to drive linear force. This example can be viewed as a simulation of a scenario when chasing suspects.

A user can use the harness 14 with one or more loops 4 for exercises without a partner for weight training such as deadlifts. The user can tie and/or knot one end of a sling 23 to a fixed object and one end on one or more loops 4 around the perimeter of the training bag 100 while lifting up the barbell with or without weight, generating force from the hip flexor to force forward to work on range of motion (ROM), corrective postural techniques and/or from recovering from acute and/or chronic pain.

Example: Resistance Sprints with a Harness and Parachute

In some embodiments, parachute 24 to be used with a harness 14. When a user is using a parachute 24, the main goal to achieve is resistance sprints without a partner. For example, the user may exercise alone, leading the user to work with wind resistance when running and/or sprinting in a linear, lateral and/or reverse plane. Additionally, it may be beneficial to use the parachute 24 subsequently damaged and/or injured lower body part to control the appropriate resistance.

Using a parachute 24 to maximize the shortening cycle (SSC) by the user storing elastic energy for every stride, increasing range of motion (ROM) and also strengthens the lower body by causing fatigue in the lower body, in specific to the hip flexor complex, quadriceps, hamstrings, tibialis anterior and calves to work in greater demand for a longer duration.

Example: Harness 14 for Other Purposes

When using the harness 14 as a rock climbing device, the weight shift from the additional hiking equipment such as pulling straps may have excessive pulls when climbing. A user may adjust the adjustable working straps 17 firmly to avoid excessive pulling. This adjustment of the working straps, allows the user to effectively shift the weight of the additional hiking equipment in order to avoid injury or other dangerous scenarios.

It is to be understood that the harness 14 can be used without physical activities and/or training tools. For example, a user can adjust all adjustable working straps 17 firmly to uplift the torso during poor posture habits such as office workers spending multiple hours a day on a computer. The use of the harness 14 can provide additional support to the user in order to create the proper muscle memory to uplift the torso in a firm position, with better posture, but also comfortable with at least one layer of compressed lining 16.

It is to be understood that the user has the option in manipulating how to use the harness 14 and/or the connecting strap 14*a* and/or variation connecting strap 14*b*. The examples listed above should be considered as recommendations and not as mandatory embodiments. Additionally, any combination of the above examples and embodiments can be utilized in order to perform the described actions of the disclosure.

Example: Training Bag 100, Harness 14 and Strap Worn as A Backpack

Any additional body weight increases strength, burns fat and improves stamina by burning more calories during a workout. Wearing the training bag 100 with a harness 14 and connecting strap 14*a* increases the body weight which leads to a more effective workout. For example, a user can wear the training bag 100 with a harness 14 and connecting strap 14*a* in previous reference of FIG. 13*a*-13*c* for push-ups as a progression from body weight. As progression arises, the user may add more weight in the training bag 100 such as filler weights 20, not limiting to other weights.

Another example is running with training bag 100 with a harness 14 and connecting strap 14*a* for long distance activities such triathlon. A triathlon athlete may use the training bag 100 in substitution for a standard triathlon backpack for increased weight to increase all around endurance. This also creates an additional convenience for a user for easy transportation. With the long duration activities on land such as biking and running, the triathlon athlete can place a hydration pack inside the training bag 100 for easy access. For example, a hydration pack can be secured in at least one compartment strap 19 with or without objects in the enclosure, to access the tube from one of the exterior fold overs 7 via hook and loop fastener 5 and at least one fastener 6.

This is very convenient for personal trainers as they travel different locations to accommodate to their clientele. For example, the personal trainer can instruct the client to perform weighted bag exercises as warm ups such as push-ups, squats then to sled exercises such as sled sprints then to bag exercises such as walking lunges and lastly to isolation exercises such as bicep curls used as filler weights 20 to finish the session.

Individual Strap, Connecting Strap 14*A*, Grip Variation Strap 14*b*

In some embodiments, grip connecting strap 25 and grip variation connecting strap 25*a* also may be viewed as a similar structure to a suspension trainer and in this invention, a connecting strap 14*a*.

In some embodiments, the connecting strap 14*a* may have one or more layers of fabric selected from webbing, nylon, ballistic nylon, canvas, polyester, elastic, bungee cord, plastic, rubber bands, ropes, wool, water-proof coating, chlorosulfonated polyethylene (CSPE) synthetic rubber (CSM), polyvinyl chloride (PVC) and/or with a mixture of polyurethane (PU), PVC tarpaulin in combination thereof, secured by one or more securing elements 2.

In some embodiments, the ending point of one or more straps comprises of at least one woven tape 3 layers wrapped around to fit a hook 18 and/or similar attachment such as a clamp to secure and reinforce when used for excessive intense training exercises. Also, when manufactured, one or more layers can comprise of a hidden rivet to provide additional securing element.

In some embodiments, the stitching structure around one or more hooks 18 can result minimal to no movement in the hook 18 and/or similar attachment when used for excessive intense training exercises. In some examples, there can be a combination of stitching around the perimeter of the hooks 18, and under the hook 18 to ensure durability and a secure fit.

In some embodiments, a connecting strap 14*a*; with an individual strap with at least one hook 18 and three connecting on the opposite end with at least one hook 18 on each securing the structure midpoint can be a securing element 2 such as a woven tape 3 with thread, stitched like an x and/or around the perimeter of the base.

It is to be understood the user can request a variation of hooks 18 selected from swivel hooks with latches, hanging hooks with latches, positive latching hooks, sorting hooks, foundry hooks, J-hooks, grab hooks, drum/barrel hooks, carabiner (shape of a wide, pear oval, D shaped positioning), thor carabiner, Mantus M2 hook, Rulaii hooks, Gorilla hooks and/or monkey hooks in combination thereof.

In some instances, individual environmentalists and organizations can request customized fabrics and/or minerals before manufacturing. For example, a mixture of minerals can comprise current fabrics that are unused and/or used recycled materials such as glass, paper, cardboard, metal, plastic, tires, rubber, and metal.

In some embodiments, a hook 18 can be fixed onto the ending of a single strap as previously illustrated in FIG. if strictly use as a device for hauling the training bag 100.

In some instances, the connecting strap 14*a*-14*b* can be used for other exercises unrelated to the training bag 100 such as attaching one or more connecting straps 14*a*-14*b* to a car for pulling exercises, attaching at least one hook 18 onto a trunk of a vehicle to hold excessive objects preventing disposal when driving, wrapping one or more straps around a tree when rock climbing.

In some embodiments, a connecting strap 14*a*-14*b* can have a visual of fabric fold-over with minimal space to insert and remove the hook for physical activities related or unrelated to the training bag 100.

In some embodiments, a connecting strap 14*a*-14*b* can comprise of one or more securing elements 2 such as Nylon thread stitching at the end point to further secure a hook 18, reassuring the user the connecting strap will haul the heavy object such as a truck.

In some embodiments, a single strap of a connecting strap 14*a*-14*b* can comprise additional hooks to utilize individually to haul another object coming from another direction (not shown).

In some embodiments, a connecting strap 14*a*-14*b* can comprise of one or more securing elements 2 such as Nylon thread around the mid-way to point utilize the strength and durability of the connecting strap 14*a*-14*b*.

In some embodiments, a connecting strap 14*a*-14*b* mid-way point can comprise of one or more straps detachable by a fastener 6 for further physical activities (not shown).

In some embodiments, a connecting strap 14*a*-14*b* mid-way point can comprise of a slight open visual to utilize the amount of space divided into three individual straps.

In some embodiments, a connecting strap 14*a*-14*b* can further comprise of MOLLE attachments for individual usage related or unrelated to the training bag 100.

In some embodiments, one or more individual of a connecting strap 14*a*-14*b* ending point hook 18 can comprise of optional attachments such as grips 1 for pulling exercises which will be further elaborated in the example embodiments.

It is to be understood one or more individual straps can be utilized as hauling exercises wrapping around one or more grips 1 (not shown) on the training bag 100 in an open and/or closed configuration.

It is to be understood one or more individual straps of a connecting strap 14*a*-14*b* can wrap around one or more loops 4 on the training bag 100 in an open and/or closed configuration to either use as a hauling apparatus or be utilized as a backpack which will be further elaborated in the upcoming examples.

It is to be understood one or more hooks 18 can attach onto a grip 1, fabric fold over on either side of one or more grips 1, an adjustable working strap 17, a buckle 6, a fastener such as a zipper head 6*a*, woven tape and an additional loop 4 further comprising of the training bag 100 fabric either in a closed bag configuration 100 or open bag configuration 100.

In some embodiments, one or more individual straps of a connecting strap 14*a*-14*b* can comprise of foam padding to utilize as a backpack with or without a harness 14.

In some instances, a user can utilize one or more straps of a connecting strap 14*a*-14*b* to attach around the training bag 100 which will then further provide padding on the user's body (not shown).

In some embodiments, one or more individual straps of a connecting strap 14*a*-14*b* can further comprise a fastener 6 such as a buckle and/or hook and loop fastener 5 to detach and be utilized as an individual strap. For example, a user can request before manufacturing a fastener and/or hook mid-way which will then release into an individual strap to use for pulling exercises in one direction (not shown).

In some instances, the endpoint of one or more individual straps of a connecting strap 14*a*-14*b* may not comprise a hook 18. For gripping comfort exercises, a grip 1 can further comprise of at least one layer of foam padding to which at least one layer of fabric of an individual strap is wrapped around at least once for a user to firmly grip and utilize the connecting strap 14*a*-14*b*.

In some embodiments, a user can wrap around the grip 1 on one or more individual straps of a connecting strap 14*a*-14*b* to tighten or loosen the connecting strap 14*a*-14*b* during pulling exercises which will be elaborated on in the upcoming examples.

In some embodiments, one or more individual straps of a connecting strap 14*a*-14*b* can further comprise an interior layer of one or more layers of elastic to extend the length of one or more individual straps and in some embodiments, the elastic can further comprise of fabric layers folded over one another in regards to the stretching of the elastic which then returns to the original position.

The grip connecting strap 25 and grip variation strap 25*a* is provided with a grip 1, securing element 2, woven tape 3, and interior with compressed lining 16 for padding. At least one grip 1 can be similar to the training bag 100 and/or with an increase in thickness of compressed lining 16 with rubber.

In some instances, the connecting strap can be viewed as a sling 23 which will be further elaborated on in the upcoming examples.

It is to be understood a connecting strap 14*a*-14*b*, variation connecting strap 25, grip connecting strap 25*a* can comprise similar visual features however, may function for various exercises.

It is to be understood one or more straps of a connecting strap 14*a*-14*b* grip connecting strap 25, and grip variation strap 25*a* can be used with or without training bag 100 and accessories.

In some instances, an individual strap and/or connecting strap can comprise of rope, further comprising of the selected manila hemp, hemp, linen, cotton, coir, jute, straw, sisal, synthetic fibers, polypropylene, nylon, polyesters, polyethylene and/or similar fabrics in combination thereof. This allows the user to create additional distance between pulling the training bag 100 as a dragging device. For example, a connecting strap 14*a*-14*b* further comprised of a rope can have a length of 10 feet. The user also has the option to wrap around the rope onto one or more loops 4, grips 1, adjustable working strap 17 and/or external surface 11*a*.

Example: Individual Strap

A user can purchase an individual strap to utilize with or without the training bag 100 and components. For example, a user can attach a hook onto a filler weight 20 MOLLE attachments then attaching on a handle onto the opposite end for rows, and internal and external shoulder rotation.

A user can utilize the individual strap and/or one or more connecting straps 14*a*-14*b* of the set as a bungee cord for additional resistance. For example, a user wearing a harness 14 and another user with an individual strap can firmly pull the user when running, creating resistance and release one grip 1 for speed and agility exercises. This can also be viewed as the similar and/or same structure as a sling 23.

Example: Connecting Straps 14*A* and Variation Connecting Strap 14*b*

Figure 22:
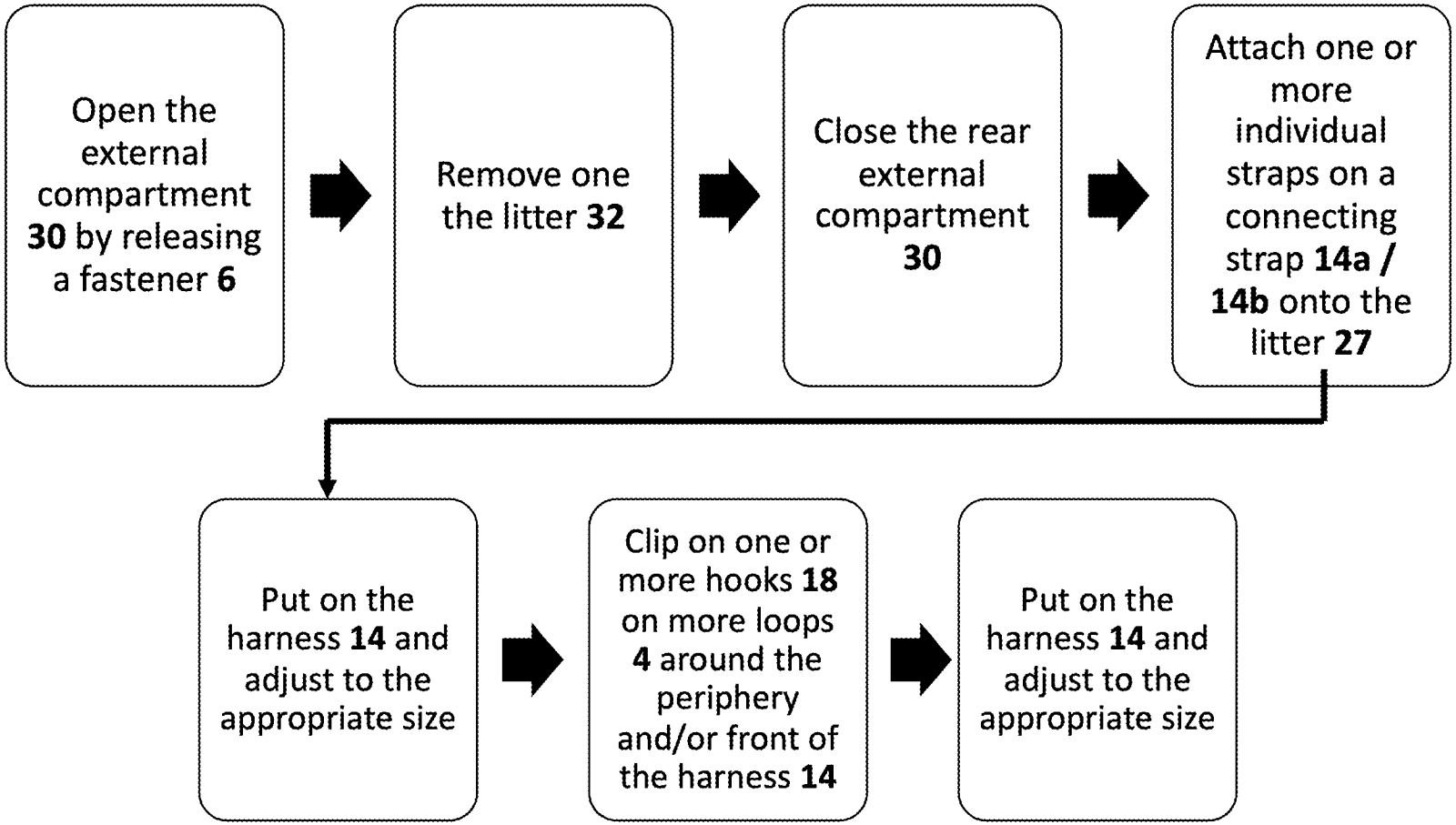
FIG. 22 is the preferred transition a training bag to dragging a litter.
Figure 24:
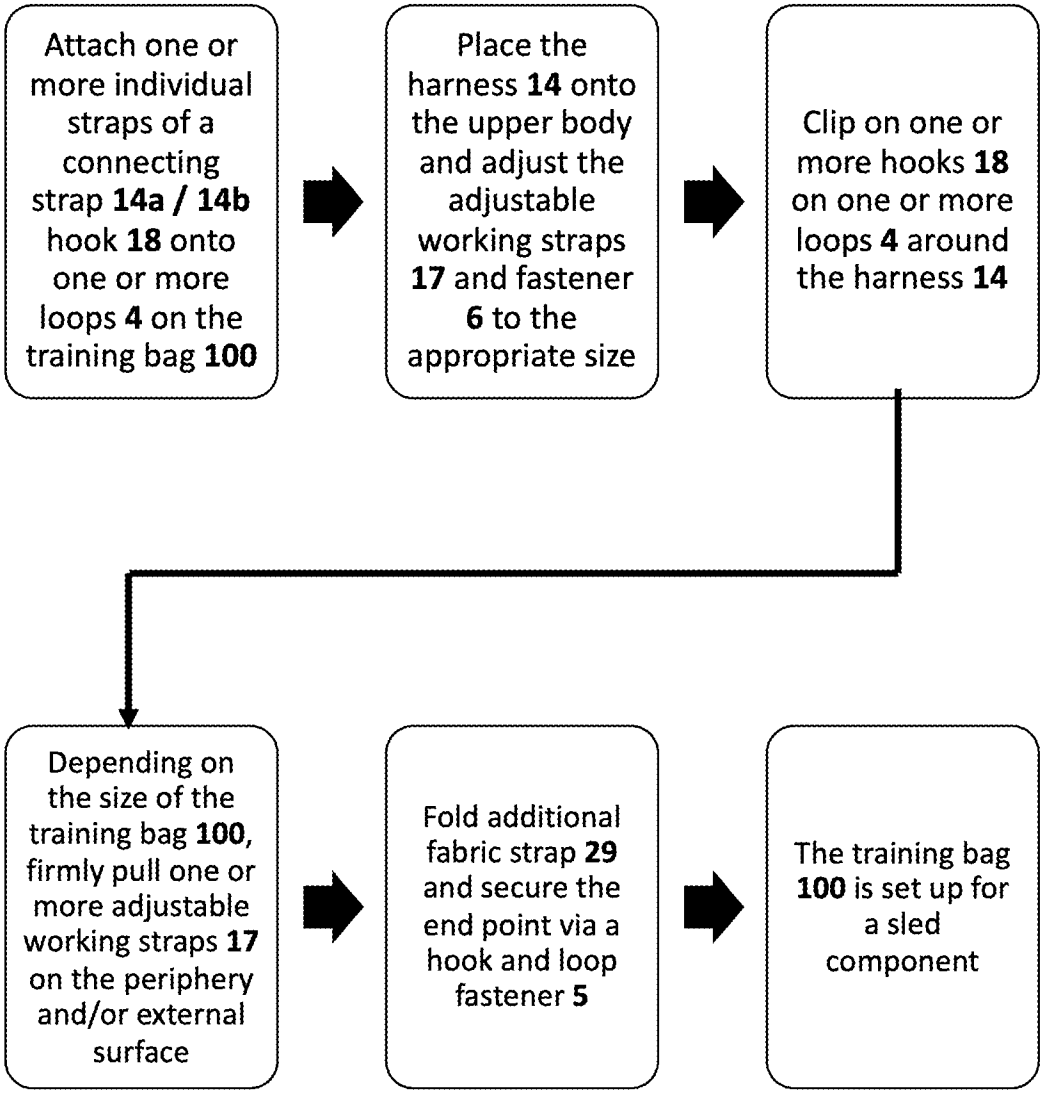
FIG. 24 is the preferred method to set up the training bag as a dragging tool.
Figures 25, 25A, 25B:
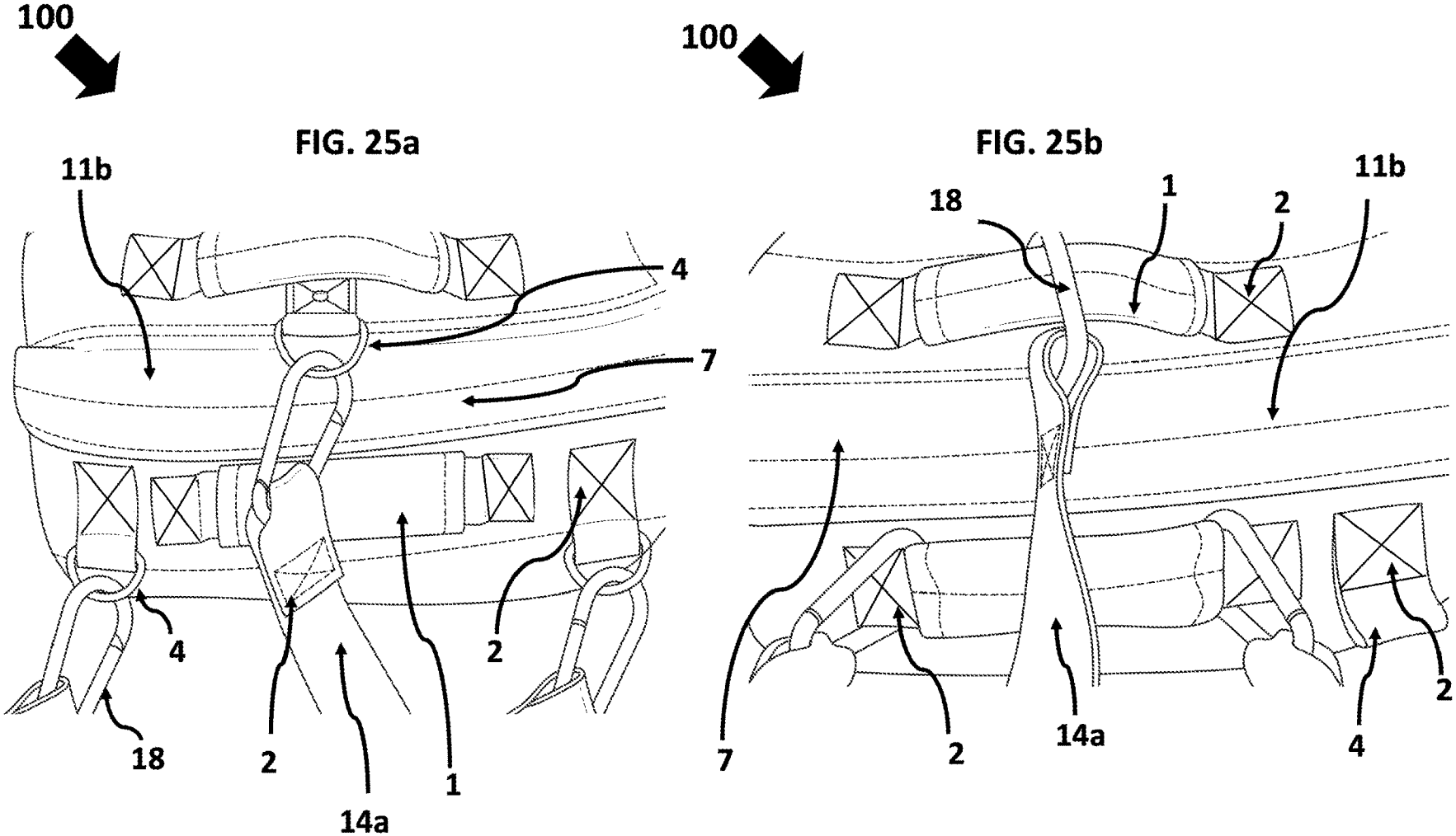
FIG. 25 is a side perspective view of a training bag, more specifically
FIG. 25*a* illustrates three hooks of a connecting strap attached onto three loops of the training bag and FIG. 25*b* illustrates three hooks of a connecting strap attached on a top grip, one hook on a distal end and one hook on a proximal end on a grip.
Figures 26, 26A, 26B, 26C, 26D:
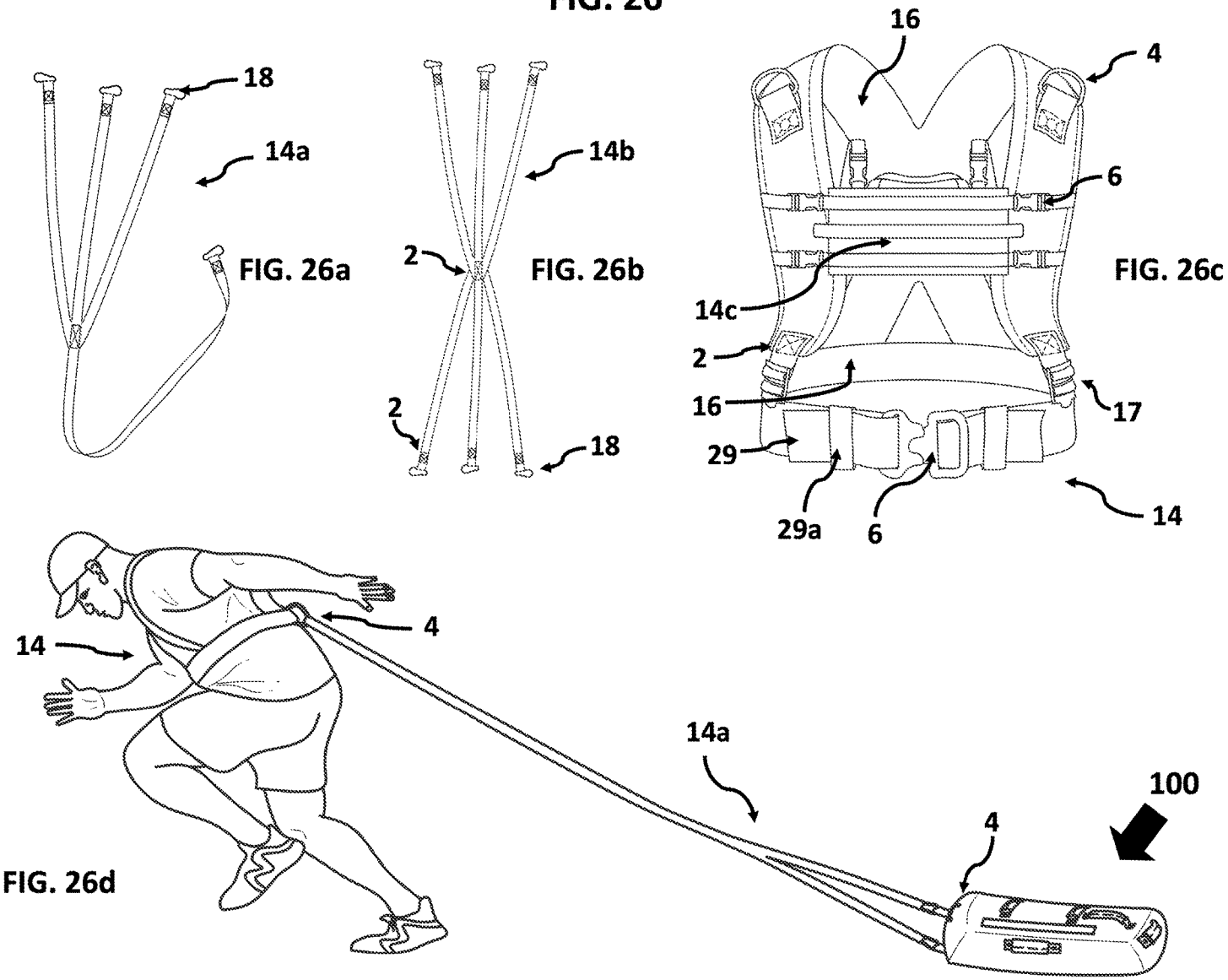
FIG. 26 is a perspective view of the components for a sled set up, more specifically
FIG. 26*a* illustrates a connecting strap.
FIG. 26*b* illustrates a variation connecting strap.
FIG. 26*c* illustrates a harness and chest kit and FIG. 26*d* illustrates a user wearing a harness, a hook from a connecting strap attached onto the rear loop of the harness and one or more loops of the training bag and dragging a portion of the rear durable surface upon a ground surface.
Figure 27:
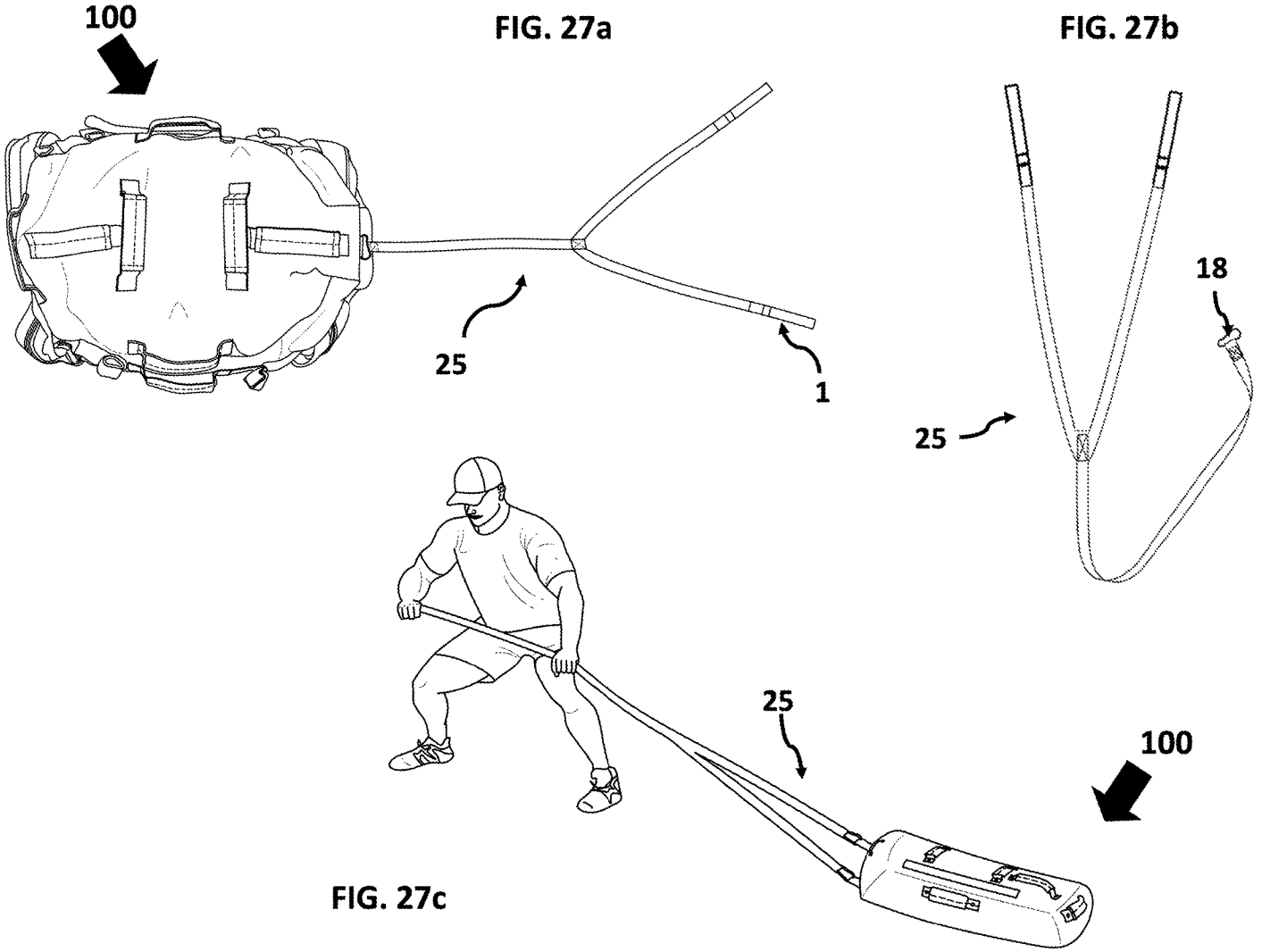
FIG. 27 is a perspective view of dragging components, more specifically

FIG. 22 illustrates the preferred method to place a harness 14 onto the upper body, followed by the set up to dragging a litter 32. It is to be understood FIG. 22 illustrates a preferred method however, is not required.

A user can attach one or more connecting straps such as a connecting strap 14*a*, connecting variation strap 14*b*, grip connecting strap 25, and/or grip variation strap 25*a* for suspension training. For example, a user can wrap around one or more straps to a fixed object such as a tree and then attach via hook 18 to one or more hooks 18 on the same connecting strap and/or other connecting straps. The grips 1 are provided in a connecting strap 14*a*-14*b*, such as a grip connecting strap 25 and/or grip variation strap 25*b* for exercises such as decline rows, and internal/external rotation in one or more joints.

In some instances, a user has options to attach one or more straps of connecting straps previously listed. For example, FIG. 23*e* illustrates a user wearing a harness 14 with a chest kit 14*c* which one or more straps of a connecting strap 14*a* and/or similar straps of the connecting strap 14 hauling a litter.

A grip 1 may not be provided for one or more connecting strap 14*a* and connecting variation strap 14*b*. A user can attach a limb strap 26 loop 4 to one or more hooks 18 one either connecting straps be used as a grip 1 for wrist and/or ankles for suspension training. Also, a user can attach other objects to a connecting strap for another usage.

It is to be understood a limb strap 26 can comprise of compressed lining 16, fasteners such as a hook and loop fastener 5 with binding, one or more loops 4 and securing elements 2 to wrap around the user's wrist without discomfort then attached by one or more hooks 18 of a connecting strap 14*a*-14*b* to haul the training bag 100 and/or other devices for dragging, pushing and pulling exercises.

The user can utilize one or more individual straps of a connecting strap 14*a*-14*b* hook 18 to attach to an individual grip 1 and then onto the training bag 100 for suspension training. More specifically, baseball pitchers' primary muscles are the rhomboids and rotator cuff. The user performs exercises such as "Y's, T's, and W's" to target the rhomboids which drag the training bag 100.

Example: Grip Variation Connecting Strap and Variation Connecting Strap 14*b*

The user can perform similar exercises as connecting straps 14*a*-14*b*, however, the grip variation connecting straps 25 is more convenient as the ending points comprise grips 1. As such, the user can attach other objects related or unrelated to the training bag 100 components such as a cable machine. One or more individual ending points can attach to a hook 18 of a cable machine for exercises such as face pulls, pulldowns and chest flies just to name a few.

Limb Strap

FIG. 21*c* illustrates a closed configuration of a limb strap 26. Accordingly, the exterior fabric of the limb strap 26 is a mixture of polyester and/or nylon, and woven tape 3 which may include an additional securing element 2 such as one or more rivets along with PVC coating creating durability along with liquid proof. At least one loop 4 is fixed on the limb strap 26, and at least one loop 4 is removable via a fastener 6 held by at least one layer of Nylon and/or similar thread 9. The limb strap 26 is attached by at least one hook and loop fastener 5, configured to wrap around the entire limb, allowing the user to adjust the limb strap 26 to the size of their limb. The interior fabric comprises of compressed lining 16 which is similar foam padding for additional cushioning.

In some embodiments, Nylon and/or similar threading 9 may be positioned to attach all of the fabrics together as a whole. For example, when manufacturing, the Nylon thread and/or similar threading 9, such as binding 10, can be stitched through one or more fabrics and with one or more layers of limb strap 26 fabric, Nylon and/or similar thread. The fabric may be stitched through more than two times, to structure all fabrics in a denser area, such as the fabric around one or more loop 4.

In some embodiments, the outer layer fabric of one or more limb strap 26 can be folded over the top and/or the bottom of the compressed lining 16, configured to be operable as foam to prevent any discomfort to the user's skin.

In some embodiments, the limb strap 26 is configured with at least one loop 4, with the circumference of at least a half an inch, around the perimeter, but not limiting to various measurements prior or subsequently to manufacturing.

It is to be understood that one or more loops 4 can be manufactured with at least one limb strap 26 for one or more optional attachable objects such as grip connecting strap 25 and/or grip variation connecting strap 25*a*.

In some embodiments, one or more optional animations can be located around the perimeter of the limb strap 26 prior to retail. However, it may be convenient to include customized cosmetic appearance, such as an organization logo during production.

Example: Limb Strap for Rehabilitation

With one or more loops 4 provided around the limb strap 26, the user has multiple choices to use the limb strap 26, in combination with training bag 100, similar to the examples listed earlier in the detailed description.

The limb strap 26 can be used without being attached to the training bag 100. For example, a user with a damaged and/or injured hand can wear the limb strap 26 around the wrist, then attaching onto a cable machine via hook 18 then onto one or more loops 4 for internal, external, flexion, extension of the shoulder, in particularly the rotator cuff without any usage of the hand.

In an example where there is a user with a damaged and/or injured hip, a progression stage may include leg raises on a cable machine by attaching a limb strap 26 to a cable machine via cable hook on to one or more loops 4 around the perimeter of the limb strap 26 for leg raises, including hip flexor flexion, extension, abduction, adduction internal and external rotation.

Sling 23

In some embodiments, a sling 23 may have at least one rubber elastic to increase the resistance and when used with or without the training bag 100 and/or other accessories. The cover coating overtops the rubber elastic and can comprise of nylon with PVC and/or PU coating to increase the durability of the sling when pulling with a quick release.

In some embodiments, the exterior fabric of the sling can be viewed as fabric overlapping on the external surface 11*a* due to the repetition of the sling 23 extended.

In some embodiments, a sling 23 can comprise of one or more grips 1 which are viewed as the same and/or similar structure of a grip 1 of the external surface 11*a* of the training bag 100.

In some embodiments, one or more securing elements can hold the structure of the sling 23, allowing the user to pull an unlimited amount of weight with or without the training bag's 100 components.

Detachable Durable Surface 27

Figure 28:
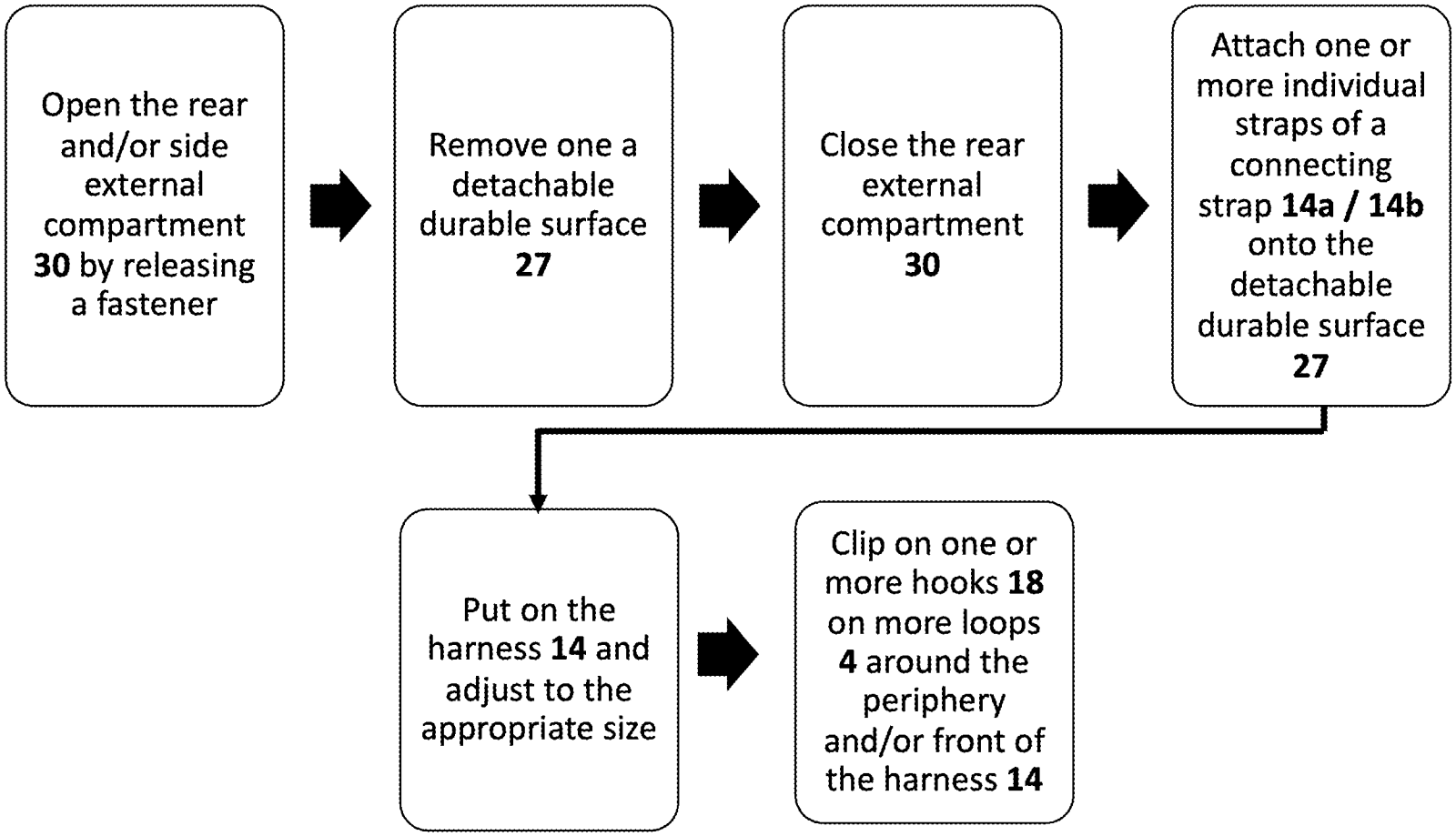
FIG. 28 is the preferred transition method to utilize a detachable durable surface.

FIG. 28 illustrates the preferred method for a detachable durable surface 27 set up set-up. It is to be understood FIG. 28 illustrates a preferred method however, is not required.

In some embodiments, a detachable durable surface 27 can comprise of the same or similar textile as the fixed durable surface 11 on the training bag 100 with the intended similar purposes.

In some embodiments, the training bag 100 can comprise of a slight opening which can be understood as an external compartment 30 around the surface area and/or perimeter of the training bag 100 in a closed bag and/or open bag configuration.

In some instances, the compartment opening can comprise of a fastener 6 such as a zipper 6*a* to secure the detachable durable surface 27 when not in use.

In some embodiments, a detachable durable surface 27 can comprise at least one layer selected from nylon, ballistic nylon, wool, silk, plants such as cotton, flax, jute, bamboo, minerals such as asbestos, glass fiber, and synthetics such as nylon, polyester, acrylic, and rayon, rubber, polyvinyl chloride (PVC) polyurethane (PU) coating and tarpaulin in combination thereof in the closed bag 100 and/or open bag configuration 101.

In some instances, the external compartment 30 opening can comprise of a fastener 6 such as at least one layer of a hook and loop fastener 5 to secure the detachable durable surface 27 when not in use. Prior to manufacturing, a user can request a detachable durable surface 27 with different textiles selected from metal, steel, carbon steel, alloy steel, stainless steel, iron (wrought or cast), aluminum, magnesium, copper, brass, bronze, zinc, titanium, tungsten, adamantium, nickel, cobalt, tin, lead, silicon with or without PVC and/or PU coating in combination thereof.

As illustrated in FIG. 29*d*, a detachable durable surface 27 is attached onto a hook 18 of a connecting strap to utilize for hauling exercises. It is to be understood the intended primary usage of a detachable durable surface 27 is for dragging without the training bag 100.

In some embodiments, an ending of the detachable durable surface 27 may have a visual of a slight elevation to secure all objects in place. Additionally, the elevation can comprise of a loop 4 to attach to optional objects such as a connecting strap to haul for dragging exercises but is not limited to other activities.

In some embodiments, a detachable durable surface 27 can comprise of one or more cavity holes to attach or detach optional objects, such as a connecting strap for dragging exercises, but not limited to other activities.

In some embodiments, a fastener strap such as a buckle can be located in different directions around the detachable durable surface 27 as depicted in FIG. 29*c*-29*d*, FIG. 30*a*-30*c* with minimal to no shifting.

Figure 30:
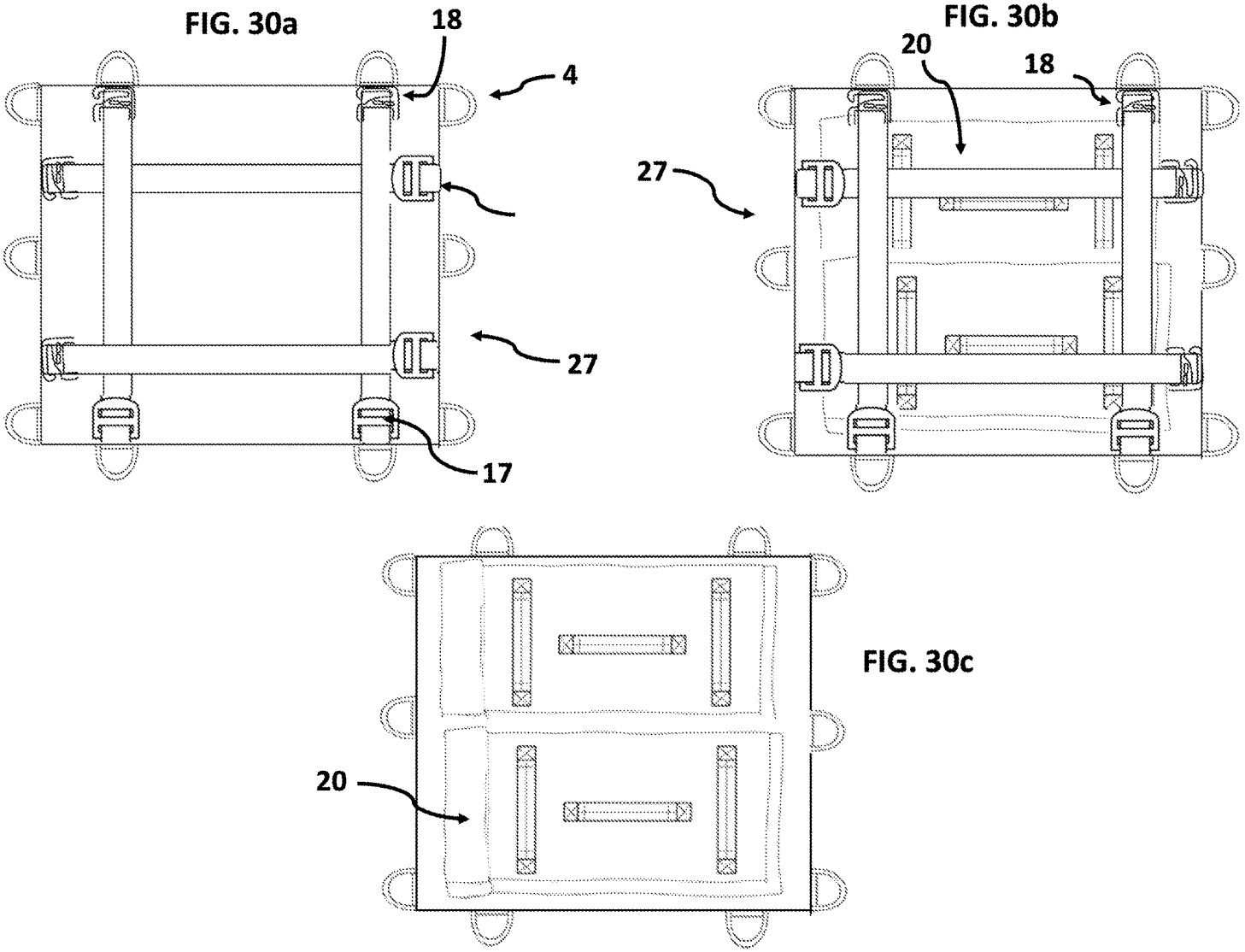
FIG. 30 is a detachable durable surface with weights, more specifically

In some embodiments, a hook and loop fastener strap 5 can be located in different directions around the detachable durable surface 27 as depicted in FIGS. 29*d* and 30*b* to secure all objects in place with minimal to no shifting. In some instances, the hook and loop fastener strap can be a removable adjustable weight strap 19.

In some embodiments, a detachable durable surface 27 can fold in half at least once to conveniently stow in a external compartment 30 and/or enclosure of the training bag 100.

In some embodiments, a fastener such as a buckle and/or hook and loop fastener can be secured to the surface area and/or perimeter by at least one securing element such as carbon fibers, fiberglass and/or glass fiber, aramid fibers, tow or stands in a bobbin, tape in a roll, woven in one or more layers of fabric and/or prepregs.

In more particular, a securing element 2 can include but is not limited to, thread stitching, rivets, adhesive, fabric glue, at least one metal rod and fastener, and fabric fold-over.

In some embodiments, an adjustable working strap 17 can comprise of one or more fastener straps to either loosen or tighten the length, depending on the size of the object.

In some embodiments, a user can stack weighted plates on top of one another to be secured by one or more fasteners previously described with a fastener and adjustable working strap 17 under and/or over to decrease shifting when performing physical activity.

In some embodiments, a user can stack and/or attach filler weights 20 to one or more securable elements on the external surface of the detachable durable surface 27 as depicted in FIG. 30*b*.

In some embodiments, the detachable durable surface 27 can be viewed with a slight elevation, depending on before manufacturing. For example, a detachable durable surface 27 can comprise of one sheet of metal which a perspective side view flat on a surface. In some instances, the detachable durable surface 27 can comprise of one or more fabrics such as nylon and/or canvas resulting in a slight elevation.

It is to be understood a detachable durable surface 27 can further be viewed as a similar structure to the durable surface 11 of the training bag 100.

In some embodiments, a detachable durable surface 27 is designed as an accessory to utilize with the training bag 100 as a draggable component. In some instances, prior to manufacturing, a training bag 100 can comprise the front external surface 11*a* of the bag with grips 1, MOLLE attachments, and animations as the external surface. This allows the user to utilize the training bag 100 with more grips 1 and/or loops around the external surface 11*a*. The user can then open the external compartment 30, manually remove the detachable surface 27, strap on one or more training bags 100, secured by at least one fastener 6, wherein a fastener 6 is selected from buckles, hook and loop fastener, adjustable working straps, hooks, pins clips combined in thereof. The user can attach one or more connecting straps onto the detachable durable surface 27 to pull like a sled.

In some instances, a detachable durable surface 27 can be retailed separately as an additional accessory with the training bag's 100 components.

Example: Detachable Durable Surface 27

As previously mentioned in the rear foam surface 16, the detachable durable surface 27 can be removed from the external compartment 30, unfolded onto a surface, and secured by one or more fasteners 6 and/or securing elements 2 for dragging exercises. For example, a training bag 100 without a durable surface 11 can attach to one or more fasteners 6 around the external surface 11*a* of the detachable durable surface 27 and then be dragged by one or more connecting straps 14*a*-14*b* attached to one or more loops 4 around the external surface and/or periphery of the detachable durable surface 27.

A user can implement the same and modified exercises as dragging the training bag 100 as a sled, however, this detachable durable surface 27 is an addition to utilizing the training bag 100 and its components.

During long-distance trekking, a user can purchase the training bag 100 with a rear foam surface to utilize as a hiking bag to carry around camping equipment. At any given point, a user has the option to remove the detachable durable surface, place the training bag 100 over top secured by one or more securing elements, attached with a hook 18 from one or more individual straps and/or connecting straps 14*a*-14*b* then onto a harness 14 to haul the training bag 100. The rear surface of the detachable durable surface will not damage in regards to the previously mentioned elements.

Example: Detachable Durable Surface with One or More Connecting Straps with Limb Strap A user has the option to connect a limb strap 26 to a connecting strap 14*a* and/or variation strap 14*b* via hook 18 on to a loop 4 on a limb strap then wrapped around the users wrist and/or ankles, securing minimal to no movement. The user has the option to perform reverse runs, lunges and with a variation with rows.

A user has the option to connect a limb strap 26 to a connecting strap 14*a* and/or variation strap 14*b* via hook 18 on to a loop 4 on a limb strap then wrapped around the users wrist and/or ankles, securing minimal to no movement. The user has the option to perform reverse runs, lunges and with a variation with rows.

For sports such as baseball, pitchers usually avoid unnecessary stress on the wrist due to their primary movers during a game. A limb strap 26 attached to a connecting strap 14*a* which is then attached via hook 18 to one or more loops 4 around the perimeter of the training bag 100 will eliminate stress but still targeting the lower body and upper back for rows.

Litter 32

It is to be understood the training bag 100 can be viewed as a military gear with or without the components such as the harness, backpack straps, connecting straps, detachable durable surface, and other working parts. When retailed, the training bag 100 can comprise various rescue components such as attachable holsters 35, flashlights, reflectors around the surface area, and periphery of the training bag 100.

In some instances, the external compartment 30 can comprise a litter 32 which is considered as a rescue basket for training without the training bag 100. For example, a user can conveniently transport the litter 32 in the rear external compartment 30 of the training bag 100, folded at least once.

In some instances, the litter 32 and detachable durable surface 27 can be viewed as a similar structure when released and removed out of the external compartment 30.

In some embodiments, the litter 32 may comprise of one or more cavity holes around the surface area and/or perimeter to latch on a hook from a connecting strap 14*a*-14*b* which is then attached to the harness 14 for pulling drills, such as real-life combat scenarios.

In some embodiments, the litter 32 can comprise one or more adjustable straps vertically and/or horizontally with the intended purpose to secure a mammal in place. It is to be understood a rescue basket can comprise personal objects for easy transport. This is convenient for users which eliminates stress when hauling with the arms backward.

Referring back to FIG. 23*e*, a user wearing a harness 14 with one strap of connecting straps attached to the rear loop and the front hole of the litter 32 hauling an injured mammal. This method can simulate a scenario during tactical and/or military training.

In some embodiments, one or more straps of a connecting strap 14*a*-14*b* can be attached to either side and/or rear of one or more holes of the litter 32.

In some embodiments, the litter 32 can comprise at least one layer of the water-repellent coating such as PVC and/or PU coating in the interior and/or exterior.

In some embodiments, a litter 32 can comprise of a slight rounding of one or more surface areas and perimeter to secure a mammal and/or other objects in place.

In some embodiments, an adjustable weight strap 19 in the enclosure of the training bag 100 can be viewed as a similar securable strap in the litter 32. In some instances, an adjustable working strap can be provided, either fixed and/or removable to expand the length and/or width, depending on the size of the mammal and/or objects.

In some embodiments, a cover comprising of foam and at least one layer of water-repellent such as PVC and/or PU coating can be provided and retailed with the litter 32 to securely fit around the litter 32 to protect all mammals and/or objects in the enclosure without damage.

Shoulder Strap 15

In some embodiments, a shoulder strap 15 can be retailed with the training bag 100 to utilize as a duffle bag.

As previously depicted in FIG. 1*d*, a user is utilizing the training bag 100 as a duffle bag to either carry related components to the training bag 100 apparatus and/or personal belongings.

In some embodiments, a shoulder strap 15 can comprise one or more layers of compressed fabric in the outer and inner surface of the shoulder strap 15.

In some embodiments, a shoulder strap 15 can further comprise of nylon stitching around the periphery of the shoulder strap 15 compressed lining 16. Additionally, the top strap can be fixed to decrease gliding movements when carrying the training bag 100 and/or other objects.

In some embodiments, a shoulder strap 15 can comprise of adjustable working straps 17 located in the middle for convenience to adjust the length, depending on the user's appropriate body size.

It is to be understood the adjustable working strap 17 can glide along with the fabric to as high and as low depending on the length adjusted too.

In some embodiments, a shoulder strap 15 can further comprise of at least one hook 18 to either ending of the shoulder strap 15 to attach onto one or more loops 4 around the training bag 100.

It is to be understood a user can attach the shoulder strap 15 hook onto other elements such as grips 1, exterior hook and loop fold overs, and securing elements 2.

In some embodiments, a shoulder strap 15 can comprise of a MOLLE attachments design which can comprise of at least one layer of woven tape with one or more securing elements 2.

In some embodiments, a shoulder strap 15 is attached to two loops 4 around the training bag 100 to be utilized as a duffle bag.

In some embodiments, the training bag 100 can comprise of unrelated objects in the enclosure to utilize as a duffle bag, such as baseball gloves, clothing, sandals, gun holster and also the optional attachable objects such as but not limited to one or more connecting straps, harness, sand fillers, backpack strap, and a detachable durable surface 27.

In some embodiments, a shoulder strap 15 can comprise of at least one layer of foam in the interior for padding with one or more layers of textiles selected from nylon, ballistic nylon, Kevlar®, wool, silk, plants such as cotton, flax, jute, bamboo, minerals such as asbestos, glass fiber, and synthetics such as nylon, polyester, acrylic, and rayon in combination thereof. It is to be understood prior to manufacturing, the user can request one layer off and/or a mixture of all layers with at least one layer of polyvinyl chloride (PVC) and/or polyurethane (PU) coating in an open and/or closed configuration or a mixture of textiles of the above, before manufacturing.

In some embodiments, at least one fabric by-way-of-the-shoulder strap 15 padding can comprise an adjustable working strap 17 to loosen or tighten the length of the shoulder strap 15.

In some embodiments, a shoulder strap 15 can comprise of at least one hook 18 selected from swivel hook with latches, hanging hook with latches, positive latching hooks, sorting hooks, foundry hooks, J-hooks, grab hooks, drum/barrel hooks, carabiner (shape of a wide, pear oval, D shaped positioning), thor carabiner, Mantus M2 hook, Rulaii hooks, Gorilla hooks and/or monkey hooks in combination thereof. The above listed can be elaborated on and further described as a hook.

At least one hook on a shoulder strap is recommended to attach to the side loop of the training bag 100 to evenly distribute the weight on each side. However, it is up to the user's discretion to utilize the shoulder strap in a preferred way.

Training Bag Cover

In some embodiments, a training bag cover can be retailed with the training bag 100 and components to utilize in different weather conditions.

In some embodiments, a training bag cover can comprise of a single layer of textile and/or more than one layer with water repellent PVC and/or PU coating.

In some embodiments, a training bag cover can comprise of fasteners around the surface area and periphery to attach onto one or more loops of the training bag 100 to securely protect all areas of the training bag 100.

In some embodiments, a training bag covering 100 can be placed in the external compartment for quick access.

It is to be understood that all references to particular materials and dimensions are provided to detail example embodiments, and may not define the composition and dimensions of all embodiments.

Various embodiments of the invention have been described in detail. Since changes in and or additions to the above-described best mode may be made without departing from the nature, spirit or scope of the invention, the invention is not to be limited to those details but only by the appended claims.

Example embodiments having thus been described, it will be obvious that the same maybe varied in many ways. Such variations are not to be regarded as a departure from the intended spirit and scope of example embodiments, and all such modifications as would be obvious to one skilled in the art are intended to be included within the scope of the following claims.

Although the present invention has been described in terms of various embodiments, it is not intended that the invention be limited to these embodiments. Modification within the spirit of the invention will be apparent to those skilled in the art.

While various embodiments in accordance with the principles disclosed herein have been described above, it should be understood that they have been presented by way of example only, and are not limiting. Thus, the breadth and scope of the invention(s) should not be limited by any of the above-described exemplary embodiments but should be defined only in accordance with the claims and their equivalents issued from this disclosure. Furthermore, the above advantages and features are provided in described embodiments, but shall not limit the application of such issued claims to processes and structures accomplishing any or all of the above advantages.

It will be understood that the principal features of this disclosure can be employed in various embodiments without departing from the scope of the disclosure. Those skilled in the art will recognize, or be able to ascertain using no more than routine experimentation, numerous equivalents to the specific procedures described herein. Such equivalents are considered to be within the scope of this disclosure and are covered by the claims.

Additionally, the section headings herein are provided as organizational cues. These headings shall not limit or characterize the invention(s) set out in any claims that may issue from this disclosure. Specifically, and by way of example, although the headings refer to a "Field" such claims should not be limited by the language under this heading to describe the so-called technical field.

Further, a description of the technology in the "Background" section is not to be construed as an admission that technology is prior art to any invention(s) in this disclosure. Neither is the "Brief Summary" to be considered a characterization of the invention(s) set forth in issued claims. Furthermore, any reference in this disclosure to "invention" in the singular should not be used to argue that there is only a single point of novelty in this disclosure. Multiple inventions may be set forth according to the limitations of the multiple claims issuing from this disclosure, and such claims accordingly define the invention(s), and their equivalents, that are protected thereby. In all instances, the scope of such claims shall be considered on their own merits in light of this disclosure, but should not be constrained by the headings set forth herein.

The use of the word "a" or "an" when used in conjunction with the term "comprising" in the claims and/or the specification may mean "one," but it is also consistent with the meaning of "one or more," "at least one," and "one or more than one." The use of the term "or" in the claims is used to mean "and/or" unless explicitly indicated to refer to alternatives only or the alternatives are mutually exclusive, although the disclosure supports a definition that refers to only alternatives and "and/or." Throughout this application, the term "about" is used to indicate that a value includes the inherent variation of error for the device, the the method being employed to determine the value, or the variation that exists among the study subjects.

As used in this specification and claim(s), the words "comprising" (and any form of comprising, such as "comprise" and "comprises"), "having" (and any form of having, such as "have" and "has"), "including" (and any form of including, such as "includes" and "include") or "containing" (and any form of containing, such as "contains" and "contain") are inclusive or open-ended and do not exclude additional, un-recited elements or method steps.

As used herein, words of approximation such as, without limitation, "about", "substantial" or "substantially" refers to a condition that when so modified is understood to not necessarily be absolute or perfect but would be considered close enough to those of ordinary skill in the art to warrant designating the condition as being present. The extent to which the description may vary will depend on how great a change can be instituted and still have one of ordinary skilled in the art recognize the modified feature as still having the required characteristics and capabilities of the unmodified feature. In general, but subject to the preceding discussion, a numerical value herein that is modified by a word of approximation such as "about" may vary from the stated value by at least ±1, 2, 3, 4, 5, 6, 7, 10, 12, or 15%.

The term "or combinations thereof" as used herein refers to all permutations and combinations of the listed items preceding the term. For example, "A, B, C, or combinations thereof is intended to include at least one of A, B, C, AB, AC, BC, or ABC, and if the order is important in a particular context, also BA, CA, CB, CBA, BCA, ACB, BAC, or CAB. Continuing with this example, expressly included are combinations that contain repeats of one or more items or terms, such as BB, AAA, AB, BBC, AAABCCCC, CBBAAA, CABABB, and so forth. The skilled artisan will understand that typically there is no limit on the number of items or terms in any combination, unless otherwise apparent from the context.

All of the compositions and/or methods disclosed and claimed herein can be made and executed without undue experimentation in light of the present disclosure. While the compositions and methods of this disclosure have been described in terms of preferred embodiments, it will be apparent to those of skill in the art that variations may be applied to the compositions and/or methods and in the steps or the sequence of steps of the method described herein without departing from the concept, spirit, and scope of the disclosure. All such similar substitutes and modifications apparent to those skilled in the art are deemed to be within the spirit, scope, and concept of the disclosure as defined by the appended claims.

What is claimed is:

1. A training bag comprising:

a top external surface;

a rear durable surface;

a periphery surface;

an internal surface;

at least one fastener, wherein the at least one fastener extends from the top external surface to the rear durable surface, the at least one fastener comprising:

a first component; and a second component;

wherein when the first component and the second component of the at least one fastener are not engaged with each other, a portion of the top external surface of the training bag is configured to contact aground surface, wherein a portion of the rear durable surface of the training bag is configured to contact the ground surface when the training bag is in an open bag configuration, wherein when the training bag is in the open bag configuration, a set of weight straps are revealed and are secured to the internal surface, wherein the rear durable surface comprises one or more layers of durable material, wherein at least one layer of durable material of the one or more layers of durable material extends to and overlaps with the periphery surface of the training bag; and one or more sets of grips, wherein:

a first grip and a second grip of the one or more sets of grips are positioned horizontally on the periphery surface, the first grip and the second grip being spaced apart from each other; and a third grip of the one or more sets of grips is positioned vertically on the top external surface of the training bag; and one or more loops, wherein at least one loop of the one or more loops is secured to the periphery surface of the training bag and is configured to temporarily secure one or more attachments, wherein at least one attachment of the one or more attachments includes a removable strap configured for dragging the training bag on the ground surface when the training bag is in a closed bag configuration.

2. The training bag according to claim 1, wherein the first grip of the one or more sets of grips comprises of a first layer of fabric and a second layer of compressed lining, wherein the first grip of the one or more sets of grips is secured to the periphery surface of the training bag.

3. The training bag according to claim 1, wherein the at least one layer of durable material of the rear durable surface comprises water proof coating.

4. The training bag according to claim 1, wherein when the rear durable surface contacts the ground surface, the training bag is configured for at least one exercise, wherein the at least one exercise includes dragging the training bag when in the closed bag configuration via a drag line.

5. The training bag according to claim 1, wherein the at least one layer of durable material extends to and overlaps with the periphery surface of the training bag when the training bag is in a closed bag configuration, wherein the rear durable surface is water resistant and flexible.

6. The training bag according to claim 1, wherein a first weight strap of the set of weight straps is secured to the internal surface of the training bag in a vertical orientation and a second weight strap of the set of weight straps is secured to the internal surface of the training bag in a horizontal orientation, wherein the first weight strap and the second weight strap each comprises a fastener.

7. A training bag comprising:

a top external surface;

a rear durable surface;

a periphery surface;

an internal surface;

at least one fastener, wherein the at least one fastener extends from the top external surface to the rear durable surface, the at least one fastener comprising:

a first component; and a second component;

wherein the first component is secured to the top external surface and the second component is secured to the periphery surface, wherein when the first component and the second component of the at least one fastener are not engaged with each other, a portion of the top external surface of the training bag is configured to contact aground surface, wherein a portion of the rear durable surface of the training bag is configured to contact the ground surface when the training bag is in an open bag configuration, wherein when the training bag is in the open bag configuration, a set of weight straps are revealed and are secured to the internal surface, wherein the rear durable surface comprises one or more layers of durable material, wherein at least one layer of durable material of the one or more layers of durable material extends to and overlaps with the periphery surface of the training bag; and one or more sets of grips, wherein:

a first grip and a second grip of the one or more sets of grips are positioned horizontally on the periphery surface, the first grip and the second grip being spaced apart from each other; and a third grip of the one or more sets of grips is positioned vertically on the top external surface of the training bag; and one or more loops, wherein at least one loop of the one or more loops is secured to the periphery surface of the training bag and is configured to temporarily secure one or more attachments, wherein at least one attachment of the one or more attachments includes a removable strap configured for dragging the training bag on the ground surface when the training bag is in a closed bag configuration.

8. The training bag according to claim 7, wherein the at least one fastener is a zipper, wherein the zipper extends from the top external surface to the rear durable surface and is configurable for transitioning the training bag between the open bag configuration and a closed bag configuration.

9. A training bag comprising:

a top external surface;

a rear durable surface;

a periphery surface;

an internal surface;

at least one fastener, wherein the at least one fastener extends from the top external surface to the rear durable surface, the at least one fastener comprising:

a first component; and a second component;

wherein the first component is secured to the top external surface and the second component is secured to the periphery surface, wherein when the first component and the second component of the at least one fastener are not engaged with each other, a portion of the top external surface of the training bag is configured to contact aground surface, wherein a portion of the rear durable surface of the training bag is configured to contact the ground surface when the training bag is in an open bag configuration, wherein when the training bag is in the open bag configuration, a set of weight straps are revealed and are secured to the internal surface, wherein the rear durable surface comprises one or more layers of durable material, wherein at least one layer of durable material of the one or more layers of durable material extends to and overlaps with the periphery surface of the training bag; and one or more sets of grips, wherein:

a first grip and a second grip of the one or more sets of grips are positioned horizontally on the periphery surface, the first grip and the second grip being spaced apart from each other; and a third grip of the one or more sets of grips is positioned vertically on the top external surface of the training bag;

one or more loops, wherein at least one loop of the one or more loops is secured to the periphery surface of the training bag and is configured to temporarily secure one or more attachments, wherein at least one attachment of the one or more attachments includes a removable strap configured for dragging the training bag on the ground surface when the training bag is in a closed bag configuration; and a set of removable backpack straps configured to attach onto a user.

10. The training bag according to claim 9, wherein the at least one fastener is a zipper, wherein the zipper extends from the top external surface to the rear durable surface and is configurable for transitioning the training bag between the open bag configuration and an closed bag configuration.

11. The training bag according to claim 4, wherein a first weight strap of the set of weight straps is secured to the internal surface of the training bag in a vertical orientation and a second weight strap of the set of weight straps is secured to the internal surface of the training bag in a horizontal orientation, wherein the first and the second weight strap each comprises a fastener.

12. The training bag according to claim 11, wherein at least one weight strap of the set of weight straps is secured to the internal surface of the training bag, wherein the at least one weight strap comprises an adjustable fastener.

13. The training bag according to claim 9, wherein the first grip of the one or more sets of grips comprises a first layer of fabric and a second layer of compressed lining, wherein the first grip is secured to the periphery surface of the training bag.

14. The training bag according to claim 9, wherein the third grip of the one or more sets of grips comprises at least one layer of fabric.

15. The training bag according to claim 9, wherein the removable strap is configured for dragging the training bag on the ground surface when the training bag is in the closed bag configuration via a drag line.

16. The training bag according to claim 9, wherein the at least one layer of durable material of the rear durable surface extends to and overlaps with the periphery surface to increase the durability of the training bag.

* * * * *